US009027786B2

(12) United States Patent
Doyle et al.

(10) Patent No.: US 9,027,786 B2
(45) Date of Patent: May 12, 2015

(54) PACKAGING SYSTEMS AND METHODS

(76) Inventors: Mark C. Doyle, Del Mar, CA (US); Linda S. Luoma, Fallbrook, CA (US); Roy S. Luoma, Fallbrook, CA (US)

( * ) Notice: Subject to any disclaimer, the term of this patent is extended or adjusted under 35 U.S.C. 154(b) by 28 days.

(21) Appl. No.: 13/344,577

(22) Filed: Jan. 5, 2012

(65) Prior Publication Data

US 2012/0145586 A1 Jun. 14, 2012

Related U.S. Application Data

(63) Continuation of application No. 13/090,209, filed on Apr. 19, 2011.

(60) Provisional application No. 61/421,171, filed on Dec. 8, 2010.

(51) Int. Cl.

| | |
|---|---|
| ***B65D 83/04*** | (2006.01) |
| ***B65D 75/32*** | (2006.01) |
| ***A61J 1/03*** | (2006.01) |
| ***A61J 7/04*** | (2006.01) |
| ***B65D 73/00*** | (2006.01) |
| ***B65D 75/24*** | (2006.01) |
| ***B65B 11/50*** | (2006.01) |
| ***A61J 7/00*** | (2006.01) |

(52) U.S. Cl.

CPC ..... *B65D 75/326* (2013.01); *A61J 1/035* (2013.01); *A61J 7/04* (2013.01); *A61J 2205/10* (2013.01); *A61J 2205/30* (2013.01); *B65D 73/0014* (2013.01); *B65D 73/0028* (2013.01); *B65D 75/24* (2013.01); *B65D 75/327* (2013.01); *B65D 83/0472* (2013.01); *B65D 2203/00* (2013.01); *B65D 2203/06* (2013.01); *B65D 2203/10* (2013.01); *B65D 2215/04* (2013.01); *B65D 2575/3227* (2013.01); *B65D 2575/3245* (2013.01); *B65D 2575/3263* (2013.01); *B65D 2575/3272* (2013.01); *B65D 2575/3281* (2013.01); *A61J 2205/60* (2013.01); *B65B 11/50* (2013.01); *B65D 2583/0409* (2013.01); *B65D 2583/0413* (2013.01); *B65D 2583/0418* (2013.01); *A61J 7/0084* (2013.01)

(58) Field of Classification Search

USPC ..... 221/2, 4, 25, 26, 30, 69, 70, 71, 87, 88

See application file for complete search history.

(56) References Cited

U.S. PATENT DOCUMENTS

| | | | | |
|---|---|---|---|---|
| 2,758,710 | A * | 8/1956 | Arens | 221/25 |
| 3,311,229 | A * | 3/1967 | Troll et al. | 206/461 |
| 3,410,450 | A * | 11/1968 | Fortenberry | 221/7 |

(Continued)

*Primary Examiner* — Gene Crawford

*Assistant Examiner* — Kelvin L Randall, Jr.

(74) *Attorney, Agent, or Firm* — Kafantaris Law Offices; Theo Kafantaris

(57) ABSTRACT

An apparatus is provided for delivering single-dose packages sequentially from a substantially continuous strip having a first dispensing end and a second end. The strip includes a cover layer attached to a base layer to define a plurality of blisters therebetween that have one or more medications therein. The blisters are aligned in single file generally along the longitudinal axis between the first and second ends and/or otherwise arranged in single-dose packages adjacent one another, e.g., at least some of the single-dose packages including a plurality of blisters having different types of medications therein. A first single-dose package at the first dispensing end may be separable from a second adjacent single-dose package such that individual single-dose packages may be removed successively from the first dispensing end.

9 Claims, 51 Drawing Sheets

FIG. 26

(56) References Cited

U.S. PATENT DOCUMENTS

| | | | | | |
|---|---|---|---|---|---|
| RE29,705 | E * | 7/1978 | Compere | 206/531 |
| 4,274,550 | A * | 6/1981 | Feldstein | 221/71 |
| 4,305,502 | A * | 12/1981 | Gregory et al. | 206/532 |
| 4,307,955 | A * | 12/1981 | Cocco et al. | 396/582 |
| 4,340,141 | A | 7/1982 | Fischer | |
| 4,537,312 | A * | 8/1985 | Intini | 206/531 |
| 4,664,262 | A | 5/1987 | White | |
| 4,669,613 | A * | 6/1987 | Collens | 206/534 |
| 4,733,797 | A * | 3/1988 | Haber | 221/8 |
| 4,838,425 | A * | 6/1989 | O'Brien et al. | 206/531 |
| 4,884,693 | A | 12/1989 | Brüsch | |
| 4,905,866 | A | 3/1990 | Bartell et al. | |
| 4,911,291 | A * | 3/1990 | Iwata et al. | 206/223 |
| 4,958,736 | A | 9/1990 | Urheim | |
| 5,788,974 | A * | 8/1998 | D'Amico et al. | 424/405 |
| D414,106 | S * | 9/1999 | Anderson | D3/203.3 |
| D421,900 | S * | 3/2000 | Eneroth et al. | D9/732 |
| 6,131,738 | A | 10/2000 | DeJonge | |
| 6,244,442 | B1 * | 6/2001 | Inoue et al. | 206/531 |
| 6,345,717 | B1 * | 2/2002 | Flewitt | 206/531 |
| 6,357,593 | B1 | 3/2002 | Bolnick et al. | |
| 6,375,956 | B1 | 4/2002 | Hermelin et al. | |
| 6,527,138 | B2 * | 3/2003 | Pawlo et al. | 221/26 |
| 6,598,745 | B2 | 7/2003 | Bolnick et al. | |
| 6,920,974 | B2 | 7/2005 | Reynolds et al. | |
| 6,945,400 | B2 | 9/2005 | Bolnick et al. | |
| 7,210,580 | B2 | 5/2007 | Elliott | |
| 7,489,594 | B2 | 2/2009 | Simon et al. | |
| 7,661,530 | B1 | 2/2010 | Hewitt | |
| 7,959,004 | B2 * | 6/2011 | Tsao | 206/531 |
| 2002/0153278 | A1 | 10/2002 | Pirro et al. | |
| 2002/0162768 | A1 | 11/2002 | Bolnick | |
| 2003/0111535 | A1 * | 6/2003 | Sacchetti et al. | 235/462.01 |
| 2003/0168376 | A1 * | 9/2003 | Taneja et al. | 206/534 |
| 2003/0200726 | A1 | 10/2003 | Rast | |
| 2004/0011693 | A1 | 1/2004 | Prenger et al. | |
| 2004/0026293 | A1 * | 2/2004 | Hughes | 206/538 |
| 2004/0040881 | A1 | 3/2004 | Grosskipf | |
| 2004/0178112 | A1 | 9/2004 | Snyder | |
| 2004/0188312 | A1 | 9/2004 | Stepowany | |
| 2004/0188314 | A1 | 9/2004 | Rock et al. | |
| 2005/0011804 | A1 | 1/2005 | Zanden et al. | |
| 2005/0087472 | A1 * | 4/2005 | Elliott | 206/528 |
| 2005/0145532 | A1 | 7/2005 | Kancsar et al. | |
| 2006/0042988 | A1 | 3/2006 | Hjalmarsson | |
| 2006/0065670 | A1 * | 3/2006 | Doublet et al. | 221/1 |
| 2006/0283749 | A1 * | 12/2006 | Wolfe et al. | 206/462 |
| 2006/0289328 | A1 | 12/2006 | Hession | |
| 2007/0007162 | A1 | 1/2007 | Buller | |
| 2007/0039851 | A1 | 2/2007 | Rasanen et al. | |
| 2007/0056876 | A1 | 3/2007 | Jones | |
| 2007/0080090 | A1 * | 4/2007 | Gherdan et al. | 206/531 |
| 2007/0084746 | A1 | 4/2007 | Udo et al. | |
| 2007/0084747 | A1 * | 4/2007 | Gherdan et al. | 206/531 |
| 2007/0095715 | A1 | 5/2007 | Simon et al. | |
| 2007/0151893 | A1 | 7/2007 | Barndt et al. | |
| 2007/0151894 | A1 | 7/2007 | Gherdan, Jr. et al. | |
| 2007/0221534 | A1 | 9/2007 | Initini | |
| 2007/0235367 | A1 | 10/2007 | Initini | |
| 2007/0235369 | A1 | 10/2007 | Perell | |
| 2007/0241552 | A1 * | 10/2007 | Watson et al. | 283/81 |
| 2007/0289258 | A1 | 12/2007 | Jung et al. | |
| 2007/0289893 | A1 | 12/2007 | Williams, Jr. | |
| 2008/0035520 | A1 | 2/2008 | Caracciolo et al. | |
| 2008/0047230 | A1 | 2/2008 | Jung et al. | |
| 2008/0110791 | A1 | 5/2008 | Specker | |
| 2008/0155941 | A1 | 7/2008 | Williams-Hartman | |
| 2008/0230432 | A1 | 9/2008 | Bobbett et al. | |
| 2008/0271417 | A1 | 11/2008 | Drost et al. | |
| 2008/0289989 | A1 * | 11/2008 | Kalvelage et al. | 206/531 |
| 2008/0302695 | A1 | 12/2008 | Meeren et al. | |
| 2009/0008285 | A1 | 1/2009 | Miller et al. | |
| 2009/0127154 | A1 | 5/2009 | Jeannin et al. | |
| 2009/0127155 | A1 | 5/2009 | Nottoli et al. | |
| 2009/0134053 | A1 | 5/2009 | Jeannin et al. | |
| 2009/0139893 | A1 * | 6/2009 | McGonagle et al. | 206/531 |
| 2009/0152155 | A1 | 6/2009 | Pasbrig | |
| 2009/0184022 | A1 | 7/2009 | Coe et al. | |
| 2009/0188828 | A1 | 7/2009 | Strub et al. | |
| 2009/0230013 | A1 * | 9/2009 | Born et al. | 206/531 |
| 2009/0242451 | A1 | 10/2009 | Kessler | |
| 2009/0277815 | A1 | 11/2009 | Kohl | |
| 2009/0283438 | A1 | 11/2009 | Bourque | |
| 2009/0283439 | A1 | 11/2009 | Barndt et al. | |
| 2009/0301924 | A1 | 12/2009 | Rondeau | |
| 2010/0000899 | A1 | 1/2010 | Burg et al. | |
| 2010/0044269 | A1 | 2/2010 | Arnold et al. | |
| 2010/0065464 | A1 | 3/2010 | Elliott | |
| 2010/0089791 | A1 | 4/2010 | Rosenbaum et al. | |
| 2010/0108559 | A1 | 5/2010 | Kohl | |
| 2010/0108677 | A1 | 5/2010 | Loftin et al. | |
| 2010/0270324 | A1 * | 10/2010 | Blum et al. | 221/25 |
| 2011/0262589 | A1 * | 10/2011 | Safarik | 426/5 |

* cited by examiner

PACKAGING SYSTEMS AND METHODS

RELATED APPLICATION DATA

This application is a continuation of co-pending application Ser. No. 13/090,209, which claims benefit of provisional application Ser. No. 61/421,171, filed Dec. 8, 2010, the entire disclosure of which is expressly incorporated by reference herein.

FIELD OF THE INVENTION

The present invention is related to packaging items into multiple single-use groups, e.g., to separable single-dose packages of medications, and to systems and methods for making and using such packaging.

BACKGROUND

Patients undergoing multiple drug regimens, or their caregivers, are required to manage multiple prescriptions and supplements. This includes ensuring that multiple tablets are ingested at predetermined times, in differing arrangements or dose groupings. For example, a patient taking four medications may have to take all four in the morning, one at mid-day, and three at night. In many cases, the number of prescriptions is large, and patients also take non-prescription medications, such as aspirin and calcium. Often medications are taken at different intervals, such as once a day, three times a day, or four times a day. Managing so many medications and administration times is often challenging, especially for impaired patients and overworked caregivers, administrators, or other users. The medications are typically supplied in multiple containers, each containing a single prescription medication, and the user must properly remove the medications from the containers, organize them into a dose grouping ("dose"), and administer them at the correct time. Errors are frequent, which may result in many health effects, including possibly re-hospitalization or death. Various organization devices have been employed to reduce errors, such as pill organization boxes, but these require the user to correctly load the box in order for them to be effective, a time consuming and inexact process. Thus, there is a need for systems and methods for pre-organizing medications to reduce labor and errors.

SUMMARY OF THE INVENTION

The present invention is directed to systems and methods for making and using packages, e.g., separable single-use packages. For example, a single-dose package may be provided that includes a plurality of blisters including different medications therein that is separable sequentially from other single-dose packages, e.g., provided as part of a substantially continuous strip or other dispensing arrangement.

In one embodiment, various medications intended to be ingested at a given time may be packaged together in a single easily identifiable and openable single-dose package. In another embodiment, the single-dose package may include medications disposed in a single-file arrangement. In another embodiment, the single-dose package may be included as part of a substantially continuous coil or serpentine arrangement of detachable sequential single-dose packages. In another embodiment, each single-dose package may be separable from the next dose package, e.g., by a perforation or other frangible features. In another embodiment, the single-dose package may include a cover configured to peel open from a web or base layer to release the medications in blisters of the package. In another embodiment, the single-dose package may be labeled with information to facilitate proper administration by the user (e.g., patient name, date of dose, time of dose). In another embodiment, the package may include tamper-evidence and/or childproofing features. In another embodiment, the single-dose package may include an adhesive strip or other feature for attaching at least a portion of the package, e.g., a cover, to a surface. In another embodiment, the single-dose package may include a peelable cover with an adhesive strip or other feature on an outer surface thereof to attach the cover to a surface such as a patient's record or chart. In another embodiment, the single-dose package may include machine readable information or other labels to permit automated dispensing of the package from a set of sequential single-dose packages. In another embodiment, the single-dose package may include holes, notches, and/or other physical features that may assist in automated dispensing of the package.

In an exemplary embodiment, the single-dose package may be part of a coil or serpentine arrangement of detachable sequential single-dose packages, e.g., adapted to be supplied in a box or other cassette. In such an embodiment, the coil or serpentine arrangement may be contained within the box or cassette such that a first end of the coil is accessible, e.g., from an outlet of the cassette, and may be removed far enough from the cassette to permit the user to detach the next single-dose package. In another embodiment, the cassette may include pertinent patient and medication information. In another embodiment, the cassette may include machine readable information, codes, strips, chips, and/or other features. In another embodiment, the cassette may include one or more child proofing features that prevent or resist a single-dose package on the first end from removal by children. In another embodiment, the cassette may include a drag feature, e.g., providing preferential resistance into but not out of the cassette, to prevent the first end from easily falling into the cassette. In another embodiment, the cassette may include a view window to permit viewing of the first end, e.g., to allow observation of information regarding the first single-dose package on the first end and/or the next single-dose package to be dispensed after the first package. It will be appreciated that the packages and/or cassettes herein may include any combination of the features described in the exemplary embodiments.

In accordance with another embodiment, an apparatus is provided for delivering single-dose packages sequentially from a substantially continuous strip having a first dispensing end and a second end. The strip may include an elongate base layer, and an elongate cover layer attached to the base layer to define a plurality of blisters therebetween that have one or more respective medications therein. The blisters may be aligned in single file generally along the longitudinal axis between the first and second ends and/or otherwise arranged in single-dose packages adjacent one another, e.g., at least some of the single-dose packages including a plurality of blisters having different types of medications therein. For example, a first single-dose package at the first dispensing end may be separable from a second adjacent single-dose package such that individual single-dose packages may be removed successively from the first dispensing end.

In accordance with still another embodiment, an apparatus is provided for delivering single-dose packages of medications sequentially from a substantially continuous strip having a first dispensing end and a second end. The strip may include an elongate base layer, and an elongate cover layer removably attached to the base layer to define a plurality of blisters therebetween that have one or more respective medications therein. The blisters may be aligned in single file generally along the longitudinal axis between the first and second ends and/or otherwise arranged in single-dose packages adjacent one another, e.g., at least some of the single-dose packages including a plurality of blisters having different types of medications therein. For example, a first single-dose package at the first dispensing end may be separable from a second adjacent single-dose package such that individual dose packages may be removed successively from the first dispensing end. In addition or alternatively, the cover layer of the removed first single-dose package may be separable from the base layer for accessing all of the medications within the one or more blisters of the first single-dose package such that the medications may be administered to a person as a single dose.

In accordance with yet another embodiment, an apparatus is provided for delivering single-dose packages of medications sequentially from a substantially continuous strip having a first dispensing end and a second end. The strip may include an elongate base layer including a flexible film, and an elongate cover layer removably attached to the base layer to define a plurality of substantially sealed blisters therebetween that have one or more respective medications therein. The blisters may be aligned in single file generally along the longitudinal axis between the first and second ends and/or wound in a coil such that the first dispensing end is accessible. The blisters may be arranged in single-dose packages adjacent one another. At least one of the cover layer and the base layer may include one or more frangible features extending transversely across the strip between adjacent single-dose packages such that a first single-dose package at the first dispensing end is separable from a second adjacent single-dose package such that individual single-dose packages may be removed successively from the first dispensing end. For example, the first single-dose package may include a plurality of blisters that are inseparable from one another and include different types of medications therein, and the cover layer of the removed first single-dose package may be attached to the base layer by an adhesive that allows the cover layer to be separated from the base layer substantially intact for accessing all of the medications within the blisters of the first single-dose package such that the medications may be administered to a person as a single dose.

While well disposed to aid in the administration of medications, the systems and methods disclosed herein may also be appropriate for other items meant to be used in groups. For example, kits of fasteners intended for assembly of products might be packaged in logical groupings using the systems and methods described herein. Dietary supplements are another example of items that might be so grouped into discrete single-dose or use single-packages. Thus, the contents of the packages described herein will be referred to as "items," and the packages as "single-use packages" or "packages."

Other aspects and features of the present invention will become apparent from consideration of the following description taken in conjunction with the accompanying drawings.

BRIEF DESCRIPTION OF THE DRAWINGS

It will be appreciated that the exemplary apparatus shown in the drawings are not necessarily drawn to scale, with emphasis instead being placed on illustrating the various aspects and features of the illustrated embodiments.

DETAILED DESCRIPTION

Figure 1A:
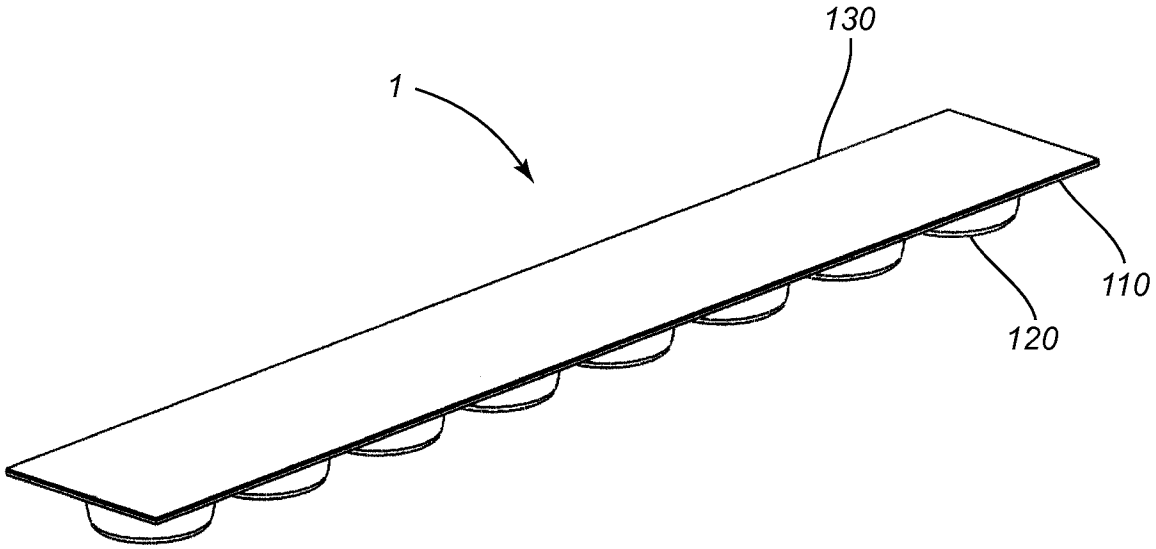
FIG. 1A is a perspective view of a first exemplary embodiment of a single-use package including a cover removably attached to a web or base layer.
Figure 1B:
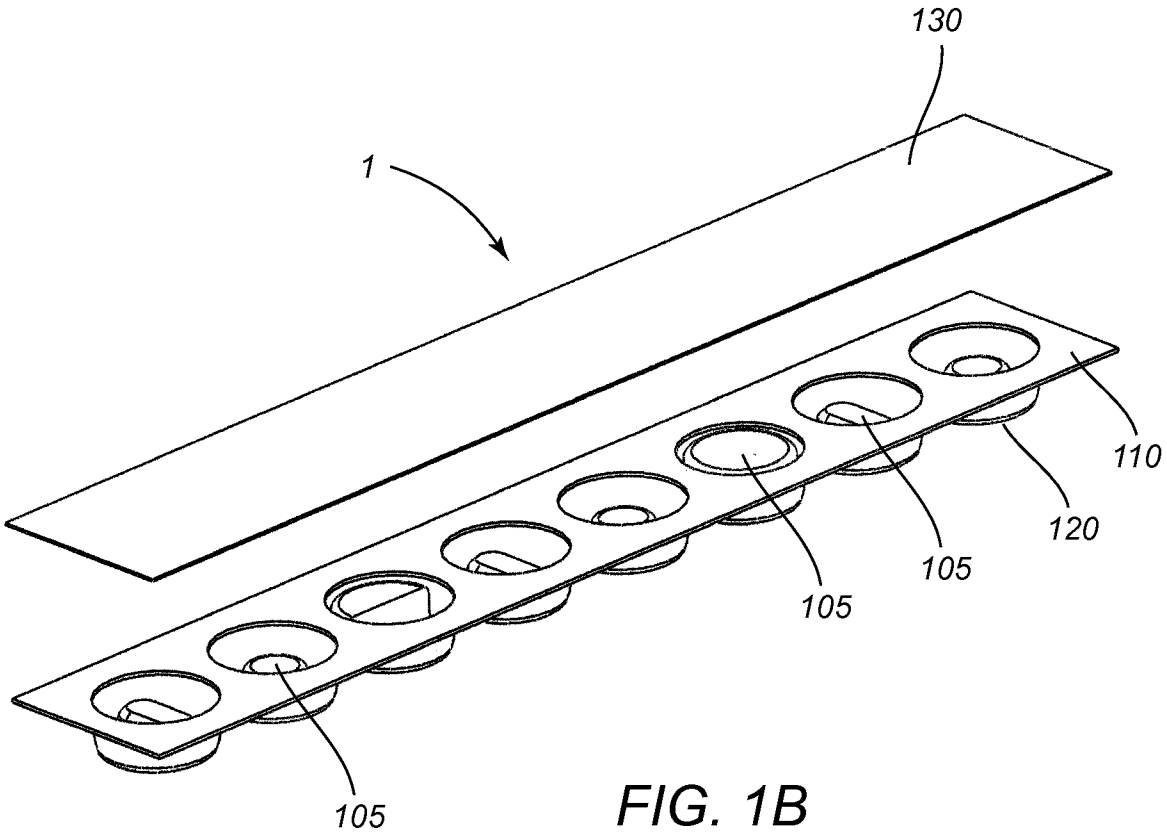
FIG. 1B is an exploded view of the package of FIG. 1A before the cover attached to the web.
Figure 1C:
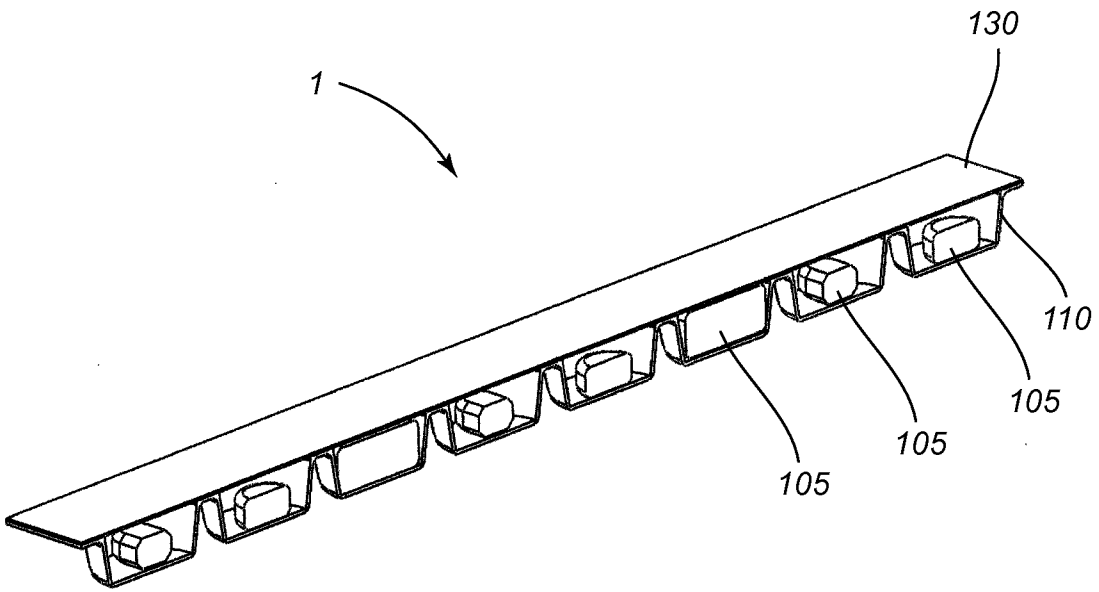
FIG. 1C is a cross-sectional view of the package of FIG. 1A taken along its length.

Turning to the drawings, FIGS. 1A-1C show an exemplary embodiment of a single-use package 1 including a plurality of items, e.g., medications 105, within blisters 120 of the package 1. As used herein, "single-use package" refers to a package, e.g., removed from a group of packages, that includes one or more related items that are intended to be used at substantially the same time. In the case of the items being medications, "single-dose package" refers to a package that includes one or more medications, e.g., a plurality of different medications, that are intended to be administered at substantially the same time to a patient. "Medication" refers to a tablet, capsule, or other dose of a compound intended for administration to a patient, e.g., for therapeutic, diagnostic, or other purpose, and may include prescription drugs, nutritional supplements, and the like.

Generally, with continued reference to FIGS. 1A-1C, the package 1 includes a web or base layer 110 and a cover layer 130 that are attached together to define one or more blisters, e.g., a plurality of blisters 120 therebetween. As shown, the web 110 includes a plurality of recesses that may be substantially enclosed by the cover 130 to define the blisters 120 containing respective medications or other items 105 therein. The cover 130 may be paper, polymers or other plastics, metal or foil materials, or other similar packaging materials. The cover 130 may include adhesive or welding features (not shown) to permit secure joining of the cover 130 to the web 110, e.g., while allowing the cover 130 to be subsequently peeled away or otherwise separated to access the items 150 within the blisters 120, as described further below.

The web 110 may be rigid, semi-rigid, or flexible, and may include a variety of materials, such as paper, polymers or other plastic, metal or foils, composite materials, and the like. For example, the web 110 may have sufficient rigidity to define recesses having predefined shapes, or the web 110 may be sufficiently flexible such that the web 110 may be elastically or otherwise deformed to define a recess to receive one or items therein, as described further below. In addition, the material of the web 110 may be opaque, translucent, transparent, optically clear, light filtering, and the like, as desired. In addition or alternatively, the web 110 may include adhesive or welding features (not shown) to permit secure joining of the cover 130 to the web 110 in addition to or instead of providing attachment features on the cover 130.

FIG. 1B shows the single-use package 1 of items 105 with the cover 130 prior to attachment to the web 110. The items 105 are placed into the blisters 120 in the web 110, e.g., before the cover 130 is attached to the web 110 to enclose the blisters 120, as described further below. The cover 130 includes a bottom face 150 adjacent a corresponding top face 140 on the web 110. Following placement of the items 105 into the blisters 120, the cover 130 is attached to the web 110, e.g., by bonding with adhesive, fusing, welding, and the like, such that the faces 140 and 150 are attached together, thus containing the items 105 within the blisters 120 defined by the web 110 and cover 130.

The single-use package 1 may be formed individually, e.g., by cutting or separating a desired section of material for the web 110 and cover 130 from a bulk source, e.g., a larger sheet, roll, and the like (not shown). Alternatively, the single-use package 1 may be formed using a substantially continuous process, e.g., where rolls or other sources of web 110 and cover 130 may be provided that correspond to a plurality of single-use packages (not shown). The web 110 and cover 130 material from the sources may be fed substantially continuously to create a strip (not shown) that includes a plurality of single-use packages connected together, as described further below.

Figure 2:
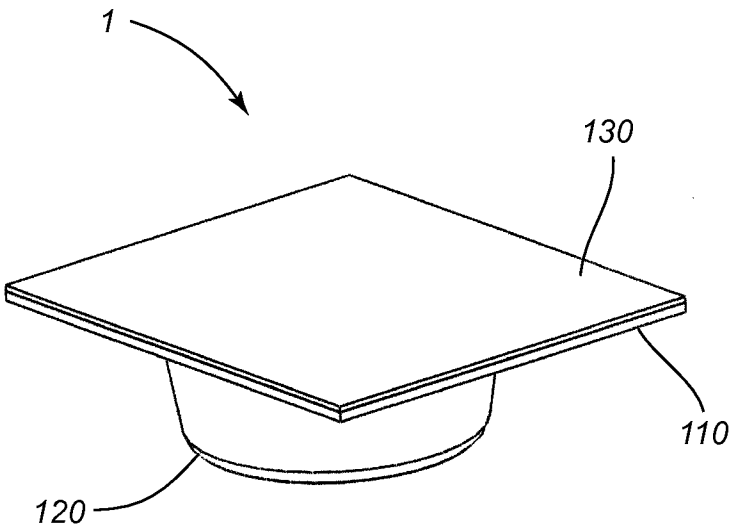
FIG. 2 is a perspective view of another exemplary embodiment of a single-use package.

As shown in FIGS. 1A-1C, the single-use package 1 may include a plurality of blisters 120 having respective items 105 therein. Alternatively, as shown in FIG. 2, a single-use package 1 may be provided that includes a single blister 120 defined by a cover 130 and web 110, with one or more items 105 therein. More typically, in a substantially continuous strip or other arrangement that includes a plurality of single-use packages, some of the packages may include a plurality of blisters and items, while others may include a single blister and item(s), depending upon the number of items and doses being packaged together, as described further below.

Figure 3:
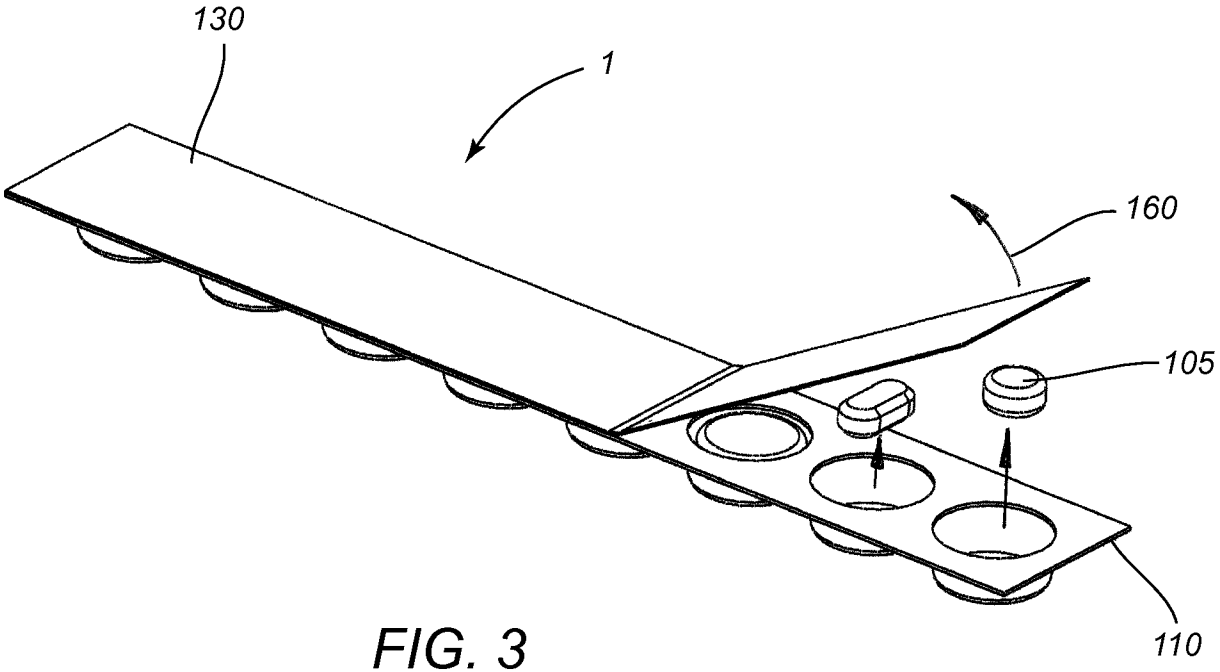
FIG. 3 is a perspective view of the single-use package of FIG. 1A, showing the cover partially peeled away from the web.

Turning to FIG. 3, the single-use package 1 of FIG. 1A is shown with the cover 130 partially peeled back along path 160 from the web 110, permitting release of items 105 for use. For example, if the single-use package 1 has been separated from a strip of multiple single-dose packages (not shown), the cover 130 may be separated from the web 110 to access and administer or otherwise use all of the items within the single-use package 1. Alternatively, as explained further below, if item(s) have been removed from one or more blisters (not shown), only the remaining items may be used when the cover 130 is separated.

Figure 4:
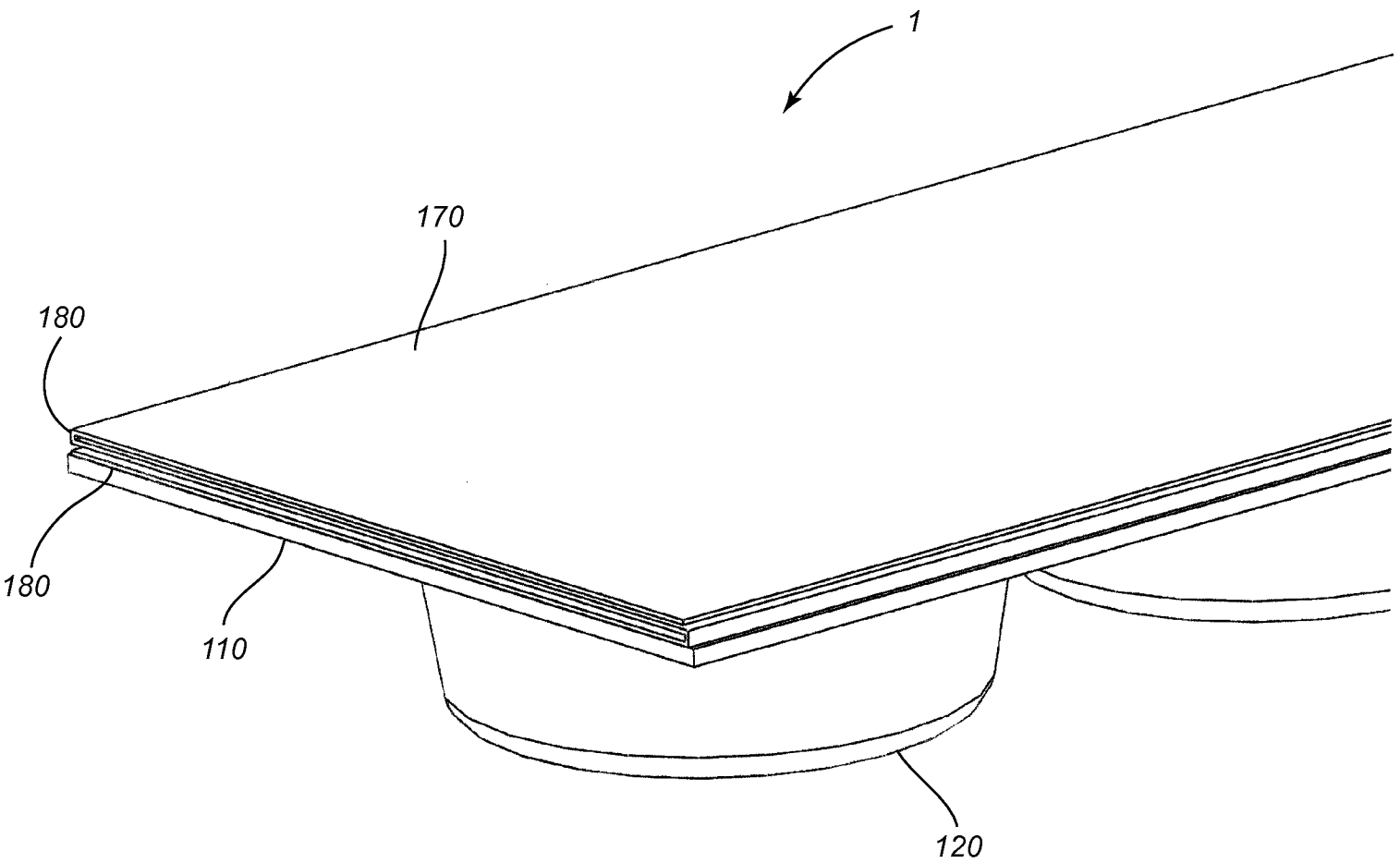
FIG. 4 is a perspective view of one end of yet another exemplary embodiment of a single-use package including a multiple fold cover.

Turning to FIG. 4, another exemplary embodiment of a single-use package 1 is shown that includes a multi-fold cover 170 adhered to web 110. The multi-fold cover 170 may include one or more folds 180 separating multiple surfaces to provide additional surface area, e.g., to create room for additional printed information such as directions for use (not shown). For example, the cover 170 may be opened without separating the cover 170 from the web 110 to read or otherwise access information on the multiple surfaces. Although shown with multiple surfaces having similar widths, it will be appreciated that various width surfaces may be provided, as desired, such that the cover 170 opens to provide a desired surface area with information thereon. Alternatively, if desired, the cover 170 may be separable from the web 110 before opening the multiple surfaces, if desired.

Figure 5A:
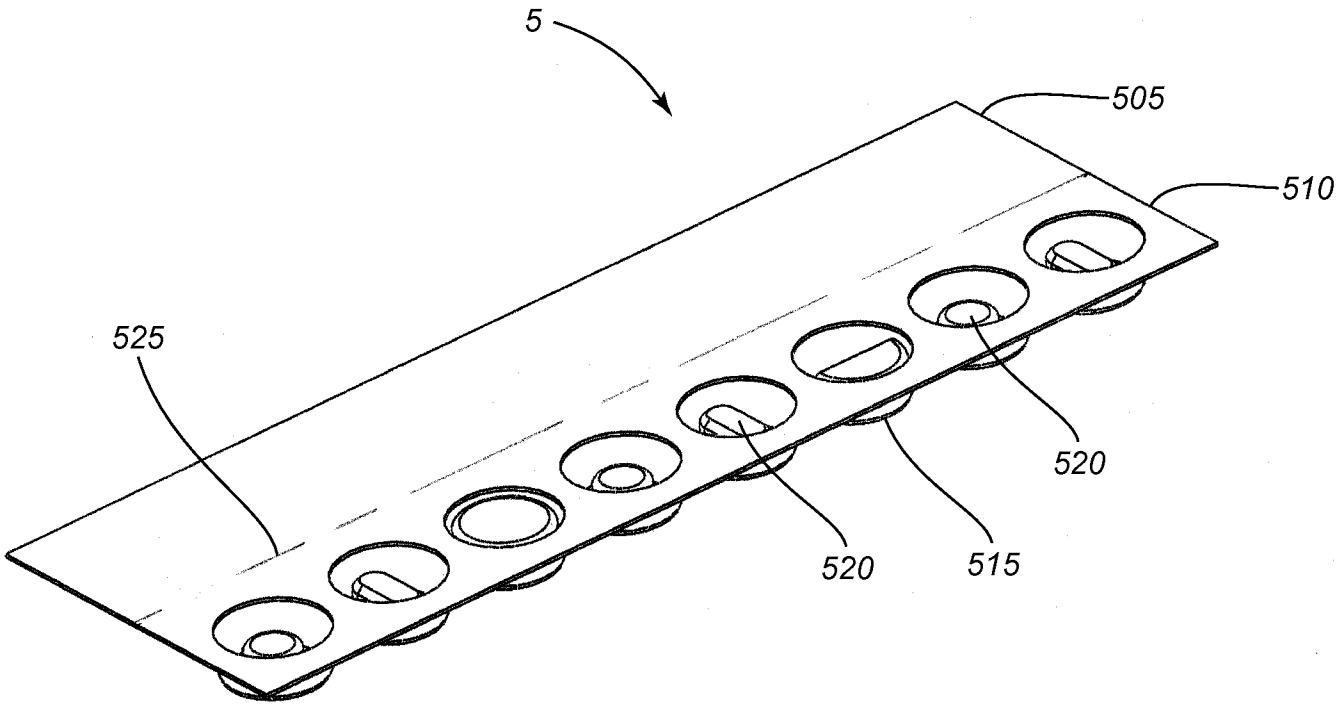
FIGS. 5A-5C are perspective views of still another embodiment of a single-use package where the web and cover are formed from a single sheet.
Figure 5B:
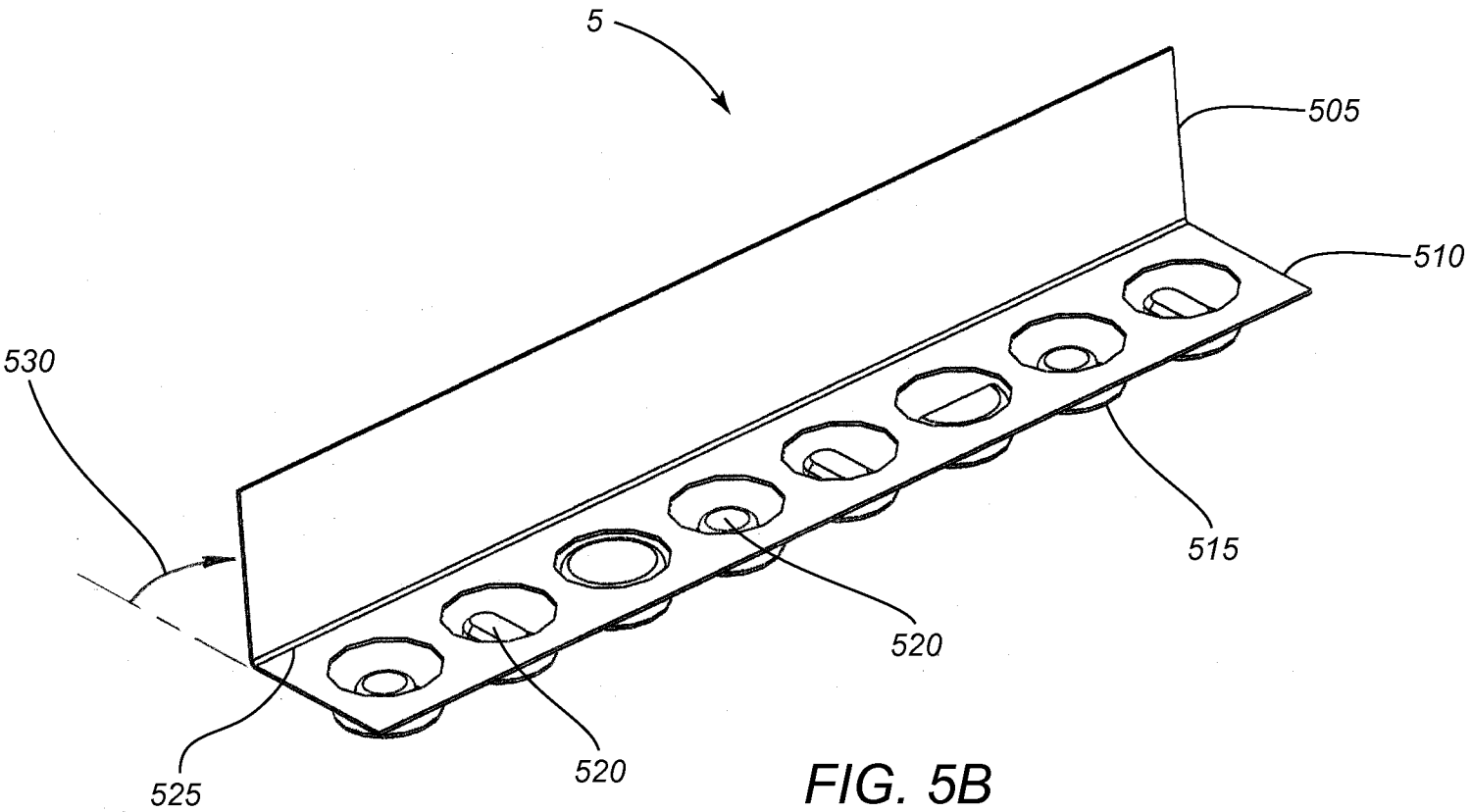
Figure 5C:
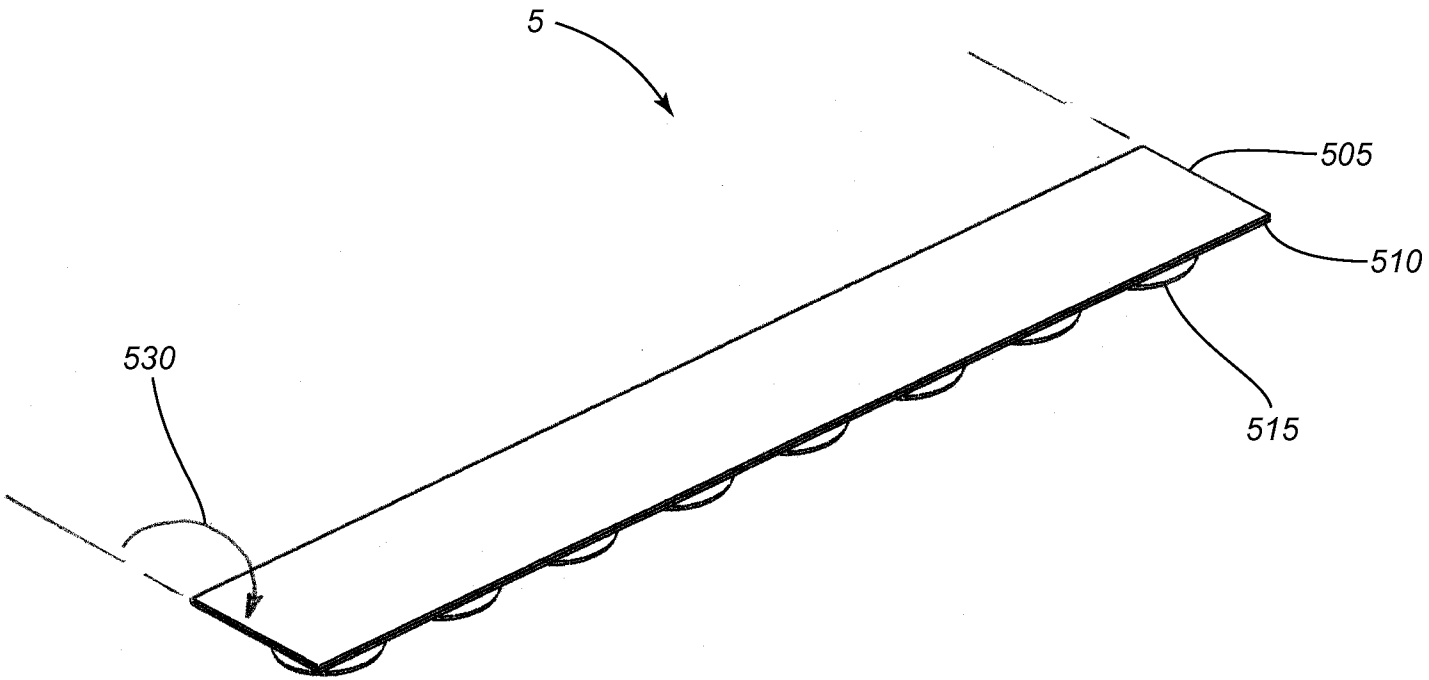

Turning to FIGS. 5A-5C, another embodiment of a single-use package 5 is shown that includes a cover 505 and web 510, generally similar to other embodiments herein. Similar to other embodiments herein, the blisters 515 may be preformed into the web 510 or may otherwise be created when an item 520 is placed within the web 510. However, unlike other embodiments, the cover 505 and web 510 may be formed from a single sheet. For example, FIG. 5A shows the cover 505, formed from the same sheet as web 510, flat and unfolded. An optional fold line 525 may be provided to ease folding or the sheet may simply be folded at a desired location. For example, FIG. 5B shows the cover 505 partially folded over along path 530. FIG. 5C shows the cover 505 folded over and secured to the web 510 to enclose items 520, e.g., by bonding with adhesive, welding, tapes, clips, and the like (not shown).

Figure 6:
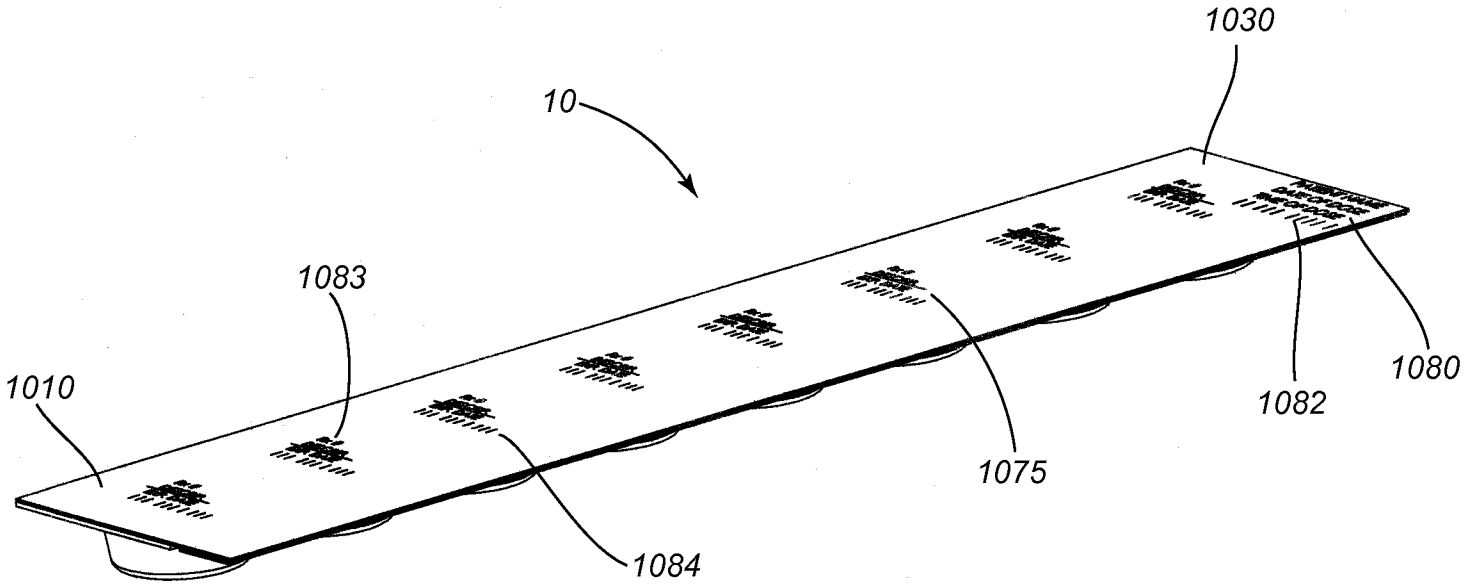
FIG. 6 is a perspective view of yet another embodiment of a single-use package including a cover having various labels thereon.

Turning to FIG. 6, another exemplary embodiment of a single-use package 10 for multiple items 1005 (not shown, see, e.g., FIGS. 9 and 10) that includes a cover 1030 secured to web 1010, e.g., similar to other embodiments herein. In addition, the cover 1030 includes human-readable use information 1080 (e.g., patient name, dose date, dose time, and the like), and machine-readable use information 1082. In addition or alternatively, the cover may include human-readable item information 1083 (e.g., prescription number, description, expiration date, and the like) and machine-readable item information 1084 associated with each item 1005 (not shown). Optionally, the cover 1030 may also include one or more label modification features 1075 associated with each blister, as described further below). In exemplary embodiments, the label modification feature may include one or more score lines, cuts, or other modification of the cover 1030. It will be appreciated that similar information may be provided on any of the other embodiments herein.

Figure 7:
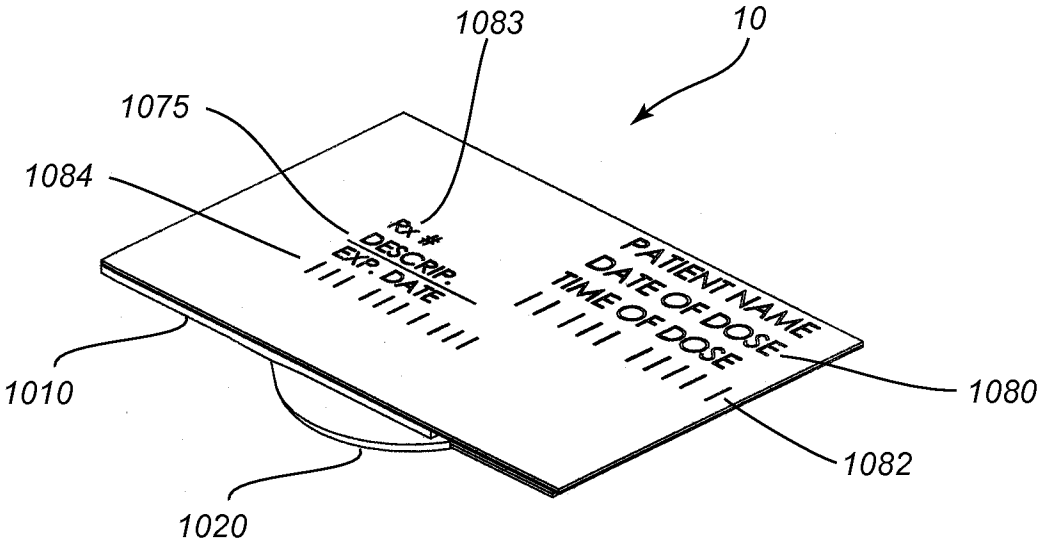
FIG. 7 is a perspective view of another embodiment of a single-use package similar to that of FIG. 2 including a cover having various labels thereon.
Figure 9:
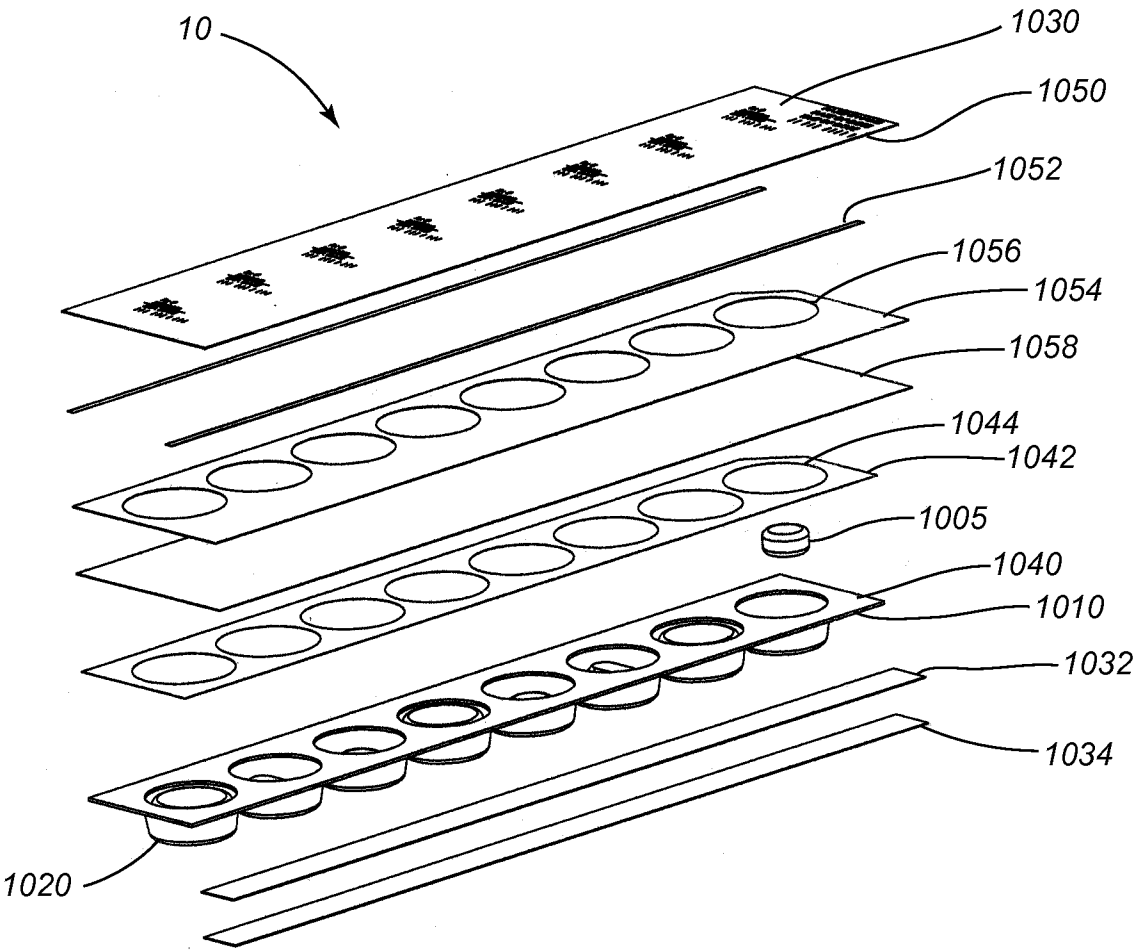
FIG. 9 is an exploded perspective view of another embodiment of a single-use package including a cover removably attached to a web or base layer and including one or more intermediate layers.
Figure 10:
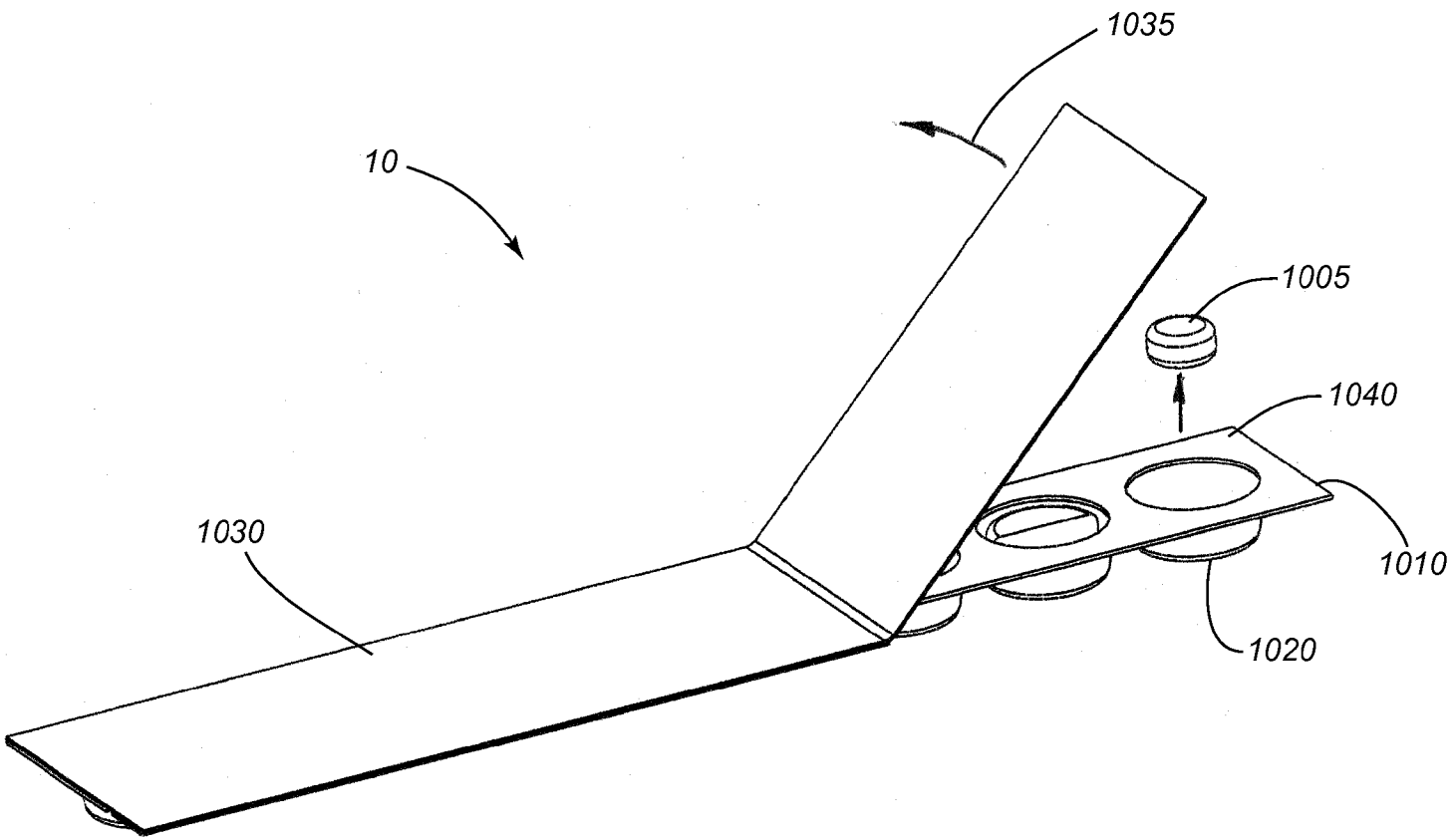
FIG. 10 is a perspective view of the single-use package of FIG. 9 after assembly and with the cover partially peeled away from the web.

FIG. 7 shows an alternative embodiment of a single-use package 10, similar to that of FIG. 6, except that it contains a single item 1005 (not shown, see FIGS. 9 and 10).

Figure 8:
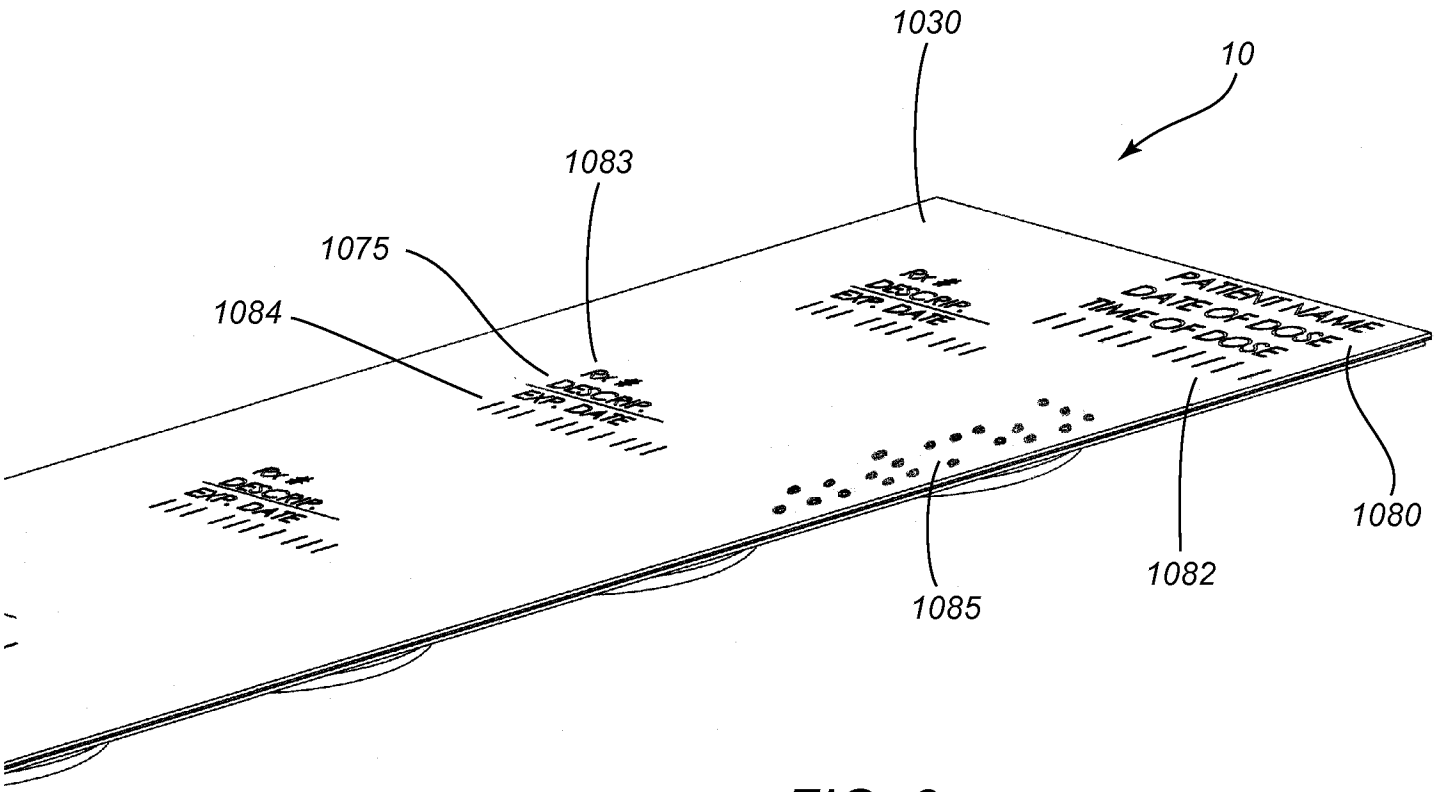
FIG. 8 is a perspective view of still another embodiment of a single-use package including a cover having various labels thereon.

FIG. 8 shows another alternative embodiment of a single-use package 10, similar to that of FIG. 6, except that it includes human-readable information for persons with reading disabilities 1085 (e.g., Braille information).

Turning to FIG. 9, another exemplary embodiment of a single-use package 10 is shown that includes optional reinforcement strips, bands, or fibers 1052 adhered or otherwise attached to the cover 1030, e.g., to impart additional strength to the cover 1030 during removal, as described further below. Also shown in FIG. 9 is an optional foil layer 1058, which may be formed from metal, paper, polymer, or other suitable material, and may provide additional sealing, a moisture barrier, and/or a frangible secondary cover once primary cover 1030 is removed. For example, the foil barrier 1058 may provide a substantially fluid-tight seal or simply a physical barrier for the blisters 1020, which may be torn or otherwise opened, as described further below. Optional foil barrier 1058 may be removably or permanently attached to the cover 1030 by bonding with adhesives, welding, and the like. In addition, if desired, a first seal layer 1054 may also be provided, e.g., a layer of adhesive or other bonding material, between the foil barrier 1058 and the cover 1030 that includes apertures 1056, e.g., to prevent adhesive or welding effects on items 1005 during packaging.

Similarly, the foil layer 1058 may be adhered or otherwise permanently or removably attached to the web 1010, e.g., by bonding with adhesives, welding, and the like. For example, a second seal layer 1042 may be provided, e.g., a layer of adhesive or other bonding material, between the foil barrier 1058 and the web 1010 that includes apertures 1044, e.g., to prevent adhesive or welding effects on items 1005 during packaging. Optional seal layers 1054 and 1042 may be adhesives or tapes applied during production of the cover 1030, foil 1058, or web 1010, or during packaging. In addition or alternatively, the seal layers 1054 and 1042 may be weld patterns or heat-seal patterns formed or applied during packaging. The base material of the cover 1030 or web 1010 may be melted to form seal layers 1054 and 1042, consistent with common welding and heat sealing techniques.

Optionally one or more adhesive strips 1032 may be adhered or otherwise attached to the cover 1030 or foil 1058, and may be used to attach at least a portion of the single-use package 10 to a surface, as described further below. For example, the adhesive strip 1032 may be used to attach the cover 1030 to a surface after the cover 1030 is separated from the web 1010, as described further below. An adhesive strip cover 1034 is provided to protect the adhesive strip 1032, e.g., from inadvertent contamination and/or premature adhering of the single-use package 10 to other objects.

FIG. 10 shows an example of the single-use package 10 of FIG. 9 with the cover 1030 partially peeled open along path 1035. In this embodiment, the optional foil layer 1058 (not shown) remains attached to the cover 1030, e.g. by seal layer 1054 (not shown). The seal layer 1042 (not shown), which joins the foil layer 1058 to the web 1010, separates from web 1010 along with the cover 1030.

Figure 11:
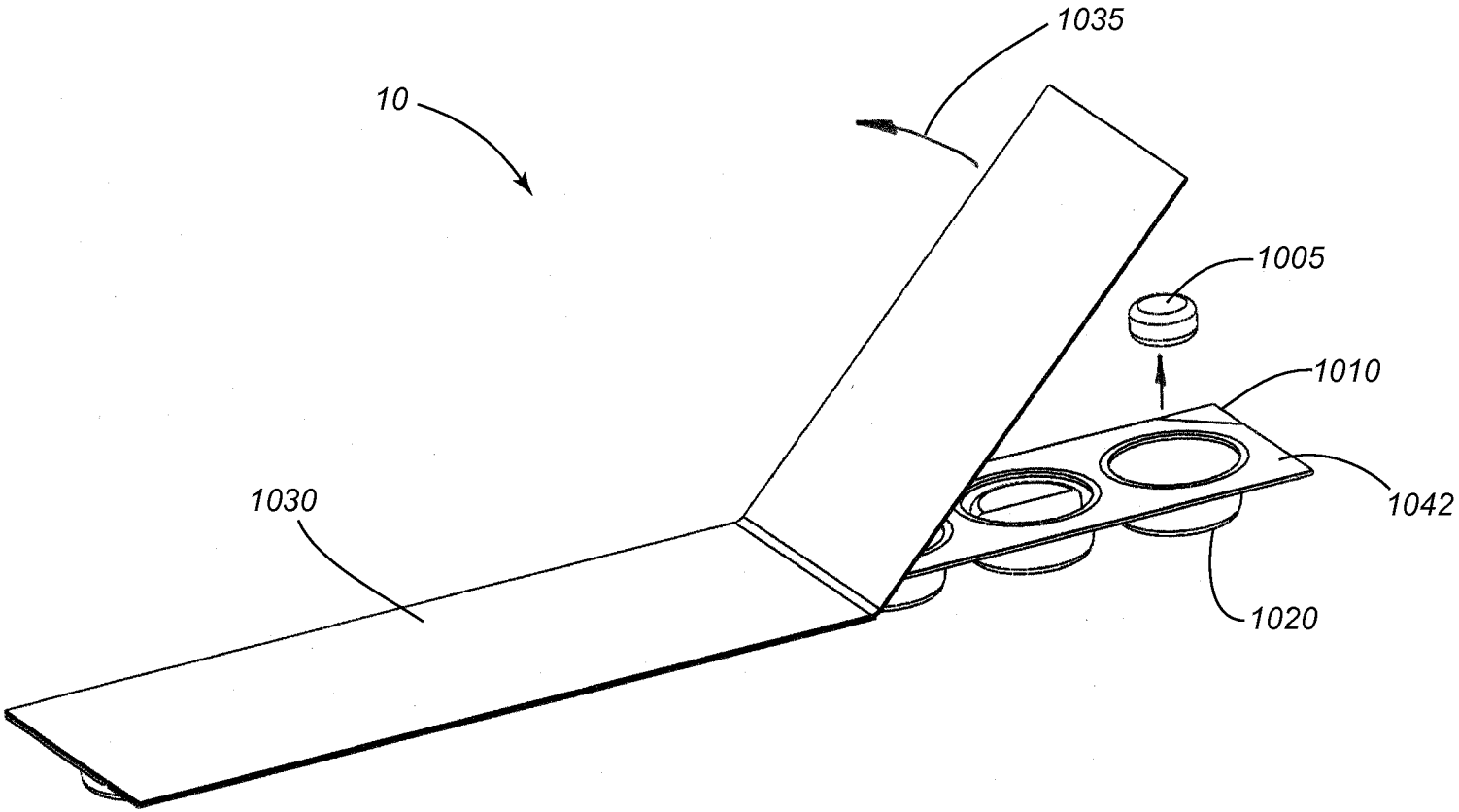
FIGS. 11 and 12 are perspective views of alternative embodiments of the package of FIGS. 9 and 10 with the cover thereof partially peeled away from the web to expose a seal layer between the cover and web through which items may be pushed before use.

FIG. 11 shows another example of the single-use package 10 of FIG. 9 with the cover 1030 partially peeled open along path 1035. In this embodiment, the optional foil layer 1058 (not shown) remains attached to the cover 1030, e.g., by seal layer 1054 (not shown). The seal layer 1042, which joins the foil layer 1058 to the web 1010, remains attached to the web 1010 rather than the cover 1030.

Figure 12:
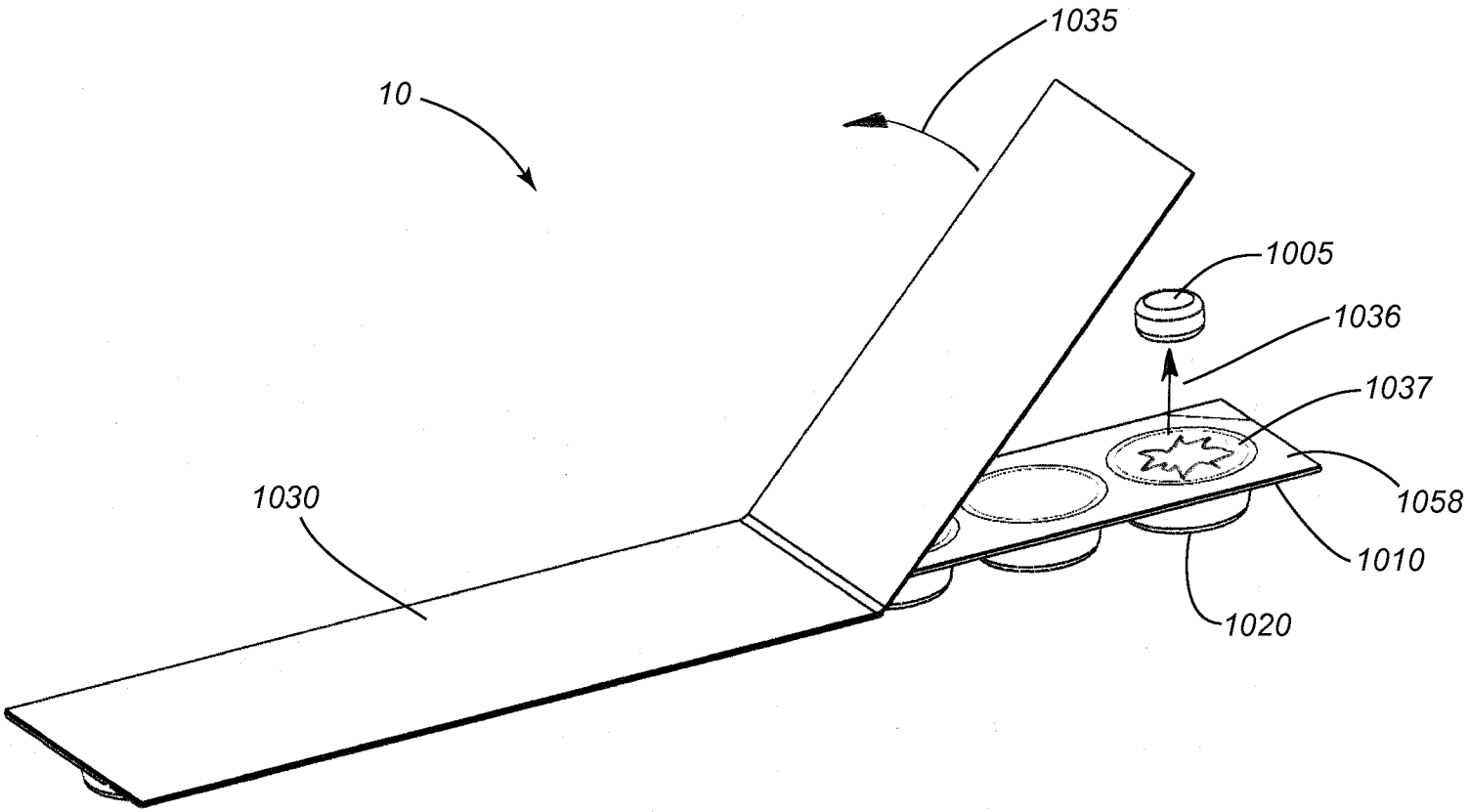

FIG. 12 shows another example of the single-use package 10 of FIG. 9 with the cover 1030 partially peeled open along path 1035. In this embodiment, the optional foil layer 1058 remains attached to the web 1010, e.g., by seal layer 1042 (not shown), but separates from the cover 1030. Thus, items 1005 remain in blisters 1020 until pushed through the foil layer 1058 approximately along path 1036, e.g., similar to other blister packaging. Pushing items 1005 through the foil layer 1058 creates aperture(s) 1037, which may be used to identify that item(s) 1005 in a particular blister 1020 were removed before opening the single-use package 10 for use, as explained elsewhere herein.

Figure 13:
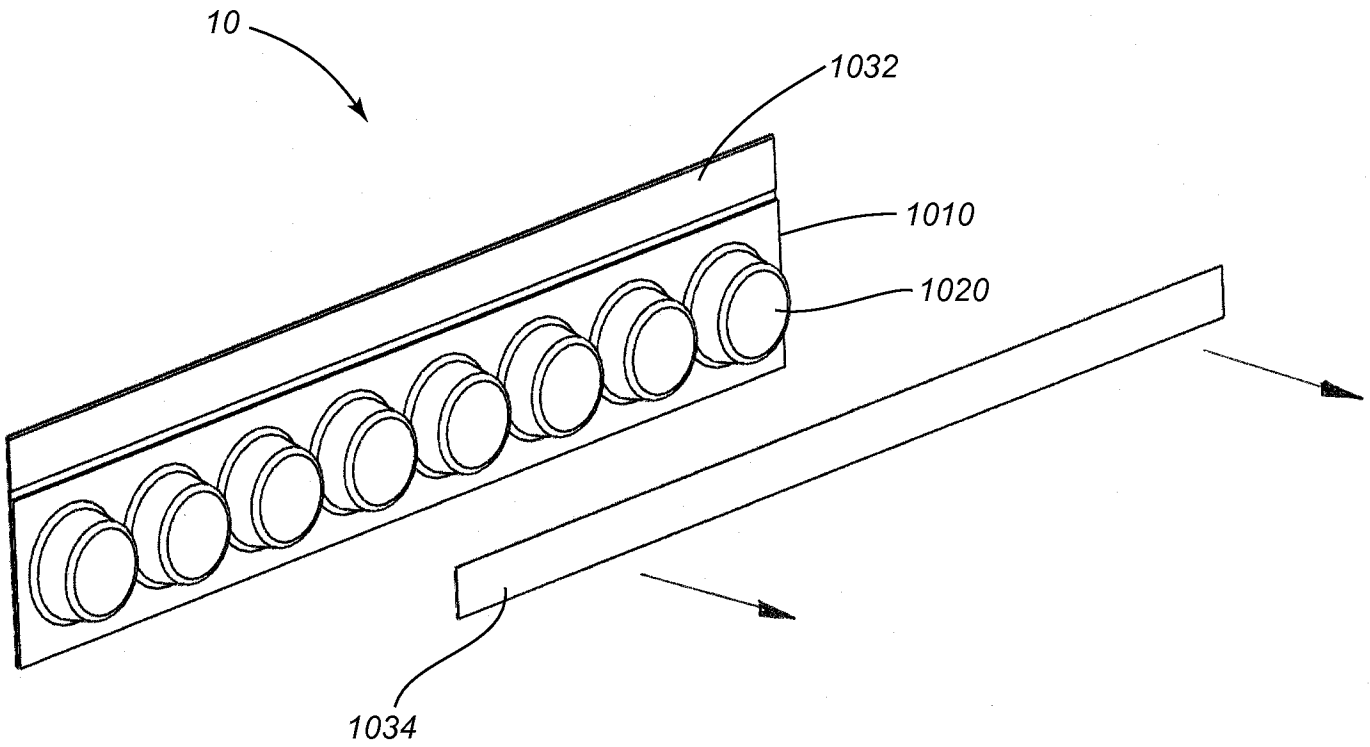
FIG. 13 is a perspective view of another exemplary embodiment of a single-use package including a strip cover removed to expose an adhesive strip on the cover.

FIG. 13 shows an example of a single-use package 10 with an adhesive strip cover 1034 removed from an adhesive strip 1032, exposing the adhesive strip 1032 to permit attachment of the entire single-use package 10 to a convenient surface (e.g., patient bed frame). For example, the adhesive strip 1032 may be provided on an extension of the web 1010 adjacent the blisters 1020 or on a lower surface of the cover 1030 if the web 1010 terminates adjacent the lower surface. Although the adhesive strip 1032 is shown on a lower surface of the single-use package 10, it will be appreciated that the adhesive strip may instead be provided on an upper surface of the cover 1030 or otherwise on the single-use package 10 (not shown), if desired.

Figure 14A:
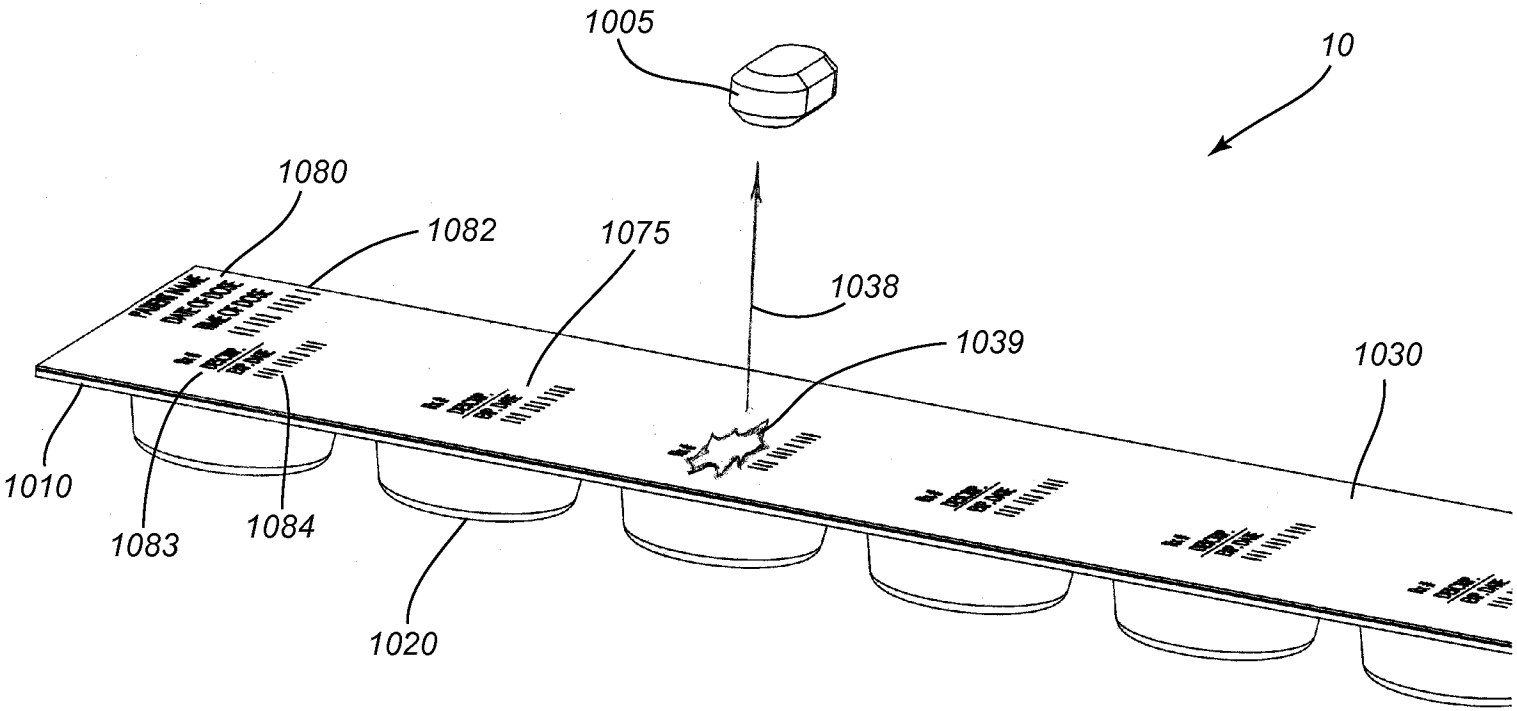
FIG. 14A is a perspective view of a single-use package, similar to that of FIG. 6, showing an item being pushed through the cover and removed from the package.

Turning to FIG. 14A, an exemplary embodiment of a single-use package 10 is shown, similar to that shown in FIG. 6, with an unwanted item 1005 removed from the single-use package 10 by pushing it through the cover 1030 along path 1038, which may be facilitated by the label modification feature 1075, which may be a score line, cut, or other modification to the cover 1030. For example, by pushing on the blister 1020 associated with the unwanted item 1005, the unwanted item 1005 may be forced against the label modification feature 1075 in the cover 1030. The label modification feature 1075 may provide a weakened or otherwise preferential rupture point in the cover 1030 through which the unwanted item 1005 may pass approximately along the path 1038. As the unwanted item 1005 is pushed through the cover 1030, the human-readable item information 1083 on the cover 1030 associated with the unwanted item 1005 is damaged or modified, leaving an aperture 1039.

Alternatively, wanted items may be pushed through such features in the cover 1030 or in a foil layer (not shown), e.g., after the cover 1030 is peeled off. For example, the weakened regions may facilitate manual or automated dispensing of contents of the blisters 1020 before use. In an exemplary embodiment, a dispensing machine (not shown) may be provided that dispenses items from successive single-use packages 1010 of a strip loaded into the machine, e.g., by pushing the items through the cover 1030 into a cup or other container (also not shown) for administration to a patient or other user, leaving an aperture 1039 for each emptied blister 1020 in the used single-use package 10.

Figure 14B:
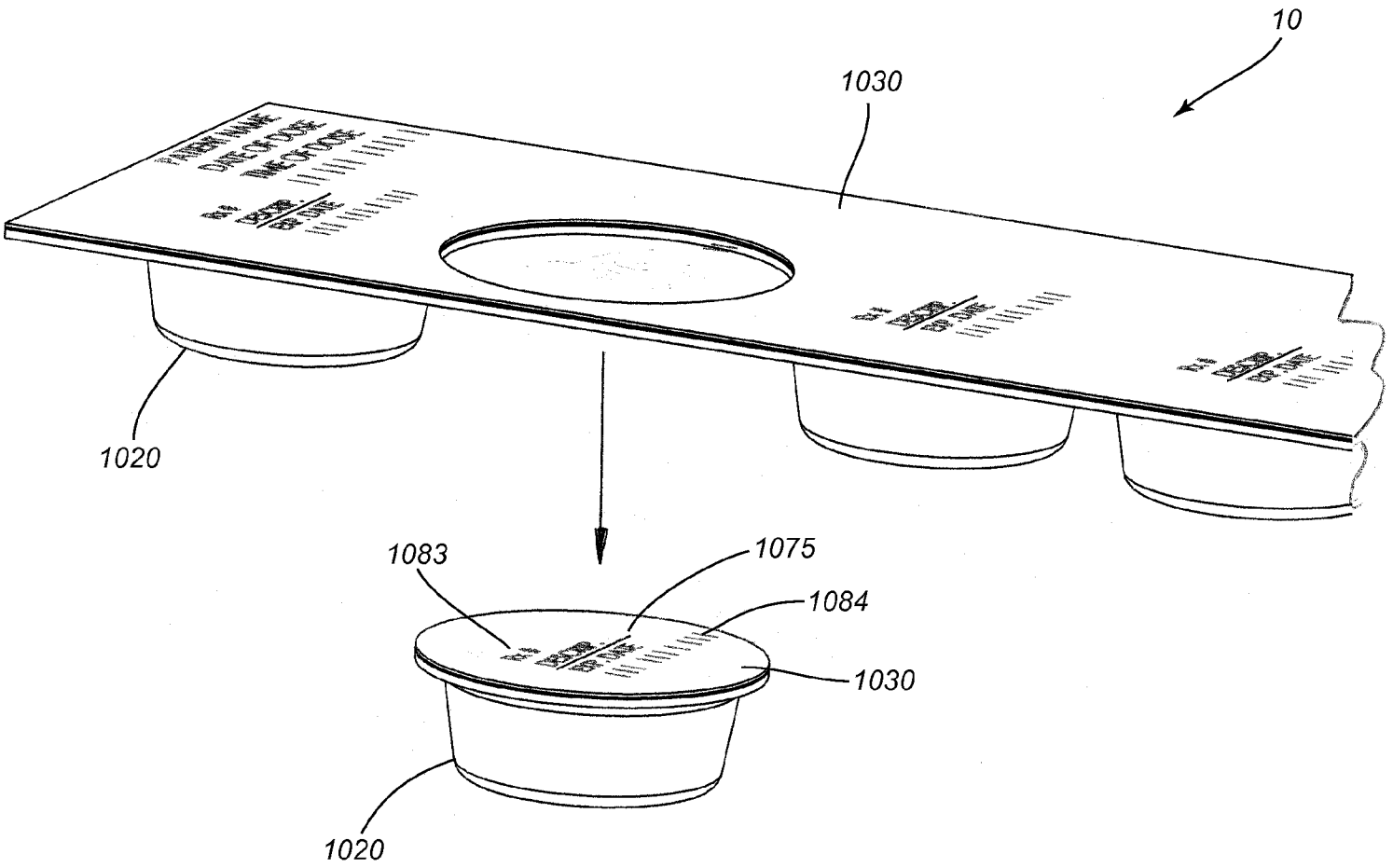
FIGS. 14B and 14C are perspective views of alternative embodiments of a single-use package, showing an entire blister being removed from the package.
Figure 14C:
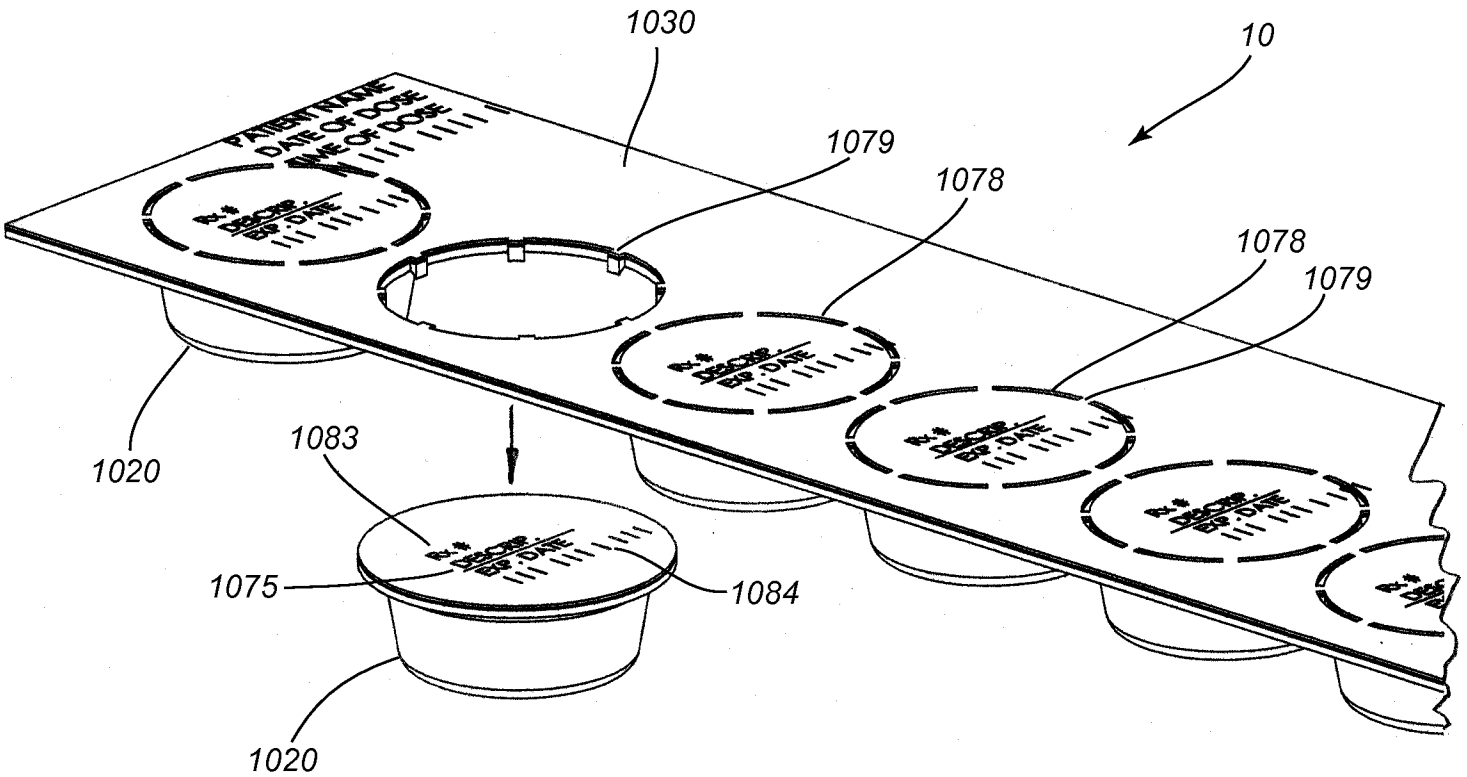

In an alternative embodiments, shown in FIGS. 14B and 14C, each blister 1020 may include one or more frangible features, e.g., formed in the cover 1030, web 1010, and/or other layer(s) of the single-use package 10, allowing the entire blister 1020 to be separated from the rest of the single-use package 10 to remove an unwanted item (not shown) in the blister 1020. For example, as shown in FIG. 14B, the web 1010 may include a circumferential weakened region around each blister 1020 that may accommodate separating the blister 1020. In this embodiment, the cover 1030 may simply tear adjacent the weakened region to allow separation. In the embodiment shown in FIG. 14C, the cover 1030 and web 1010 include weakened regions 1078 separated by tabs or other continuous regions 1079, e.g., formed by cut lines at least partially therethrough to facilitate separation of an unwanted blister 1020 and its contents. The weakened regions 1078 and/or tabs 1079 may have substantially the same size as other similar features, or their sizes may vary, e.g., with tablet size and/or spacing, as described further below.

Figure 15:
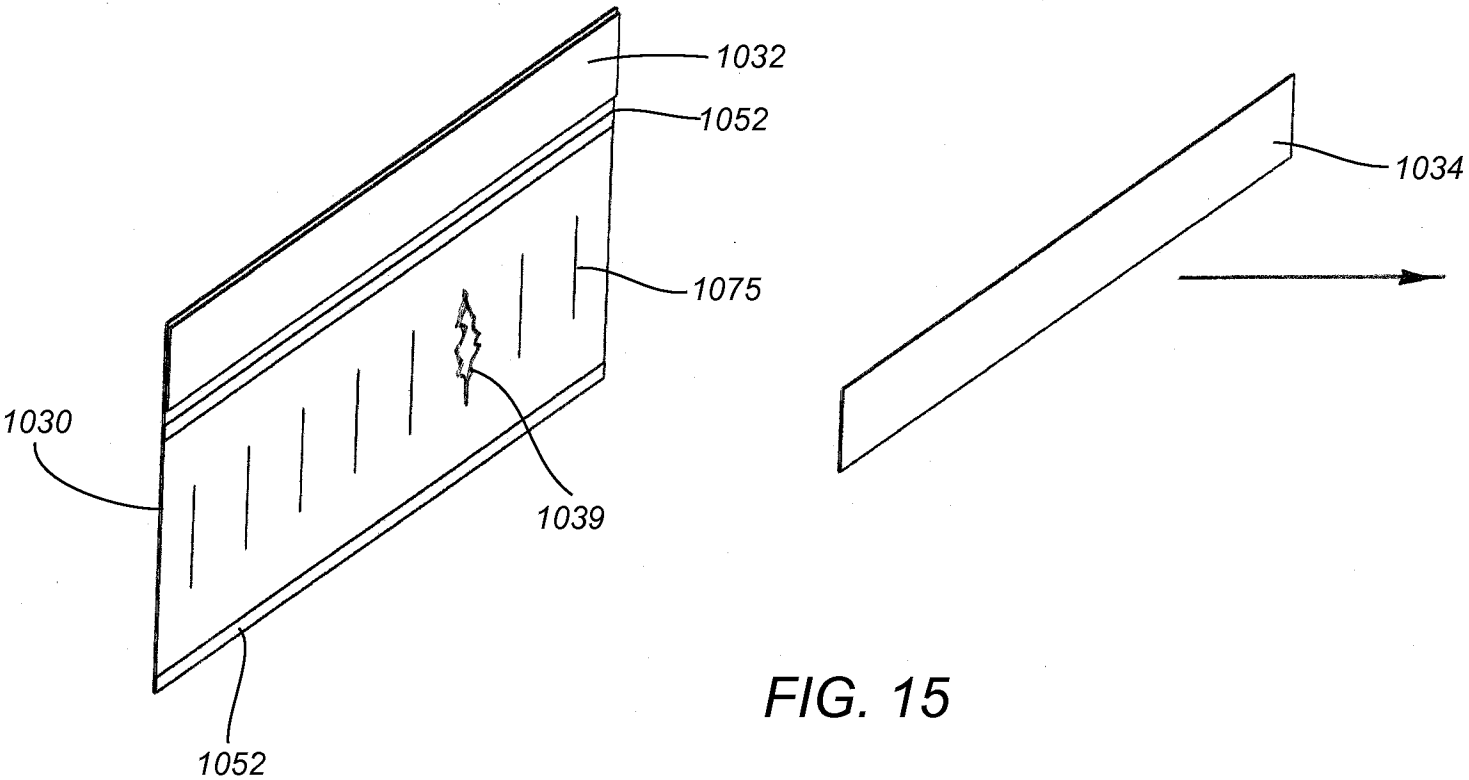
FIG. 15 is a perspective view of a cover including an adhesive strip that has been separated from a single-use package, showing a strip cover being removed from the cover to expose the adhesive strip.
Figure 16:
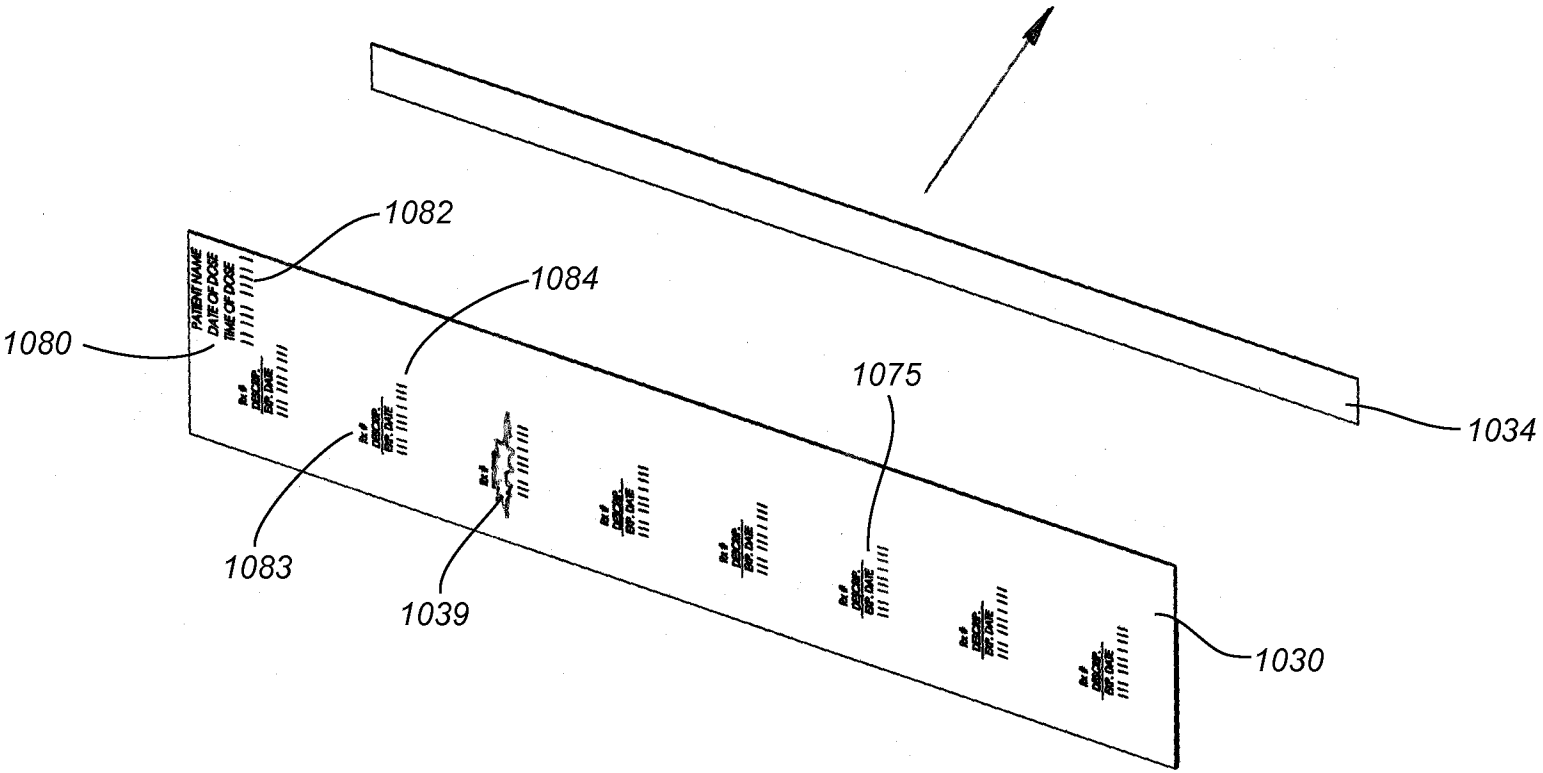
FIG. 16 is a perspective view of the cover of FIG. 15 showing labels on an upper surface of the cover and the strip cover removed.

Turning to FIGS. 15 and 16, a cover 1030 of a single-use package 10 (not shown) is shown, similar to that shown in FIG. 13, after removal of the cover 1030 from the web 1010 and/or other components of the single-use package 10, e.g., by peeling along path 1035 as shown in FIG. 10. In this embodiment, as shown in FIG. 15, the adhesive strip 1032 is provided on a lower surface of the cover 1030 along one edge, e.g., spaced apart from where the cover 1030 was attached to the web 1010 (not shown). The adhesive strip 1032 may be exposed by removing the adhesive strip cover 1034, and the removed cover 1030 may be attached to a convenient surface (e.g., patient chart) using the adhesive strip 1032, as desired. Optional reinforcement strips, bands, or fibers 1052 are shown that may be attached to the cover 1030, e.g., to impart additional strength to the cover 1030 during removal.

FIG. 16 shows an upper view of the removed cover 1030, optionally modified by removal of unwanted items 1005 (not shown) as illustrated by aperture 1039. As shown, the removed cover 1030 includes human-readable information 1083 of all wanted items 1005 dispensed when the single-use package 10 is opened. The aperture(s) 1039, by modifying human-readable information 1083 associated with the unwanted item(s) 1005, indicate which items were not dispensed. Thus, a record of the items dispensed in the single-use package 10 may be easily maintained.

Figure 17:
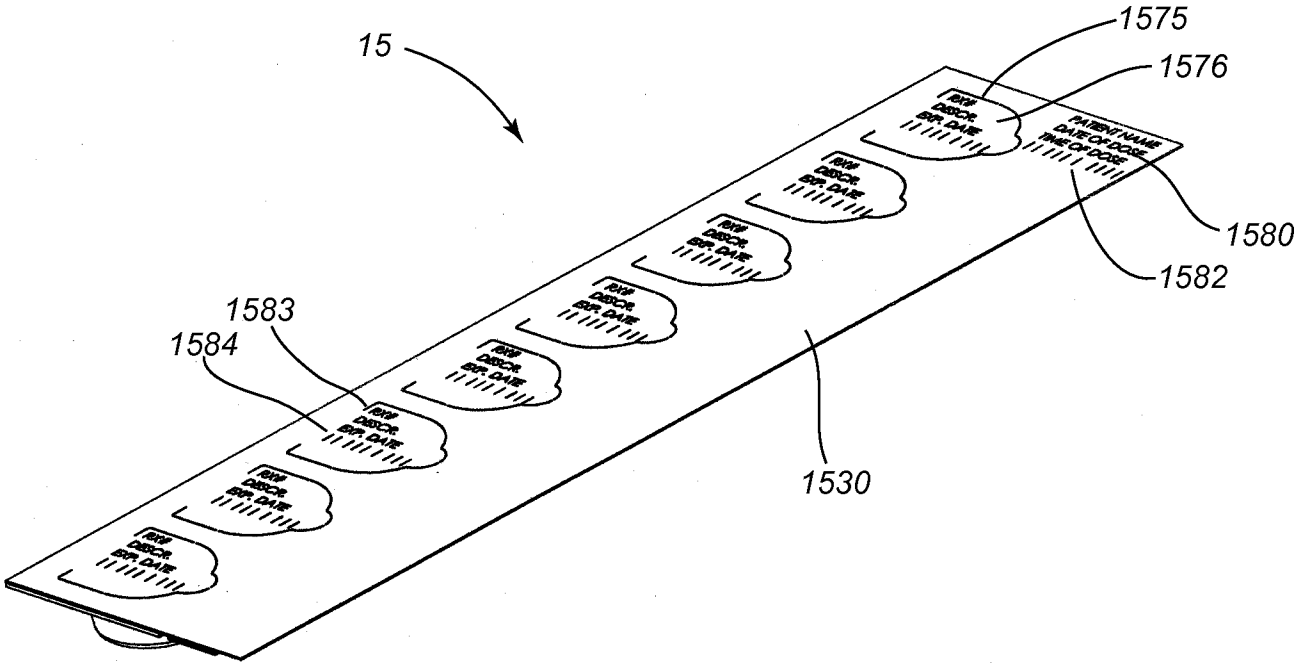
FIG. 17 is a perspective view of another exemplary embodiment of a single-use package including labels on a cover that includes weakened regions to facilitate removing items from individual blisters, as shown in FIG. 18.

FIG. 17 shows another embodiment of a single-use package 15 with an alternate label modification feature 1575, e.g., a score line, cut, or other weakened or otherwise preferential rupture point in the cover 1530 adjacent each blister 1020. As shown, each label modification feature 1575 extends at least partially around the a periphery of the area above a respective blister 1020, e.g., to define a tab or other removable portion 1576. Human and machine readable information 1583 and 1584 may be provided at least partially on the tab 1576, which consequently is also removed when the tab 1576 is removed.

Figure 18:
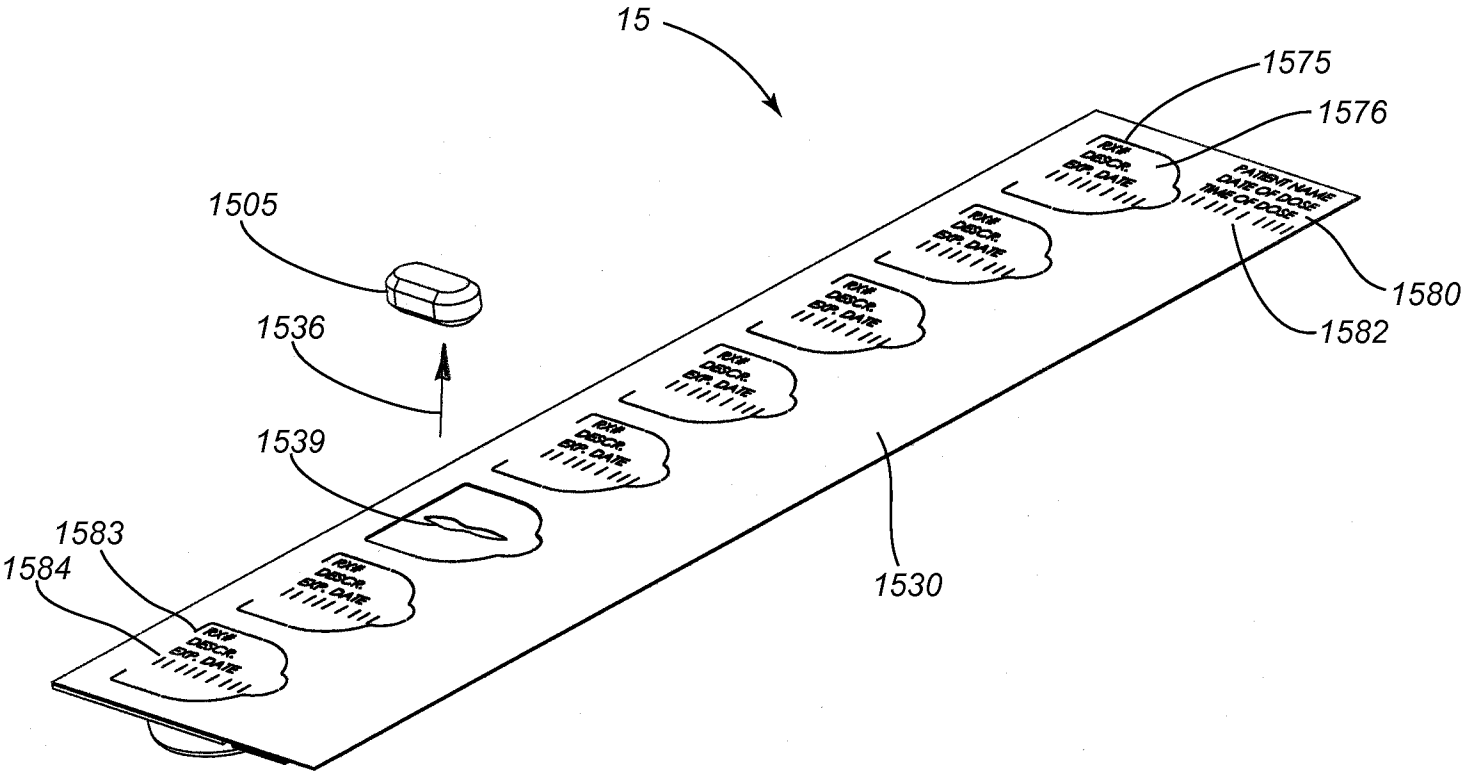

FIG. 18 shows the single-use package 15 of FIG. 17 with one tab 1576 removed, and an unwanted item 1505 pushed out approximately along path 1536. Optional foil layer 1558 is shown, with an aperture 1539 in the foil layer 1558 where the unwanted item 1505 has ruptured the foil layer 1558. Human and machine readable information 1583 and 1584 associated with the unwanted item 1505 has been removed with the tab 1576, thereby modifying the cover 1530. When the cover 1530 is removed to dispense wanted items 1505, the human and machine readable information 1583 and 1584 on the cover 1530 will accurately reflect which wanted items 1505 were dispensed. Thus, a record of the items 1505 dispensed in the single-use package 15 may be easily maintained.

Figure 19:
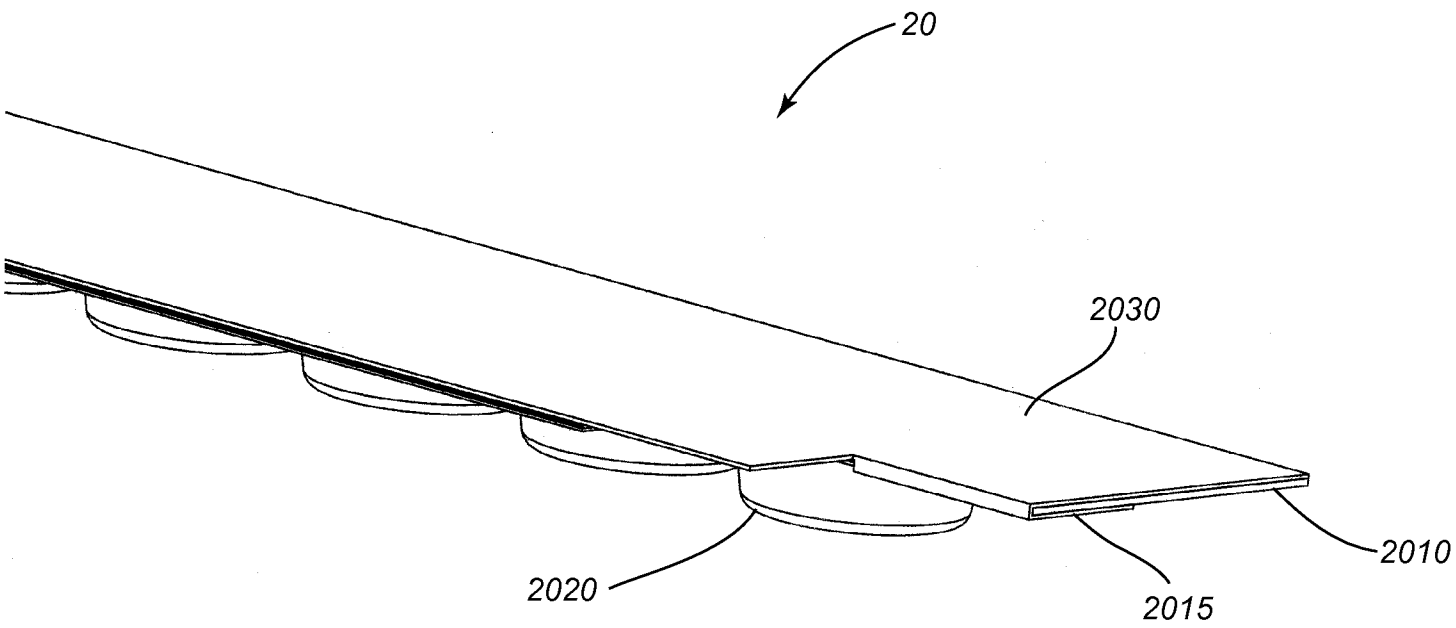
FIG. 19 is a perspective view of one end of another exemplary embodiment of a single-use package that includes child-proofing features.

Turning to FIG. 19, another exemplary embodiment of a single-use package 20 is shown that includes a child-proofing tab 2015, e.g., formed or otherwise provided as part of cover 2030. As shown, the childproofing tab 2015 is folded over and adhered or otherwise attached to web 2010, thereby securing the cover 2030 to the web 2010. The childproofing tab 2015 may prevent the cover 1030 from being easily removed from the web 2010, e.g., by children or other individuals, by requiring understanding of the function of tab 2015, as described below.

Figure 20:
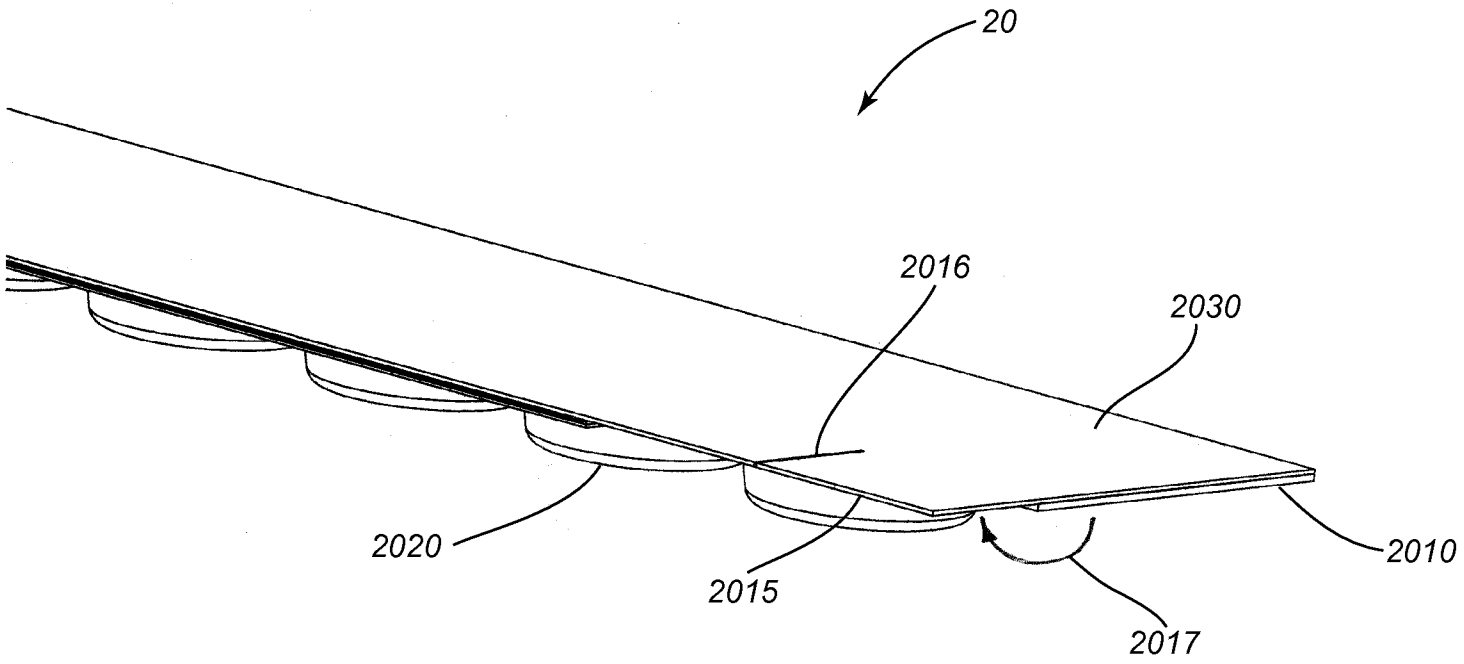
FIGS. 20 and 21 are perspective views of the single-use package of FIG. 19, showing the child-proofing features separated, and a cover of the package partially peeled away from a web of the package, respectively.

For example, FIG. 20 shows the single-use package 20 including a child-proofing tab 2015 as part of the cover 2030 with the child-proofing tab 2015 peeled away from the web 2010 approximately along path 2017. It will be appreciated that the cover 2030 may not easily be removed from the web 2010 without first peeling the child-proofing tab 2015 away from the web 2010, as shown in FIG. 20. Thus, the child-proofing tab 2015 requires two peeling motions (2017 in FIGS. 20 and 2035 in FIG. 21) to remove the cover 2030 from the web 2010.

Figure 21:
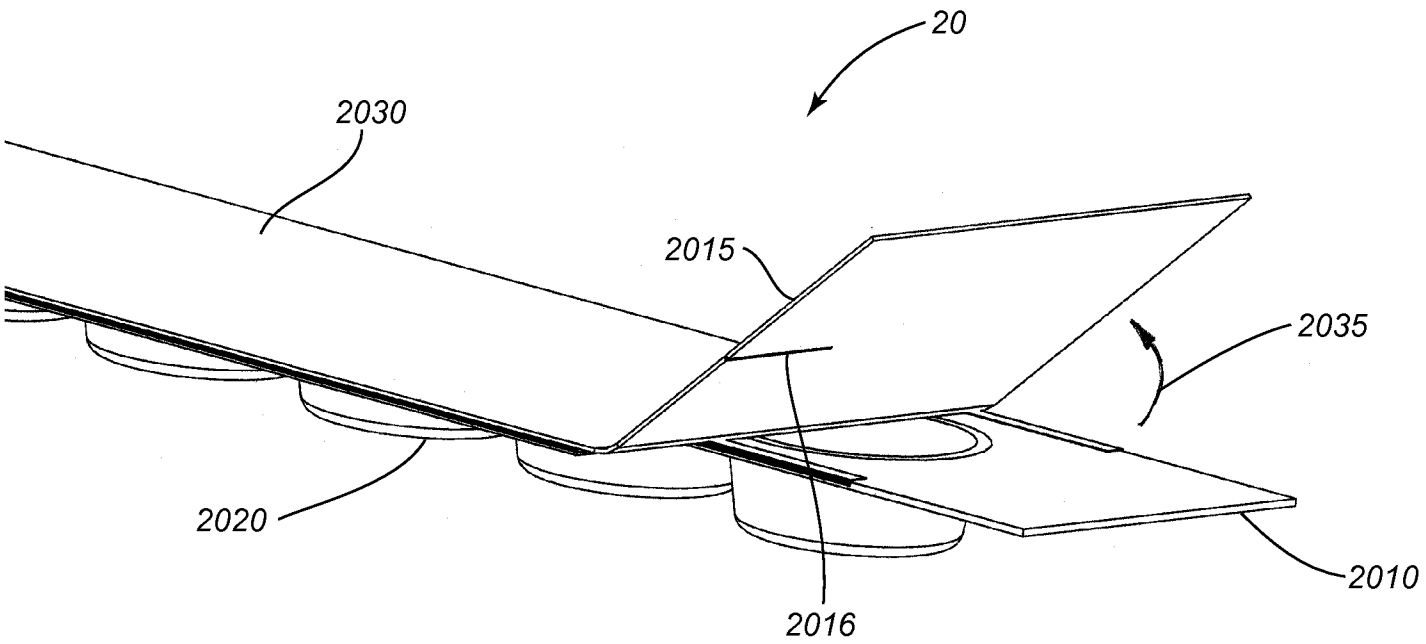

FIG. 21 shows the single-use package 20 with the child-proofing tab 2015 peeled away from the web 2010 and the cover 2030 peeled back approximately along path 2035.

Figure 22:
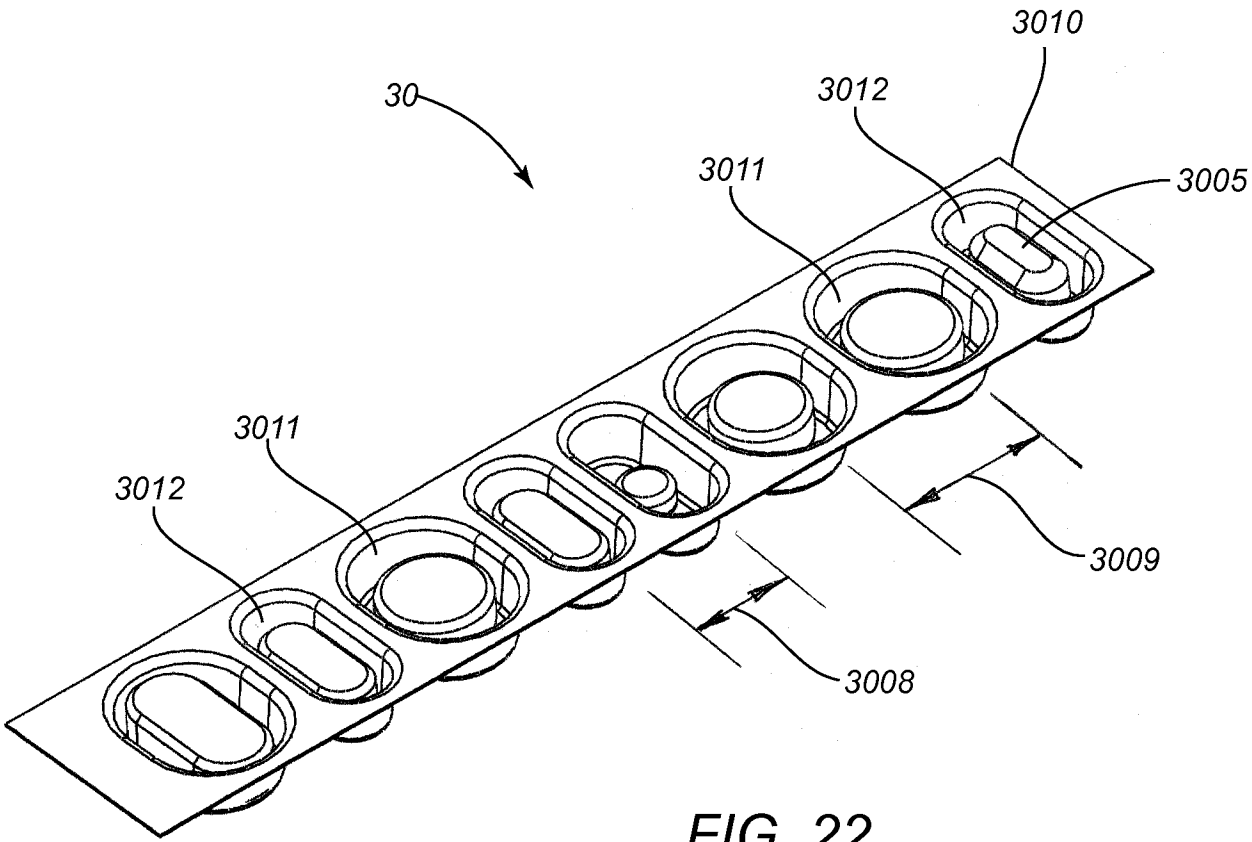
FIG. 22 is a perspective view of a web or base layer of a single-use package showing blisters having variable spacing along a length of the web.
Figure 23:
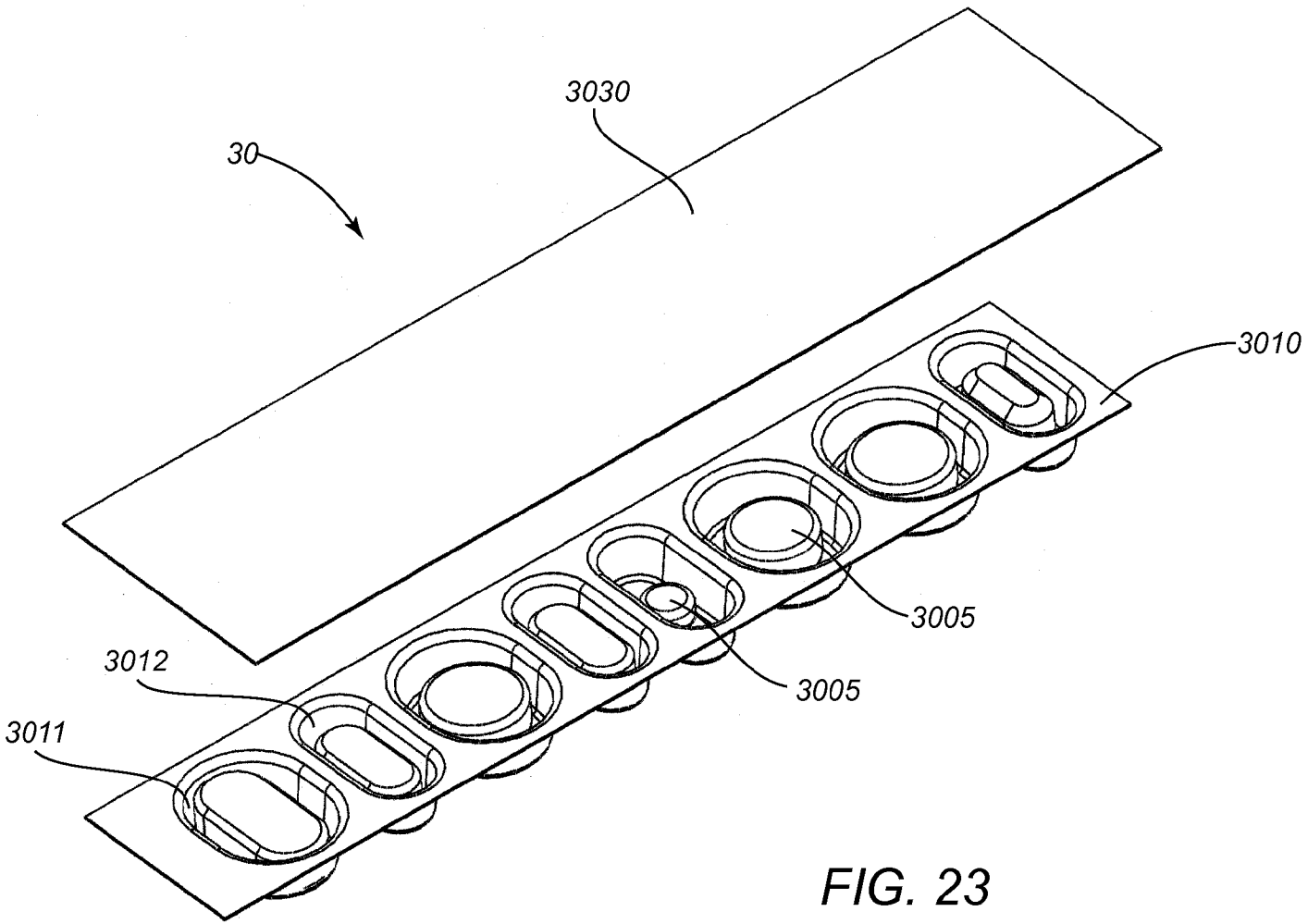
FIG. 23 is a perspective view of the web of FIG. 22, showing a cover being attached to the web to enclose the blisters.
Figure 24:
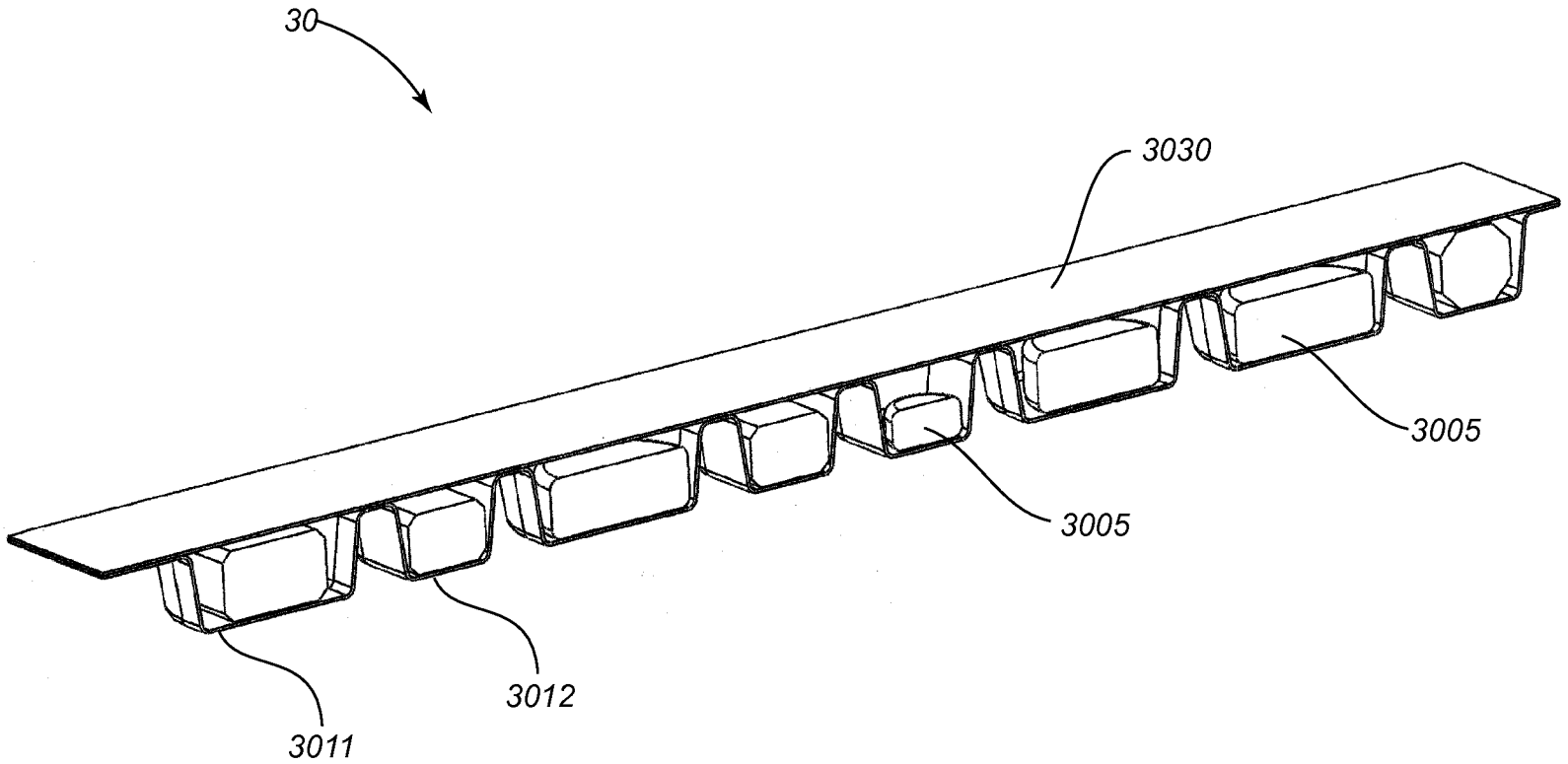
FIG. 24 is a cross-sectional view of the package of FIGS. 22 and 23 taken along its length after attaching the cover to the web.

Turning to FIGS. 22-24, another exemplary embodiment of a single-use package 30 is shown in which the web 3010 accommodates variable spacing of items 3005 within its blisters. For example, as shown in FIG. 22, blisters 3011, 3012 of various sizes are formed into the web 3010 based on the variation in size of the items 3005 being stored in the single-use package 30. Thus, a large item might be place in a large blister 3011, and a smaller item may be placed in blister 3012. The distance between blisters 3011, 3012 may also vary in response to their size. For example, as shown, the distance 3008 between two small blisters 3012 is smaller than the distance 3009 between two large blisters 3011.

FIG. 23 shows the web 3010 and a cover 3030 of the single-use package 30 in aligned relationship with one another prior to attaching the cover 3030 to the web 3010. Blisters 3011, 3012 in the web 3010 may be permanently formed into the web 3010, or alternatively, the blisters 3011, 3012 may be formed and held open using vacuum, pressure, or other external forces on the web 3010 (not shown), e.g., to enable placement of items 3005 into the blisters 3011, 3012. Such forces may be maintained until the cover 3030 is adhered to the web 3010, as shown in FIG. 24.

FIG. 24 shows the single-use package 30 with the cover 3030 adhered or otherwise attached to the web 3010. If the blisters 3011, 3012 are permanently formed into the web 3010, they will be unchanged after the cover 3030 is attached to the web 3010, as shown in FIG. 24. Alternatively, if the blisters 3011, 3012 are filled with a gas (e.g., air) during attachment of the cover 3030 to the web 3010 and the gas is sealed within the blisters 3011, 3012, the blisters 3011, 3012 may maintain approximately the shape and size shown in FIGS. 22-24.

Figure 25:
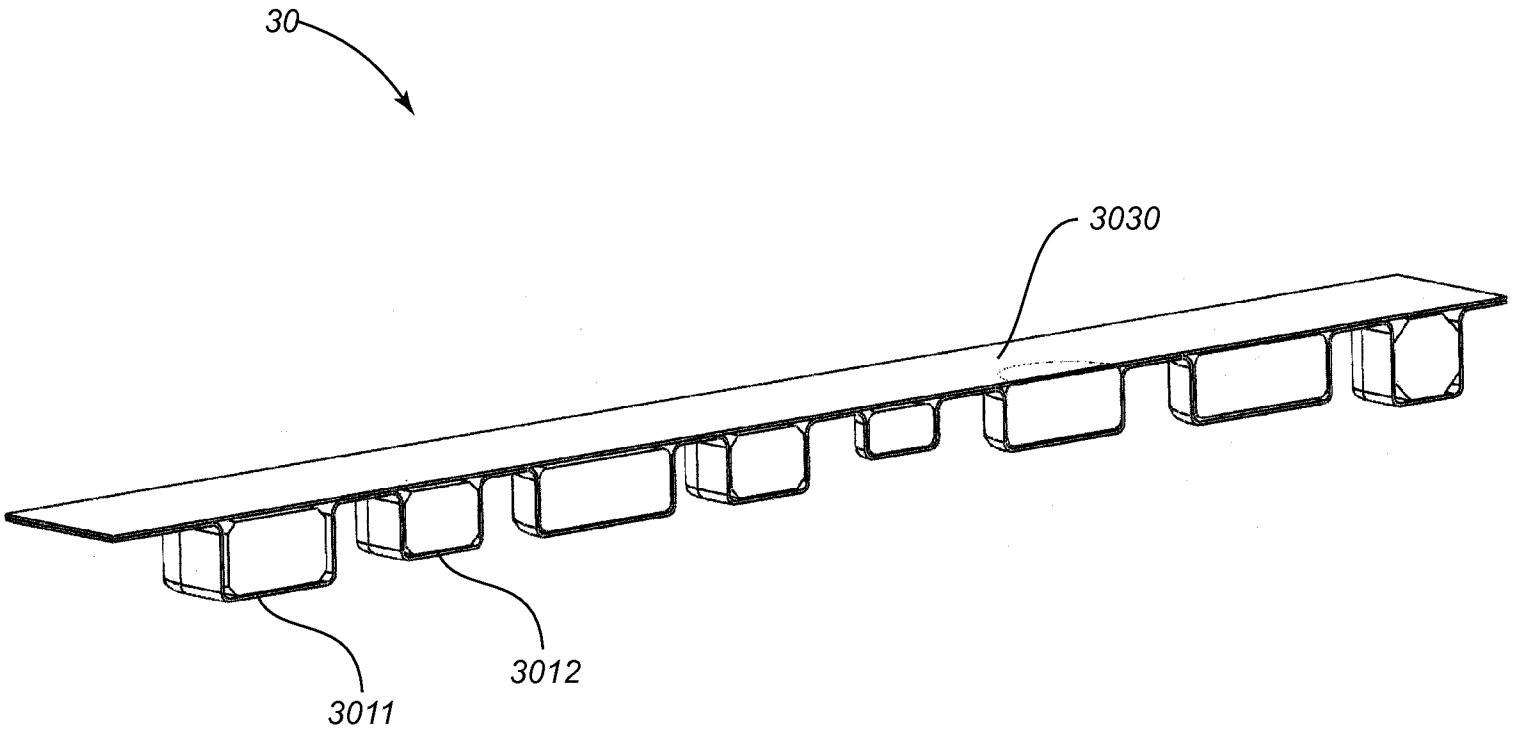
FIG. 25 is a cross-sectional view of an alternative single-use package to that shown in FIG. 24.

Alternatively, as shown in FIG. 25, if the web 3010 is flexible and if the blisters 3011, 3012 are formed and held open by using vacuum, pressure, or other external forces (not shown), e.g., to enable placement of items 3005 into the blisters 3011, 3012, then removal of the external forces after attaching the cover 3030 to the web 3010 will allow the blisters 3011, 3012 to resile back around the items 3005, as shown. Thus, the material of the web 3010 may be elastically expanded to create recesses for the items 3005 and resiliently contracted once the items 3005 are received therein to define blisters 3011, 3012 closely surrounding the items 3005.

Air or other gases may be allowed to escape during resilient contraction, e.g., through porous or otherwise unsealed features. For example, the cover 3030 may be porous to accommodate such gases escaping after sealing. Alternately, the cover 3030 may be partially sealed, leaving vents or other features to accommodate gases escaping. Any such features may be fully sealed subsequently during processing.

Figure 26:
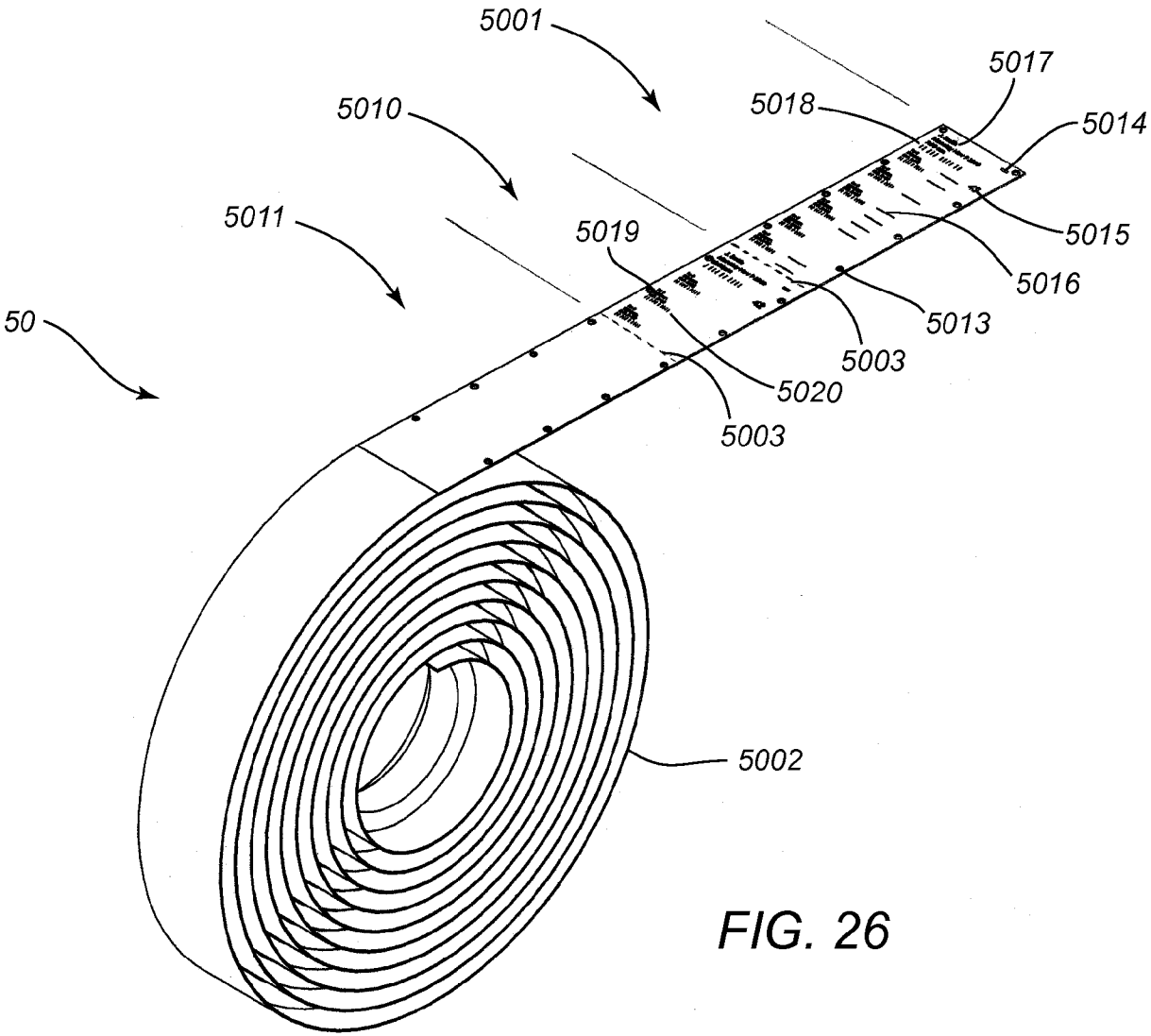
FIG. 26 is a perspective view of an exemplary embodiment of a substantially continuous strip of single-use packages wound into a coil arrangement.

Turning to FIG. 26, an exemplary embodiment of a substantially continuous strip 50 of multiple single-use packages 5001, 5010, and 5011 is shown. As used herein, a "substantially continuous" strip may include a plurality of single-use packages formed together, e.g., using a substantially continuous process. Alternatively, individual packages may be formed separately, and joined together or carried on a substantially continuous strip (not shown), similar to other embodiments herein. For example, the components of each single-use package 5001, 5010, 5011, etc., e.g., cover, web, etc., may be fed substantially continuously from rolls or other storage devices (not shown), along and/or within a system for forming the components into a single strip 50 including multiple single-use packages, e.g., separated by separation features or otherwise spaced apart to accommodate separation, as described elsewhere herein. In exemplary embodiments, the resulting substantially continuous strip may include sufficient single-use packages, e.g., for a single day, a single week, or an entire month, (or more) depending upon the number of single-use packages desired to be packaged together.

Optionally, as shown in FIG. 26, the substantially continuous strip 50 may be formed into a coil 5002 or other convenient package or arrangement for subsequent storage and/or use. The single-use packages 5001, 5010, 5011, etc. may be disposed on the strip 50 in the desired sequential order of dispensing, i.e., the first single-use package 5001 on a first dispensing end of the strip 50 is the next one to be dispensed. Optionally, perforations 5003, weakened regions, and/or other frangible features may be provided between adjacent single-use packages 5001, 5010, 5011, etc., e.g., extending transversely across the cover 1030 and/or web 1010. The number of items in each single-use package may vary. For example, as shown, the first single-use package 5001 contains six (6) items, and the second single-use package 5010 contains three (3) items. Optionally, holes 5013, notches, indentations, and/or other mechanical features may be provided along the strip 50, e.g., to aid in automated packaging and/or dispensing. For example, the holes 5013 may cooperate with a tractor-feed mechanism of a dispensing machine (not shown) to advance the first package 5001 or one or more of the subsequent packages, if desired. Machine readable information 5016, such as bar codes, 2D barcodes, RFID chips, magnetic strips, and/or other machine-readable information may also be provided along the strip 50, e.g., to aid in automated packaging and/or dispensing. For example, machine readable alignment and positioning features 5014 may be provided to aid in automated packaging and dispensing, and package sequence information 5015 (e.g., package number on strip) may be provided. In addition or alternatively, human-readable use information 5017 and/or machine readable use information 5018 may be provided on each single-use package 5001, 5010, and 5011 and/or human-readable item information 5019 and machine-readable item information 5020 may be provided for each item in the blisters 5020.

Figure 27:
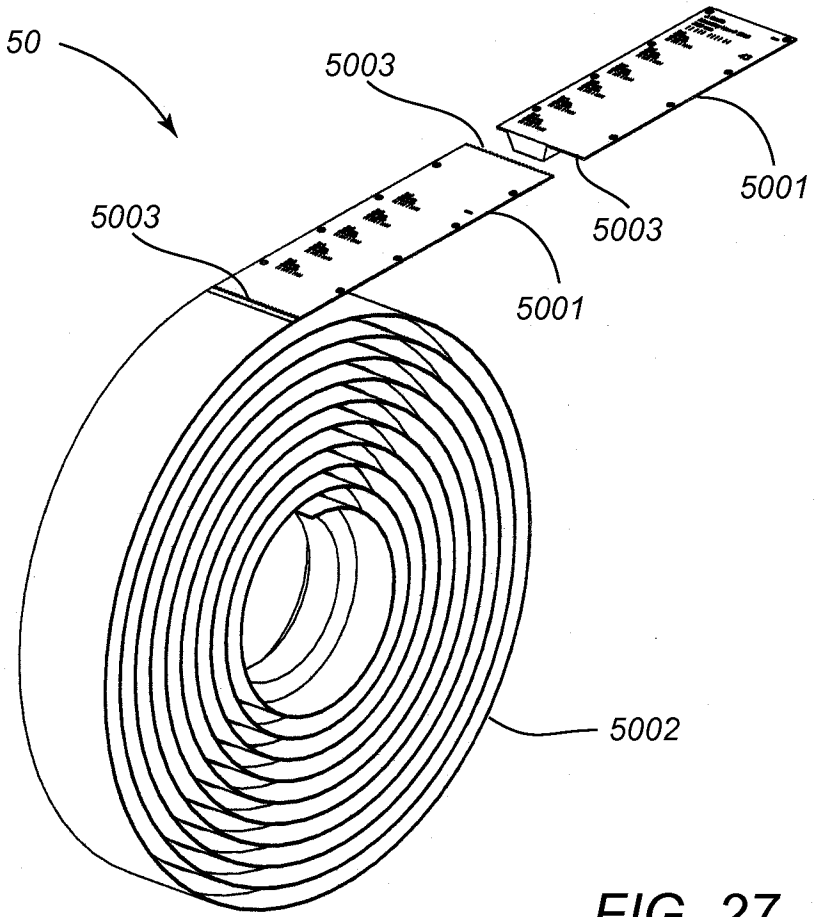
FIG. 27 is a perspective view of the coil arrangement of FIG. 26, showing a first single-use package being removed from a first end of the coil.
Figure 28:
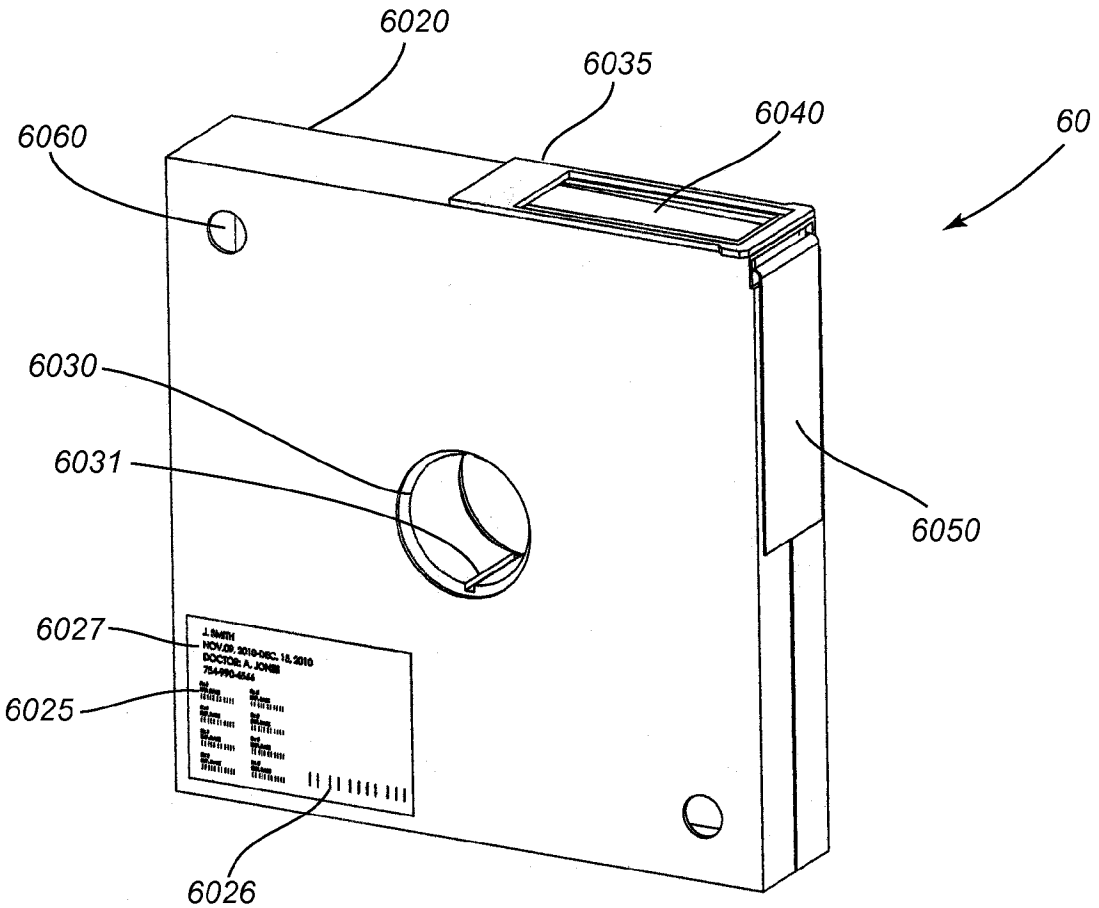
FIG. 28 is a perspective view of an exemplary embodiment of a cassette containing a substantially continuous strip of single-use packages, such as that shown in FIGS. 26 and 27.

FIG. 27 shows another exemplary embodiment of a substantially continuous strip 50 of multiple single-use packages with one single-use package 5001 separated from the strip 50 at perforation (or other frangible features) 5003.

Figure 29:
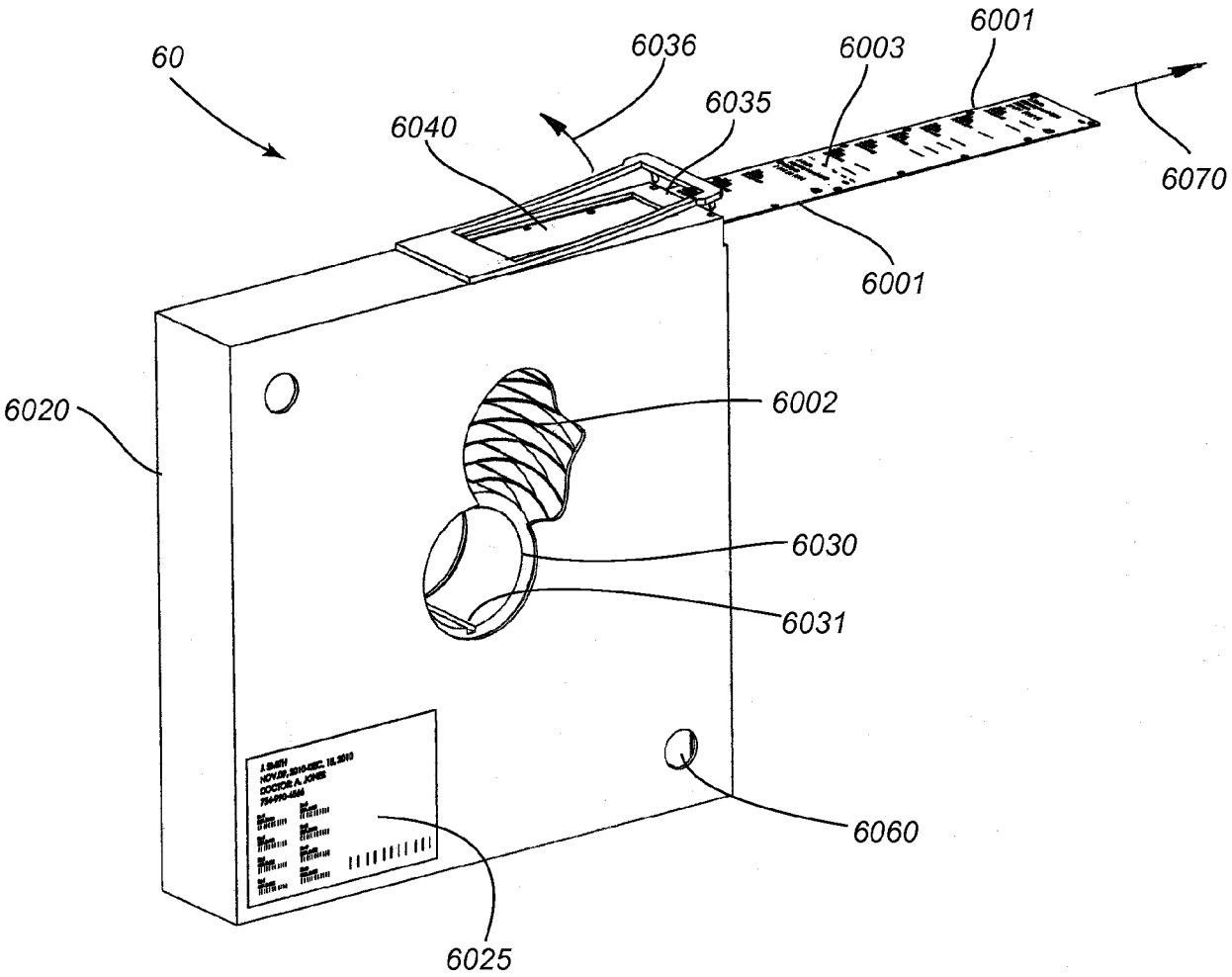
FIG. 29 is a perspective view of the cassette of FIG. 28, showing a first single-use package on a first end of the strip being pulled from the cassette.
Figure 30:
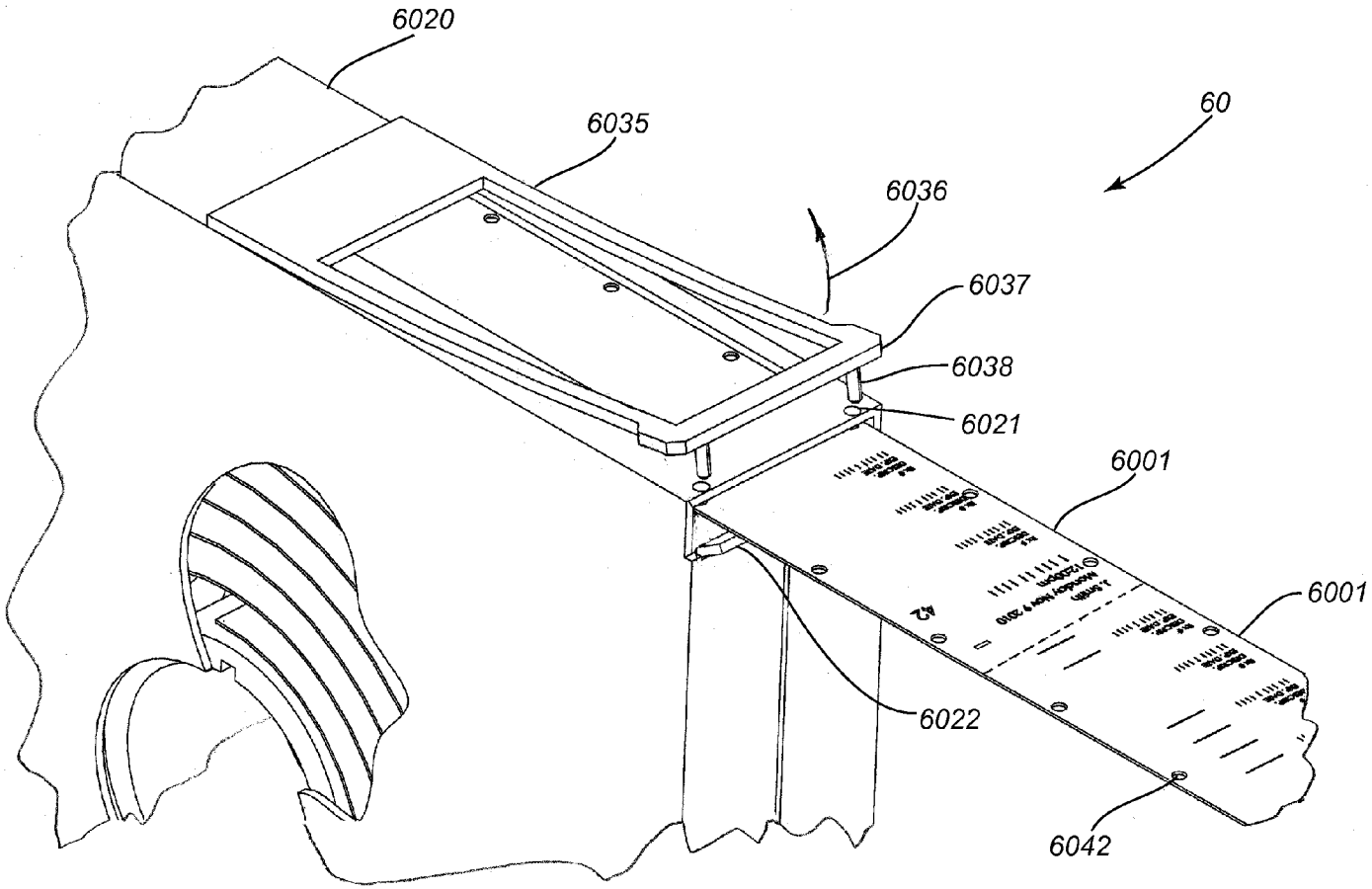
FIG. 30 is a detail of the cassette of FIGS. 28 and 29, showing a latch on an outlet of the cassette for limiting removal of single-use packages from the cassette.

Turning to FIGS. 28-31, an exemplary embodiment of a box or cassette 60 is shown for storing and/or dispensing a plurality of single-use packages 6001, e.g., provided in a substantially continuous strip therein. As shown in FIGS. 29 and 30, the single-use packages 6001 may be provided in a coil arrangement 6002 within a cassette housing 6020. Optionally, the cassette housing 6020 may include alignment features 6060, e.g., to aid in positioning the cassette 60 in a dispensing fixture or machine (not shown). A core 6030 may be positioned at the center of the coil 6002, e.g., to aid in automated or manual dispensing, and/or to aid in winding the coil 6002 into the cassette housing 6020. The core 6030 may include optional grip feature(s) 6031 to enable reliable machine or fixture contact with the core 6030. A label 6025 may be attached to the cassette housing 6020, and may include human-readable information 6027 and 6025 (e.g., patient, prescription numbers, doctor or pharmacist contact information, and the like), and/or machine-readable information 6026 (e.g., patient, prescription numbers, doctor or pharmacist contact information, and the like). In exemplary embodiments, the machine-readable information may take the form of bar codes, RFID chips, magnetic strips, and/or other suitable features. A tamper-evident leader 6050 may be adhered to or otherwise provided on the cassette housing 6020, e.g., to show if the cassette 60 has been prematurely opened. A childproofing latch or other suitable feature 6035 may also be provided, if desired, as explained further below. An optional view window 6040 may also be provided to permit users to read human-readable information on one or more of the single-use packages 6001 within the cassette 60, also as described further below.

FIG. 29 shows the cassette 60 of single-use packages 6001 arranged as a coil 6002 with the cassette 60 opened and a first end of the coil 6002 pulled out along axis 6070 to expose one or more of the single-use packages 6001. Similar to other embodiments herein, as shown, the single-use packages 6001 may be separated by a perforation and/or other suitable frangible features 6003. Optionally, the cassette 60 may include a childproofing latch 6035 shown pulled upward along path 6036 in FIG. 29, thus permitting the strip of single-use packages 6001 to be pulled out of the cassette housing 6020 for dispensing. Human-readable information and/or machine readable information, such as that described above with reference to FIG. 6 or elsewhere herein may be viewed through view window 6040. For example, the window 6040 may allow one or more of the next single-dose packages to be viewed, e.g., to facilitate scheduling and/or otherwise planning the dispensing of the viewed packages.

FIG. 30 shows additional detail of the features of the cassette 60 while a single-use package 6001 is being dispensed, as shown in FIG. 29. As shown, the childproofing latch 6035 includes finger bosses 6037, e.g., to improve the user's grip on the childproofing latch 6035, in order for the user to lift the childproofing latch 6035 up approximately along path 6036. Lifting the childproofing latch 6035 along the path 6036 disengages latch features 6038 on the childproofing latch 6035 from perforations or other suitable features 6042 in the single-use packages 6001, allowing the single-use package 6001 to be removed from the cassette 60.

Optionally, a drag feature 6022 may be provided on the cassette housing 6020, for example, to apply a force to the single-use package 6001 on the first end of the coil 6002, e.g., to prevent the user from inadvertently pulling too many packages out of the cassette housing 6020, and/or to prevent the strip of single-use packages 6001 from inadvertently sliding backwards into the cassette housing 6020.

Figure 31:
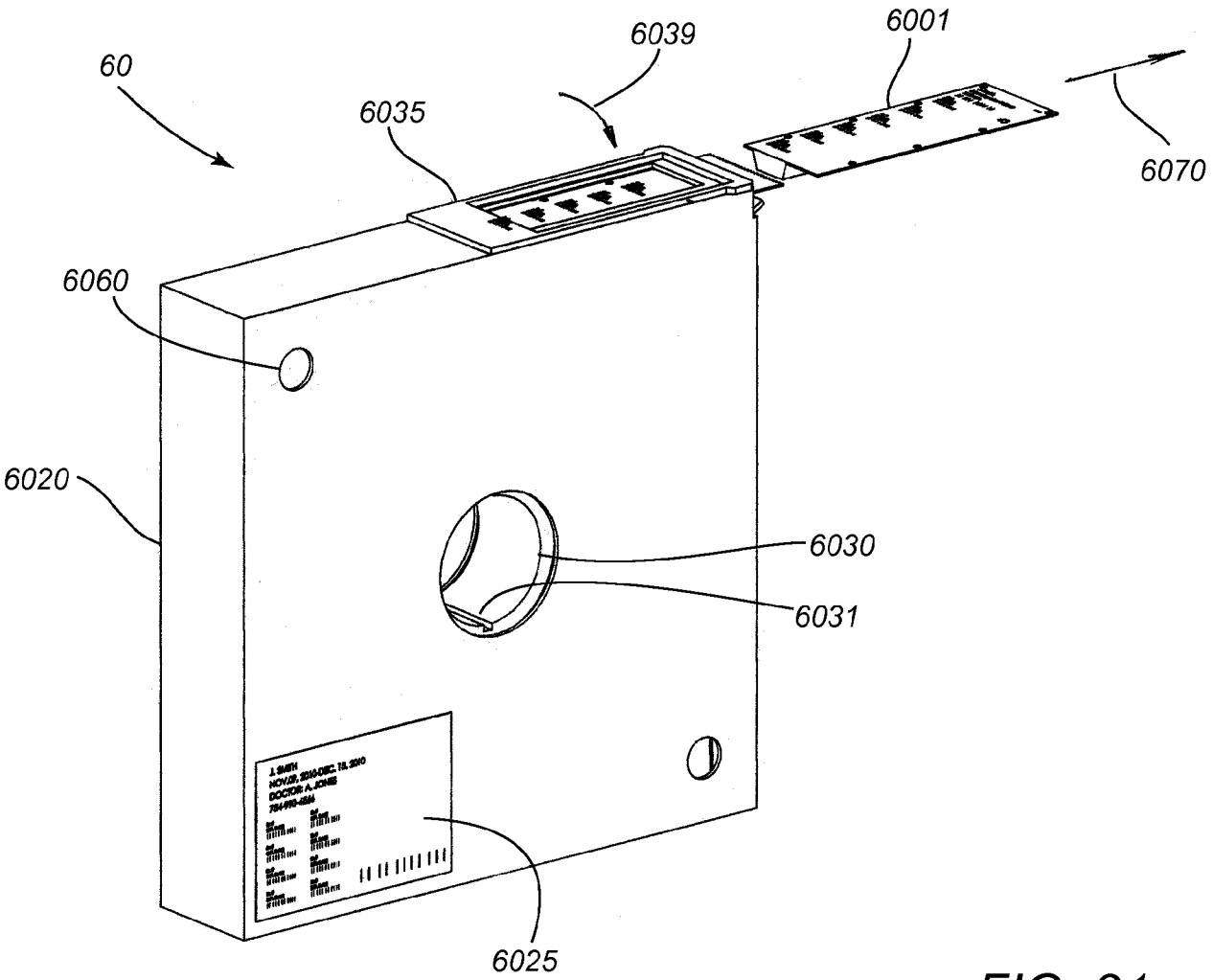
FIG. 31 is a perspective view of the cassette of FIGS. 28-30, showing the first single-use package being separated from the next single-use package.

FIG. 31 shows the cassette 60 of single-use packages with a first single-use package 6001 separated at a perforation or other suitable frangible features 6003. The childproofing latch 6035 is shown resiled back approximately along path 6039 such that the latch features 6038 can re-engage perforations or other suitable features in the next single-use package 6001.

Figure 32:
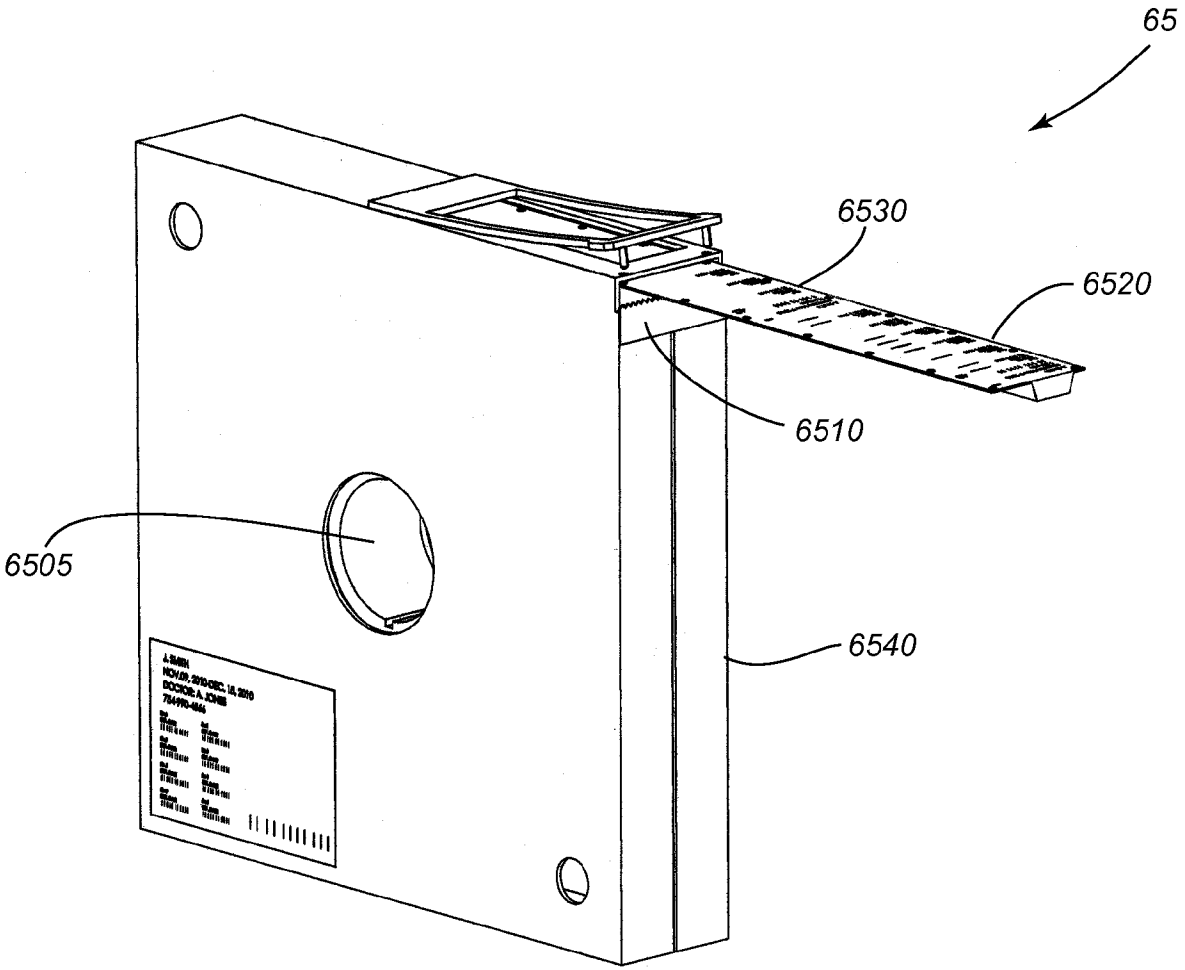
FIG. 32 is a perspective view of another embodiment of a cassette that includes a blade adjacent an outlet of the cassette for separating a first single-use package from the next single-use package.

FIG. 32 shows an alternative embodiment of a cassette 65 of single-use packages arranged on a continuous strip formed into a coil 6505 and located in a cassette housing 6540, generally similar to the previous embodiment. Unlike the previous embodiment, the cassette housing 6540 includes a cutting blade 6510 to enable the user to separate single-use packages 6520 from the strip 6530 by cutting through the strip 6530 at the desired location, e.g., to sequentially separate and/or otherwise remove the single-use packages 6520 from the cassette 65. In this alternative, frangible features may be omitted between adjacent single-use packages 6520 and sufficient space may be provided between end blisters on adjacent single-use packages 6520 to accommodate cutting between the adjacent packages 6520 to separate the first package from the next one. Optionally, the cassette 65 may include a stop and the coil 6505 may include corresponding features (not shown) located at predetermined positions on each single-use package 6520 such that the first dispensing end of the coil 6505 may be pulled from the cassette 65 until the features engage and prevent further removal of the dispensing end. For example, the features may engage and stop further removal when the region between the first and second packages on the first end is aligned with the blade 6510. Thus, these features may ensure that the packages are cut at the correct location to properly separate the first single-use package 6520 from the next one. The features may be manually disengaged after actuating the blade 6510 or actuation of the blade 6510 may automatically release the features to allow the dispensing end to be removed sufficiently to separate the next single-use package 6520.

Figure 33A:
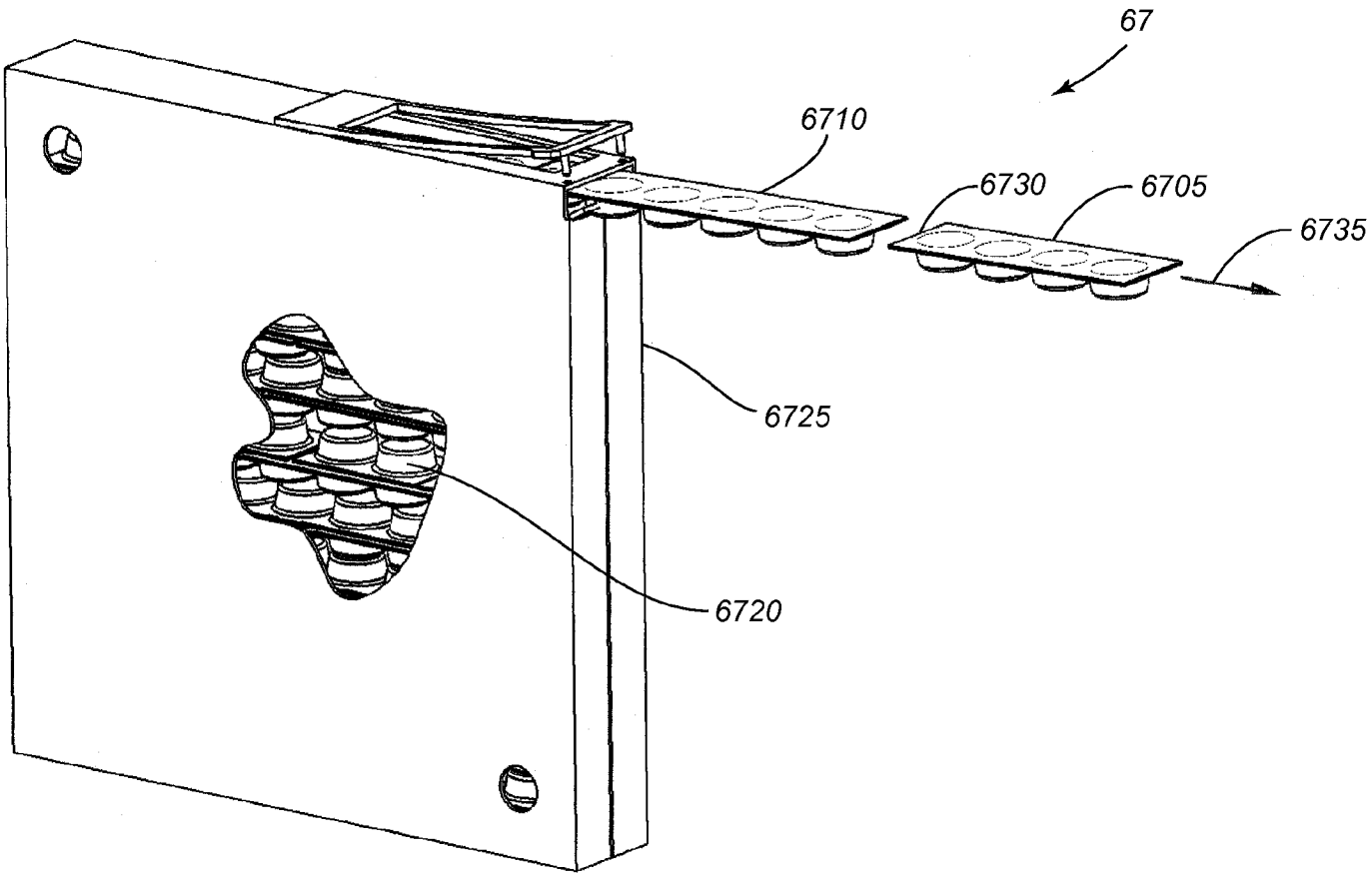
FIGS. 33A and 33B are perspective and cross-sectional views of still another embodiment of a cassette including a substantially continuous strip of single-use packages contained therein in a serpentine arrangement.
Figure 33B:
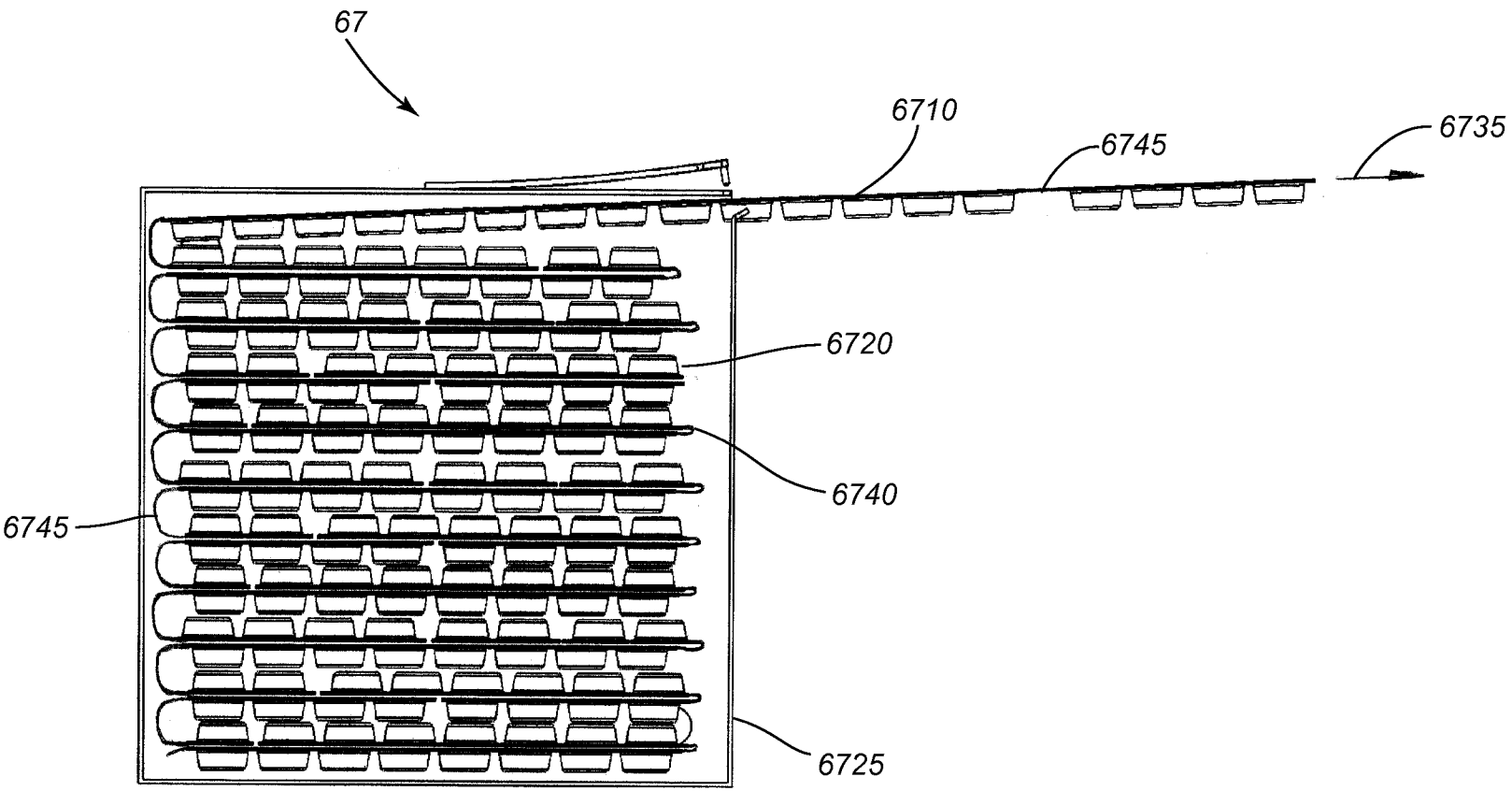

Turning to FIGS. 33A and 33B, another embodiment of a cassette 67 of single use packages 6705 is shown contained within a cassette 67. Although the single-use packages 6705 may be arranged in a substantially continuous strip 6710, similar to the previous embodiments, the strip 6710 is provided in a serpentine arrangement 6720 (best shown in FIG. 33B) within a cassette housing 6725. As shown in FIG. 33A, the cassette housing 6725 may include similar features to other embodiments herein. FIGS. 33A and 33B show the cassette 67 of single-use packages 6705 with the cassette housing 6725 opened and a first dispensing end of the strip 6710 of single-use packages 6705 being pulled out along axis 6735 to remove a first single-use package. The single-use packages 6705 may be separated by a perforation or other suitable frangible features 6730 or, alternatively, the cassette 67 may include a cutting blade and the like (not shown) for separating successive single-use packages, similar to other embodiments herein.

As shown in FIG. 33B, the strip 6710 may be arranged in a serpentine form, in which successive layers of single-use packages 6705 are connected by joints 6740, 6745. The joints 6740, 6745 may have lengths sufficient to allow the layers of single-use packages 6720 to lie substantially horizontal or flat within the housing 6725. In addition, the joints 6740, 6745 that connect the layers of single-use packages 6705 and/or the single-use packages 6705 themselves may be sufficiently flexible to permit the serpentine strip 6710 to be pulled out of cassette housing 6725 along axis 6735 without substantial risk of jamming within the housing 6725. The joints 6740, 6745 may be formed from the same materials used to produce the single use packages 6705, for example, as part of the strip 6710, e.g., by a layer of the cover and web material. Alternatively, the joints 6740, 6745 may be formed less than all of the layers of the single-use packages 6705, e.g., only from the web or cover material to increase their flexibility, if only portions of the materials of the single-use packages 6705 are substantially continuous along the length of the strip 6710. In a further alternative, the joints 6740, 6745 may be provided at locations within individual single-use packages, e.g., if the lengths of the single-use packages vary along the length of the strip 6710, to accommodate placing the strip 6710 in the serpentine arrangement.

Figure 34A:
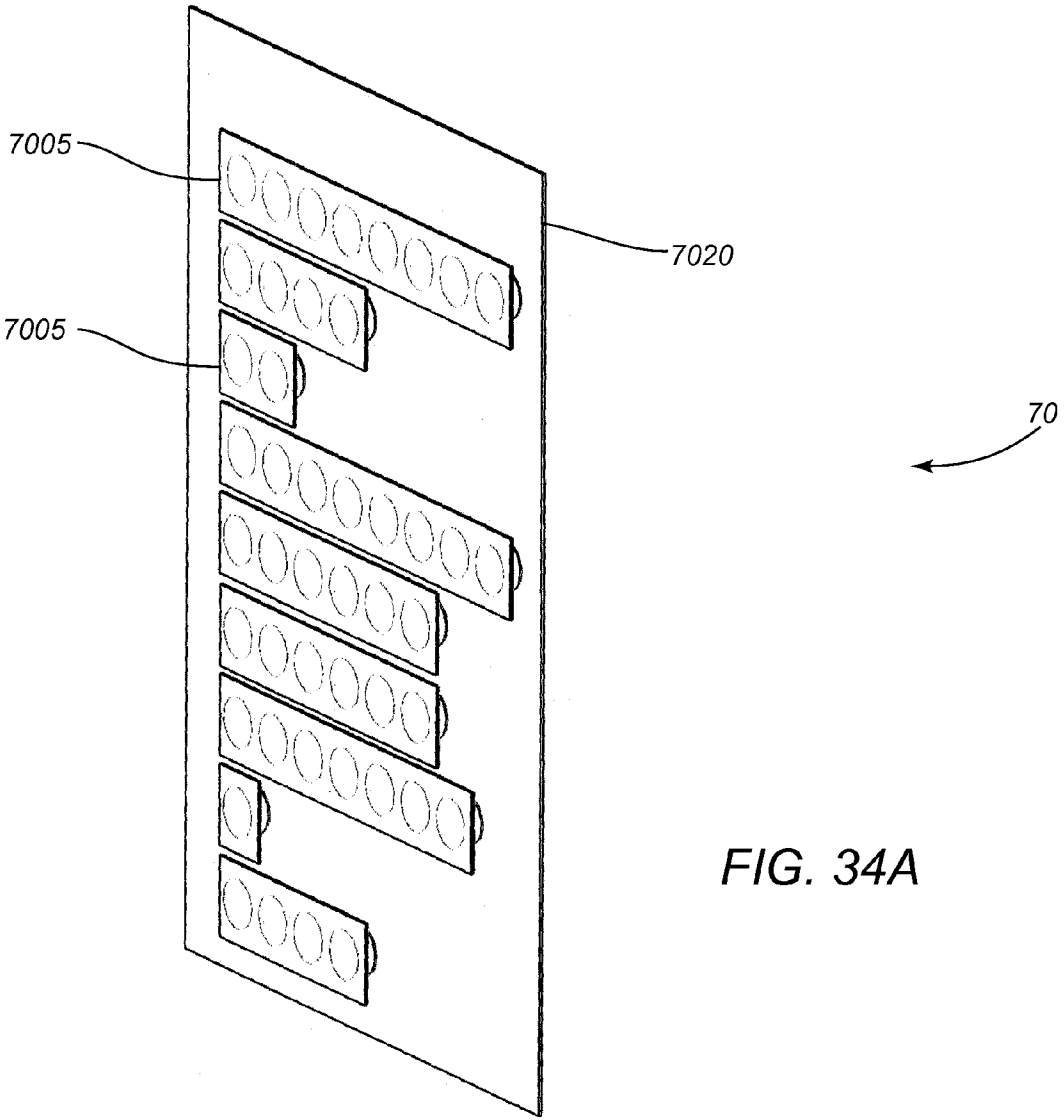
FIGS. 34A and 34B are perspective views of a dispensing calendar including a plurality of single-use packages removably attached to a card.
Figure 34B:
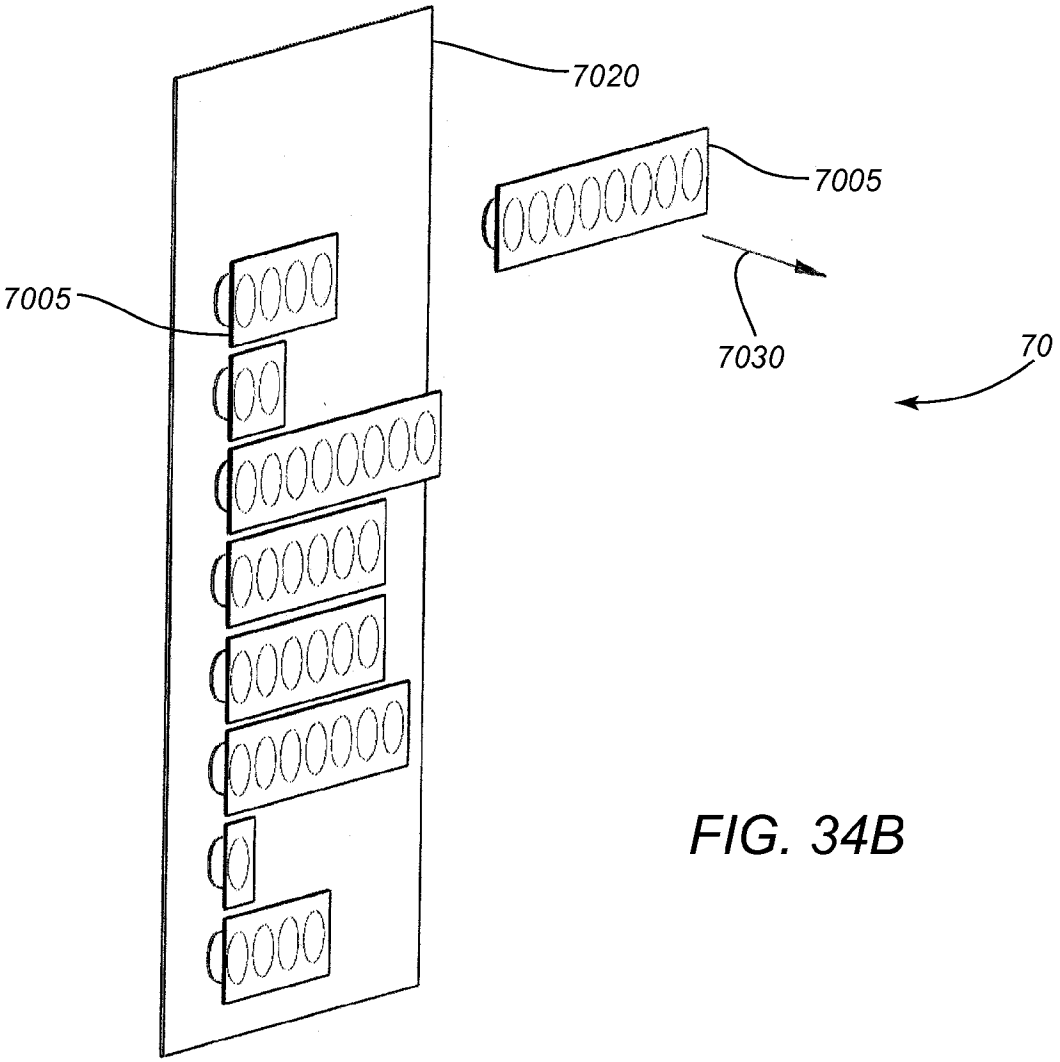

Turning to FIGS. 34A and 34B, an alternative embodiment of an arrangement or grouping of single-use packages 7005 is shown that includes a dispensing calendar 70 including a plurality of single-use packages 7005, which may be similar to any of the embodiments herein, attached to a card 7020. The single-use packages 7005 may be formed similar to any of the embodiments herein, e.g., separately or substantially continuous and then separated before being attached to the card 7020. The card 7020 may be a substantially planar piece of paper, cardboard, fabric, and the like, which may be substantially rigid or may be foldable or rollable to facilitate storage and/or use. The single-use packages 7005 may be arranged on the card 7020 in sequence, e.g., adjacent one another vertically, horizontally, and the like, such that a first single-use package 7005 on one end may be separated as shown in FIG. 34B and used. The single-use packages 7005 may then be sequentially removed from the card 7020, which may includes instructions or other visual guides (not shown) to ensure that the packages 7005 are separated and used in the proper order. The single-use packages 7005 may be removably attached to the card 7020 by using adhesives, tapes, welding, clips, and the like (not shown), e.g., such that the single-use packages 7005 may be separated from the card 7020 by pulling (for example along path 7030), peeling, cutting, and the like.

Figure 35:
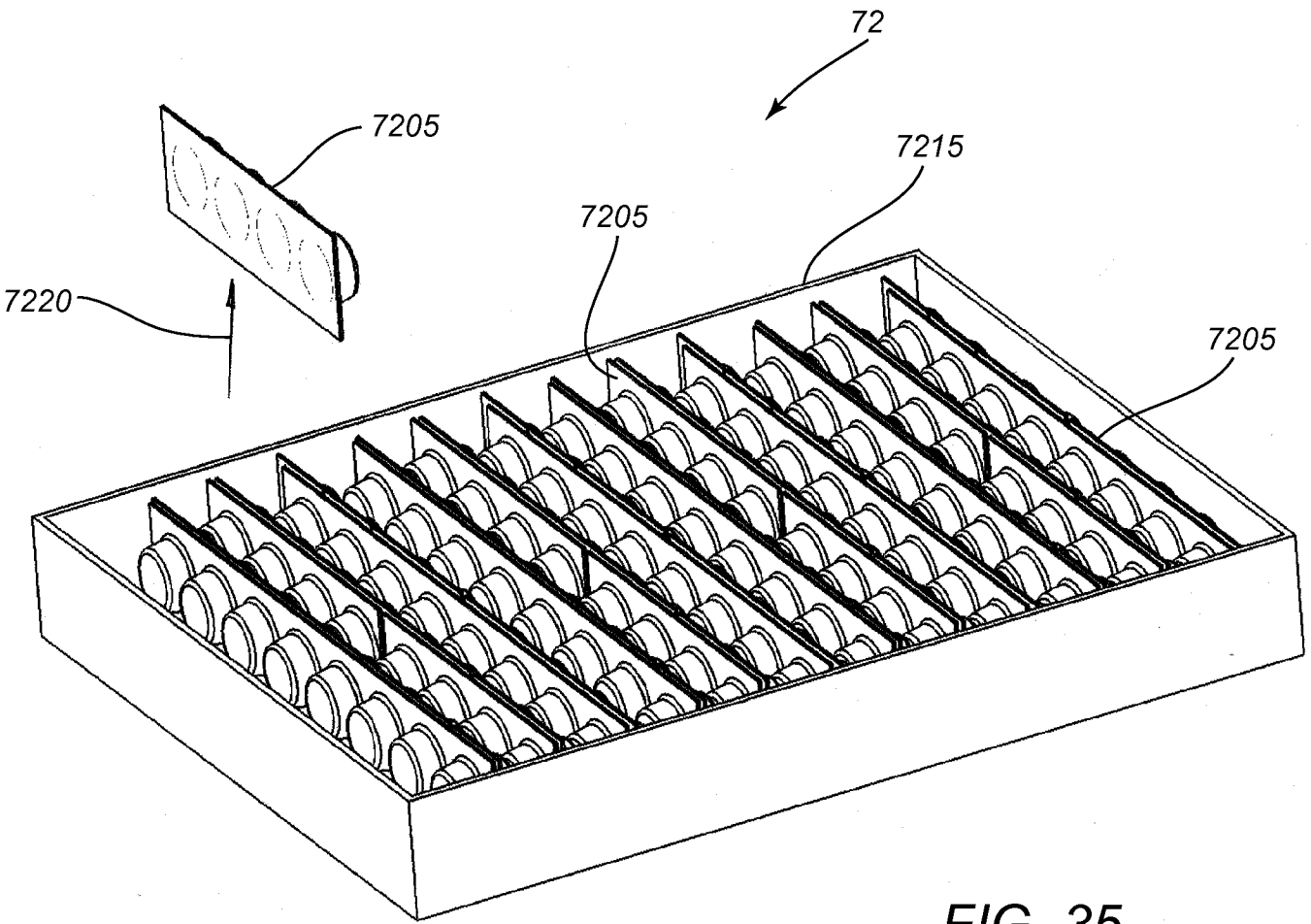
FIG. 35 is a perspective view of a dispensing box including a plurality of single-use packages removable therefrom.

FIG. 35 shows another alternative arrangement for grouping single-use packages 7205 together that includes a dispensing box 72 including a plurality of single-use packages 7205 arranged inside the box 7215. The single use packages 7205 may be arranged in the box 7215 in sequence and optionally may include instructions or visual guides (not shown), e.g., to ensure that the single-use packages 7205 are removed and used in the proper sequence. The single-use packages 7205 may be formed similar to any of the embodiments herein, e.g., separately or substantially continuous and then separated before being attached or placed within the box 7215. Optionally, the single-use packages 7205 may be removably attached to or otherwise secured within the box 7215, e.g., by adhesives, tapes, welding, clips, and the like (not shown). The single-use packages 7205 may be separated from the box 7215, e.g., by pulling (for example along path 7220), peeling, cutting, and the like.

Figure 36:
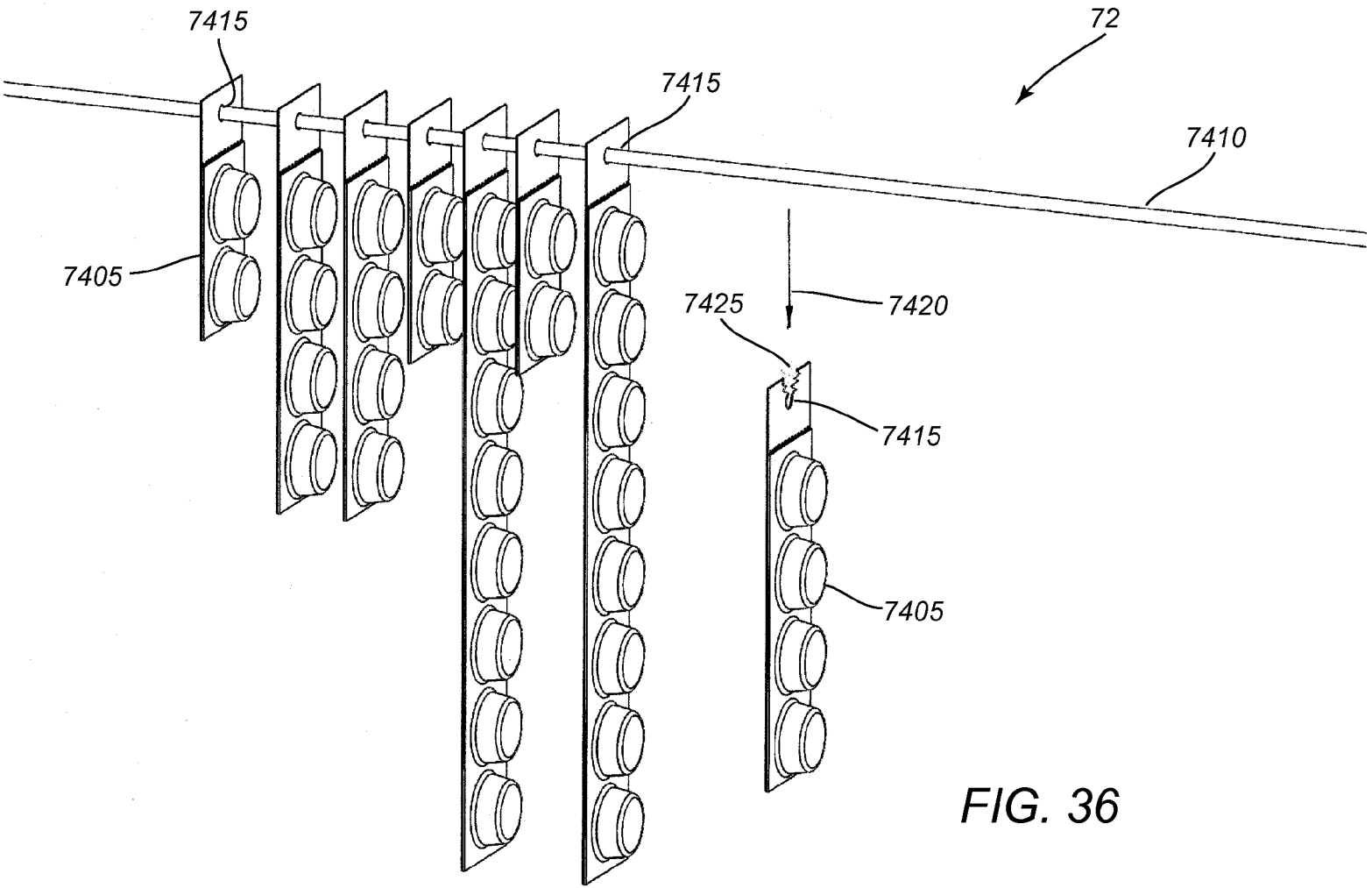
FIG. 36 is a perspective view of an exemplary embodiment of a dispensing line removably carrying a plurality of single-use packages.

Turning to FIG. 36, yet another alternative arrangement or grouping of single-use packages 7405 is shown that includes a dispensing line 74 including a plurality of single-use packages 7405 hung from line 7410. The single-use packages 7405 may be formed similar to any of the embodiments herein, e.g., separately or substantially continuous and then separated before being attached to or otherwise placed on the line 7410.

The single use packages 7405 may be arranged on the line 7410 in sequence, e.g., by attaching the single-use packages 7405 to the line 7410 by a hole 7415 in each single-use package 7405. Ends of the line 7410 may include features, e.g., enlarged portions (not shown) larger than the holes 7415, to prevent the single-use packages 7405 from falling off the line 7410. The single-use packages 7405 may be separated from the line 7410 by pulling (for example along path 7420), cutting, and the like. For example, each single-use package 7405 may be separated successively from the line 7410 simply by tearing material surrounding the hole 7415, e.g., leaving a channel 7425. The dispensing line 7410 may be substantially rigid, flexible, malleable, and the like. For example, the line 7410 may be a substantially rigid rod or tube provided in a substantially linear arrangement, or alternatively in a "C," "O" ring, or other curved arrangement (not shown), if desired. Alternatively, the line 7410 may be flexible or malleable such that the user may reorient the line 7410 into a convenient or other desired shape.

Figure 37:
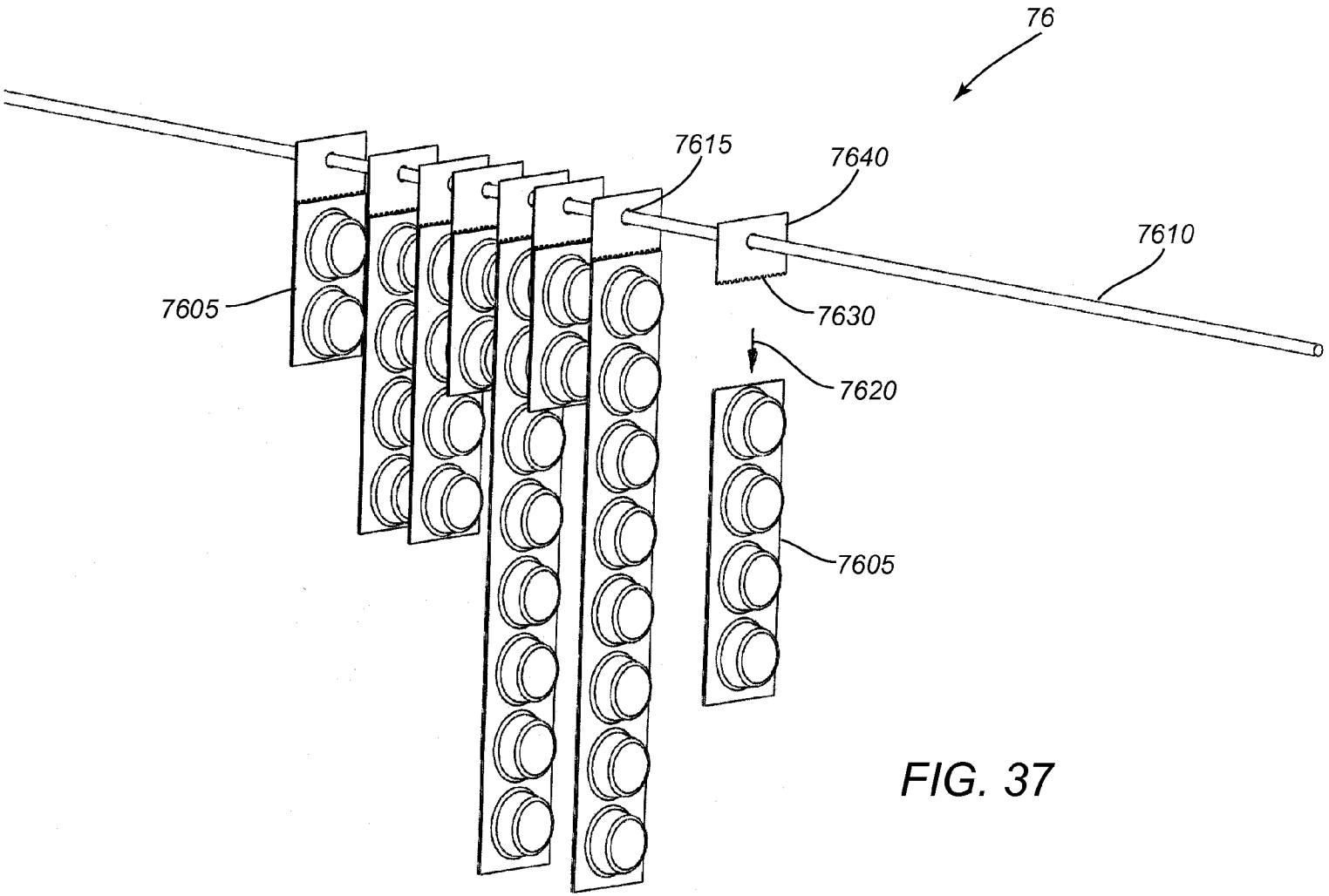
FIG. 37 is a perspective view of another embodiment of a dispensing line removably carrying a plurality of single-use packages.

FIG. 37 shows an alternative arrangement or grouping single-use packages 7605 generally similar to that of FIG. 36. For example, a dispensing line 76 may be provided for carrying a plurality of single-use packages 7605, e.g., arranged on the line 7610 in sequence. The single-use packages 7605 may be attached to the line 7610 by a hole 7615 in each single-use package 7605. Unlike the previous embodiment, the single-use packages 7605 may include one or more frangible features 7630, which may be torn, cut, or otherwise separated to remove each single-use package 7605, leaving a tab 7640 attached to the line 7610. The tab 7640 may include any desired labels or other information, similar to other embodiments herein, e.g., to identify the contents of any removed single-use packages 7605.

Figure 38:
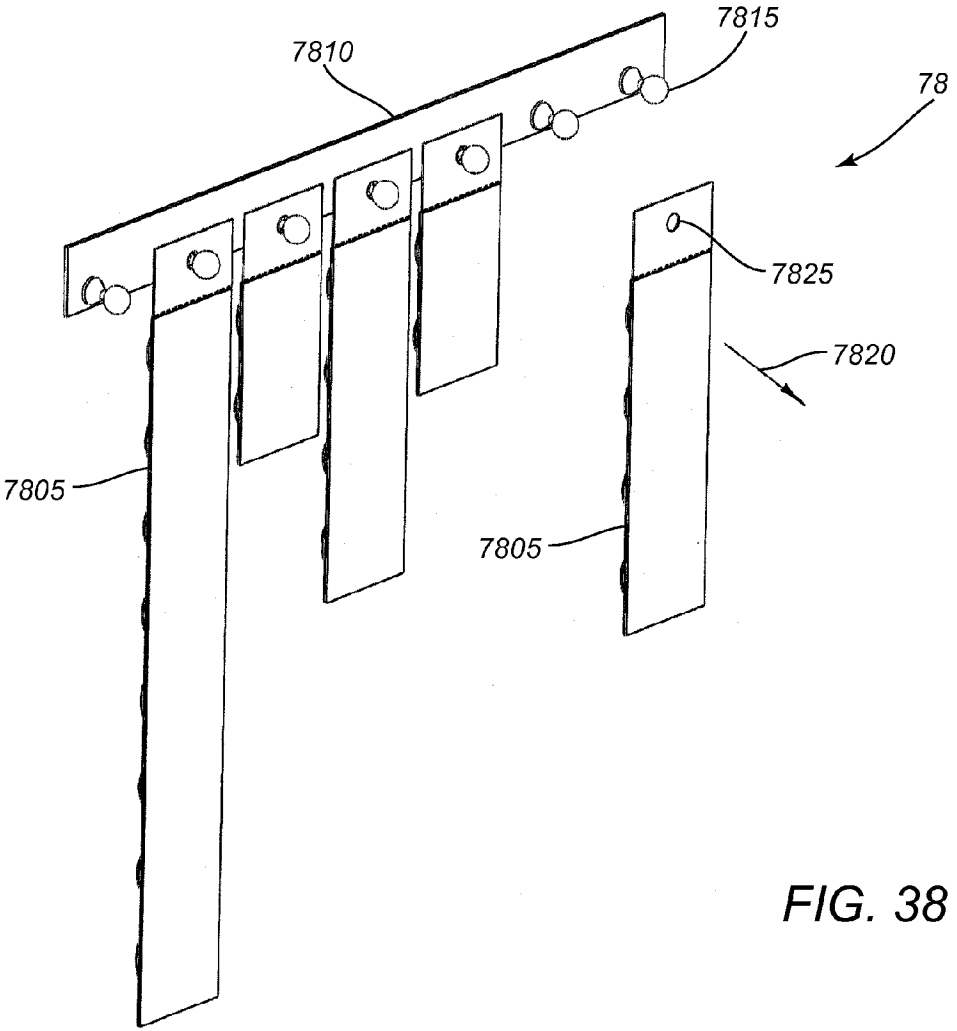
FIG. 38 is a perspective view of a dispensing rail including a plurality of single-use packages removable therefrom.

Turning to FIG. 38, yet another alternative arrangement or grouping single-use packages 7805 is shown that includes a dispensing rail 78 including a plurality of single-use packages 7805 hung from bosses 7815 spaced apart or otherwise arranged on the rail 7810, e.g., in sequence similar to the previous embodiments. The single-use packages 7805 may be formed similar to any of the embodiments herein, e.g., separately or substantially continuous and then separated before being attached to or otherwise placed on the rail 7810. The single-use packages 7805 may attached to the bosses 7815 on the rail 7810, e.g., using a hole 7825 in each single-use package 7805. The single-use packages 7805 may be separated from the bosses 7815, e.g., by pulling (for example along path 7820), cutting, and the like. The dispensing rail 7810 may be rigid or flexible, substantially straight, curved, and the like, similar to the dispensing line 7410 described above.

Figure 39:
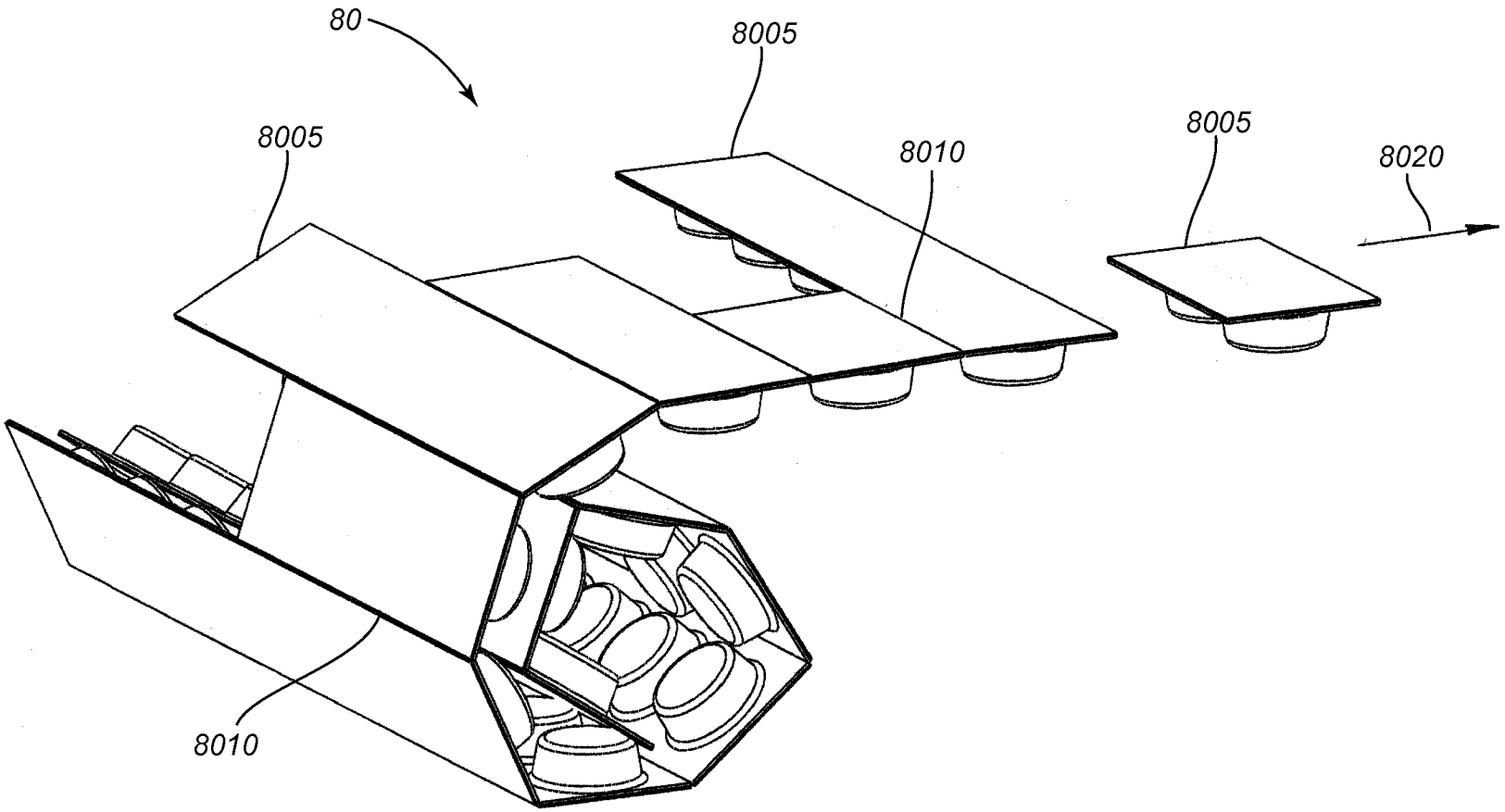
FIG. 39 is a perspective view of a dispensing coil including a plurality of single-use packages removable sequentially therefrom.

Turning to FIG. 39, another exemplary embodiment of a substantially continuous strip of single-use packages 8005 is shown that includes a lateral or side orientation coil 80. Unlike the previous coils, the single-use packages 8005 are attached or otherwise formed together along their sides 8010 to adjacent single-use packages 8005 rather than at their ends. Each single-use package 8005 may be formed similar to any of the embodiments herein, e.g., separately or substantially continuous and then separated before being attached together into the coil 80. Adjacent single-use packages 8005 may be attached together, e.g., butted or lapped together, using adhesives, tapes, clips, and the like (not shown), or alternatively, the single-use packages 8005 may be manufactured already attached along their sides 8010. The single-use packages 8005 may be separated from the coil 80 by pulling (for example along path 8020), cutting, or other methods. For example, the coil 80 may include one or more frangible features between adjacent single-use packages 8005, similar to other embodiments herein. The coil 80 may be provided in a box or cassette (not shown), which may facilitate removing single-use packages 8005 from a first dispensing end of the coil 80, similar to other embodiments herein.

Figure 40A:
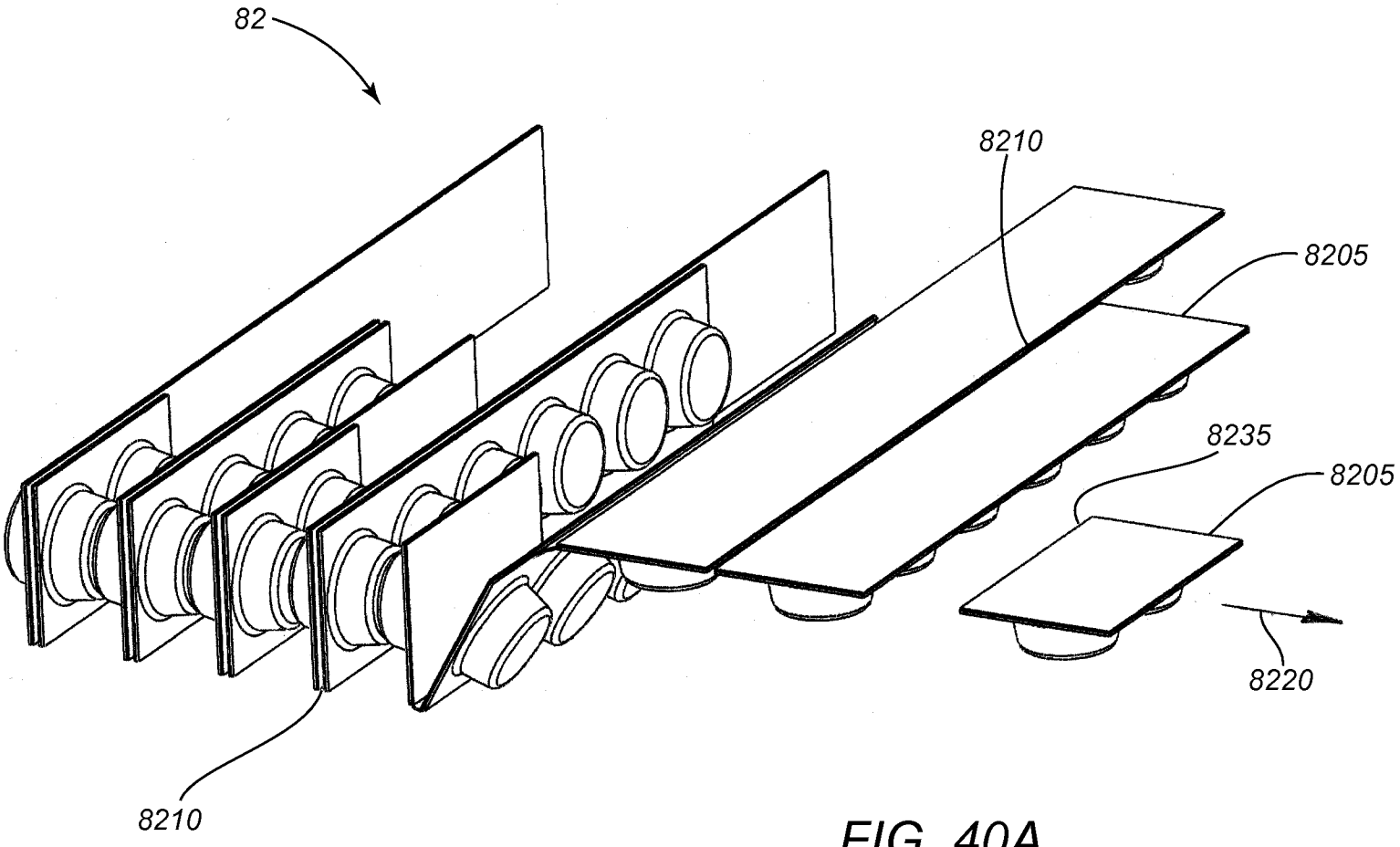
FIGS. 40A and 40B are perspective and side views, respectively, of another embodiment of a dispensing apparatus including a plurality of single-use packages in a serpentine arrangement allowing the packages to be removed sequentially therefrom.
Figure 40B:
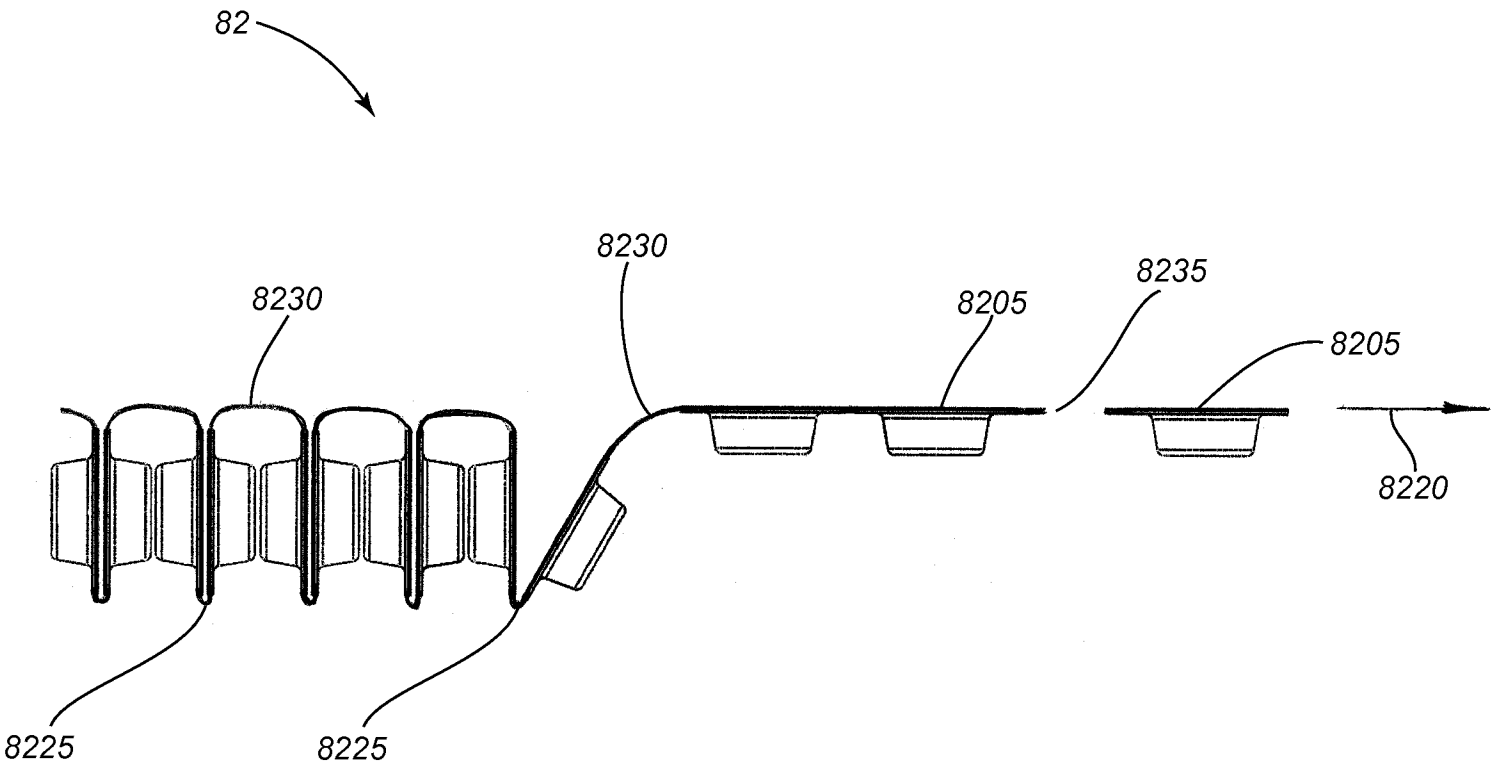

FIGS. 40A and 40B show another embodiment of a substantially continuous strip of single-use packages 8205 provided in a lateral or side orientation serpentine arrangement or group 82. Similar to the previous embodiment, adjacent single-use packages 8205 are attached or otherwise formed together along their sides 8210, rather than their ends. For example, the single-use packages 8205 may be attached together using adhesives, tapes, clips, and the like (not shown), or may be manufactured already attached along their sides 8210. Adjacent single-use packages 8205 may be attached together by substantially continuous elongated joints 8225 and 8230 or by a plurality of spaced apart joints, e.g., at each end of the shortest package of each adjacent pair (not shown). Similar to the previous embodiments, the single-use packages 8205 may be provided within a box or cassette (not shown), if desired, and/or separated from the side orientation serpentine group 82 by pulling (for example along path 8220), cutting, and the like.

Figure 41:
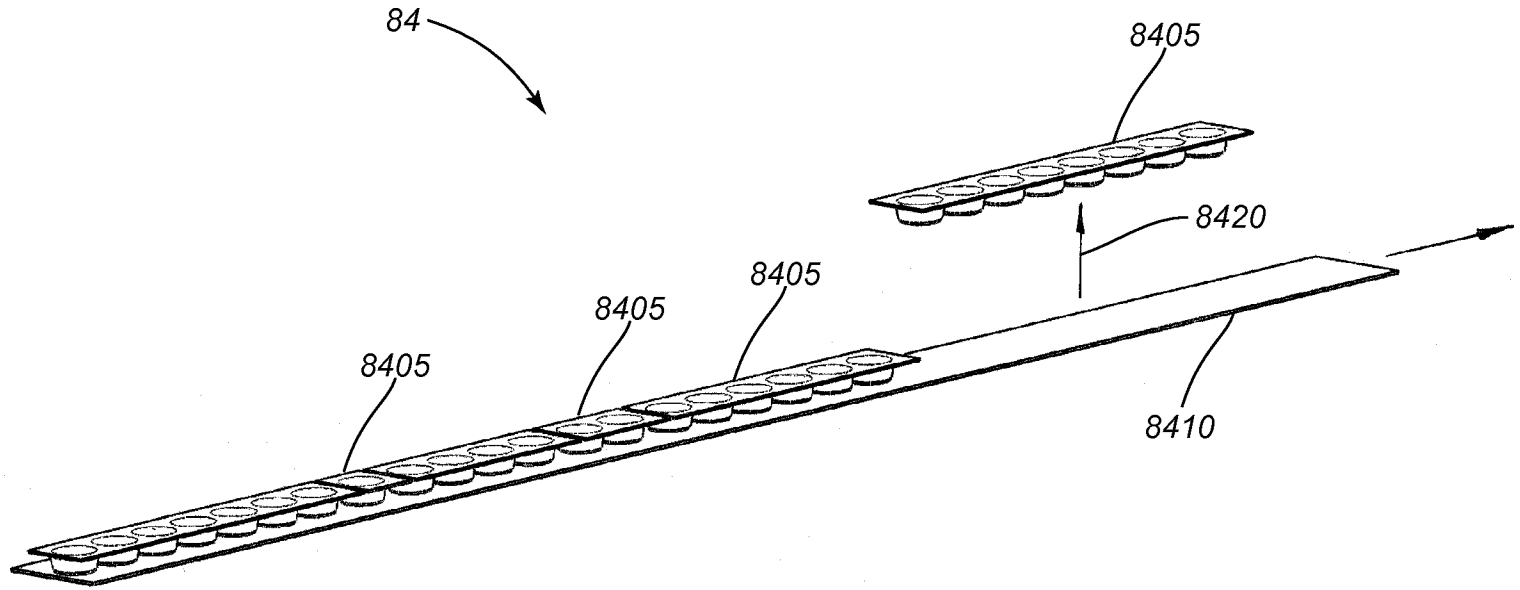
FIG. 41 is a perspective view of yet another embodiment of a dispensing apparatus including a plurality of single-use packages removable attached to a dispensing belt in a single file arrangement.

Turning to FIG. 41, yet another embodiment of a substantially continuous arrangement or grouping of single-use packages 8405 provided in an axial belt grouping 84 in which a plurality of single-use packages 8405 are attached to a belt 8410. Each single-use package 8405 may be formed similar to any of the embodiments herein, e.g., separately or substantially continuous and then separated before being attached to the coil 8410. The single-use packages 8405 may be removably attached to the belt 8410, e.g., by adhesives, tapes, clips, welding, and the like (not shown). During use, the single-use packages 8405 may be separated from the belt 8410, e.g., by pulling (for example along path 8420), peeling, cutting, and the like. The belt 8410 may be formed from a substantially rigid or flexible strip of material, e.g., paper, polymer, release liner, and the like, which may be provided in a substantially linear configuration, a coiled configuration, a serpentine arrangement, and the like (not shown).

Figure 42:
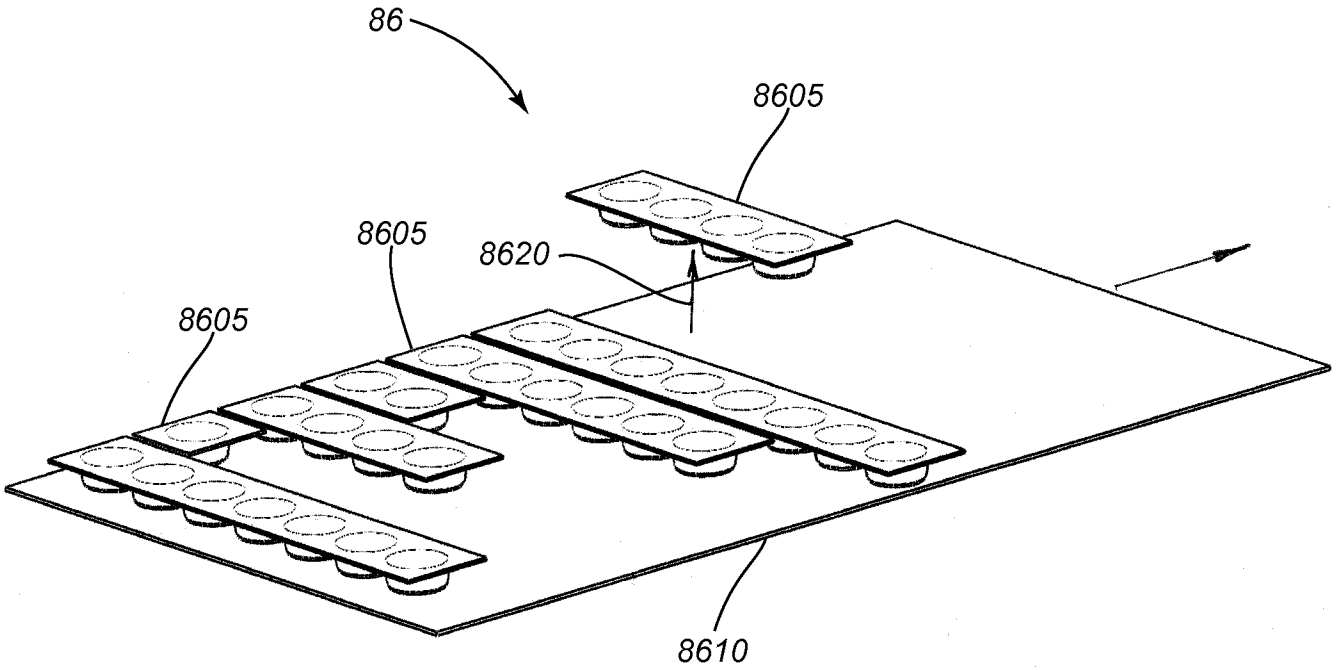
FIG. 42 is a perspective view of still another embodiment of a dispensing apparatus including a plurality of single-use packages removably attached to a dispensing belt in a lateral arrangement.

FIG. 42 shows another alternative arrangement or grouping single-use packages generally similar to that of FIG. 41, except that the single-use packages 8605 are provided in a lateral or sideways belt grouping 86 including a plurality of single-use packages 8605 attached to a sideways belt 8610. The single-use packages 8605 may be removably attached to the sideways belt 8610, e.g., by adhesives, tapes, clips, welding, and the like (not shown), similar to other embodiments herein. Thus, the single-use packages 8605 may be separated from the belt 8610, e.g., by pulling (for example along path 8620), peeling, cutting, and the like. The belt 8610 may be formed from a substantially rigid or flexible sheet of material, e.g., paper, polymer, and the like, which may be provided substantially flat, or arranged in a coiled, serpentine, or other arrangement, as desired.

It will be appreciated that elements or components shown with any embodiment herein are exemplary for the specific embodiment and may be used on or in combination with other embodiments disclosed herein.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the scope of the appended claims.

We claim:

1. A method for creating a disposable product for storing a plurality of sequential and time-based administrations of medications, the product customized according to the prescription of a user, said method comprising:

a. in a system, receiving information about a sequential and time-based prescription of a user, the prescription calling for administration of one or more of a plurality of different medications;

b. in the system, determining prescription-based sequence of single dose packages, the determining including;

i. selecting at least one medication from said plurality of medications to be included in each single dose package of said sequence of single dose packages, wherein the selected medication may vary according to the prescription of the user and from one single-dose package of said sequence of single dose packages to another;

ii. selecting two or more medications from said plurality of different medications to be included in at least one single dose package in said sequence of single dose packages, wherein the selected medications may vary according to the prescription of the user; and iii. customizing the contents of one or more single dose packages in said sequence of single dose packages to have a different number of medications than adjacent single dose packages, to meet the sequential and time-based prescription of the user;

c. using the system for forming a strip including multiple single-use packages to perform a step of customizing a continuous strip according to the prescription-based sequence, the continuous strip including an elongated base layer and an elongated cover layer attached to the elongated base layer, the customizing including:

i. arranging the prescription-based sequence of said single dose package, the arranging further comprising:

1. arranging each sequential single dose package into a respective separable sequential portion of said continuous strip; and 2. arranging said sequence of single dose packages into a first single file;

ii. dispensing one or more medications corresponding to a dose into a single dose package, including dispensing each medication into a different blister, a set of blisters within a single dose package being inseparable.

2. The method of claim 1, wherein said customizing said continuous strip further comprises disposing an identification code on each single dose package, including placing a label on each single-dose package, wherein said label overlies respective blisters for identifying medications in their respective blisters.

3. The method of claim 1, further comprising placing or printing a label including information related to the identity of the patient and an intended timing for administering the medications of the respective single-dose package according to the prescription.

4. The method of claim 2, further comprising configuring the identification code to identify the medications and the location of individual medications within blisters within a single dose package.

5. The method of claim 4, further comprising:

a. receiving an indication to remove a medication from a single dose package;

b. reading a plurality of identification codes on respective single dose packages;

c. using the read identification codes to identify one or more single dose packages having the indicated medication, and a particular blister within the identified single dose package having the indicated medication; and d. removing the indicated medication from the identified blister.

6. The method of claim 1, wherein customizing the continuous strip further comprises spacing apart adjacent single-dose packages from one another at variable distances.

7. The method of claim 1, further comprising winding the continuous strip in a coil or serpentine arrangement such that only one end is accessible and disposing said continuous strip in a cassette housing such that only one single-dose package may be removed at a time from the strip.

8. The method of claim 1, wherein selecting at least one medication from the plurality to be included in each single dose package of the sequence further includes selecting at least two medications from the plurality to be included in each single dose package of the sequence.

9. The method of claim 1, further comprising disposing said continuous strip in a cassette housing such that only one single-dose package may be removed at a time from the strip.

* * * * *